US009702222B2

(12) United States Patent
Hardesty et al.

(10) Patent No.: US 9,702,222 B2
(45) Date of Patent: Jul. 11, 2017

(54) REVERSE FLOW MULTIPLE TOOL SYSTEM AND METHOD

(71) Applicant: GEODynamics, Inc., Millsap, TX (US)

(72) Inventors: John T. Hardesty, Weatherford, TX (US); Philip M. Snider, Tomball, TX (US); David S. Wesson, Fort Worth, TX (US)

(73) Assignee: GEODYNAMICS, INC., Millsap, TX (US)

( * ) Notice: Subject to any disclaimer, the term of this patent is extended or adjusted under 35 U.S.C. 154(b) by 0 days.

(21) Appl. No.: 15/192,435

(22) Filed: Jun. 24, 2016

(65) Prior Publication Data

US 2017/0058641 A1 Mar. 2, 2017

Related U.S. Application Data

(63) Continuation-in-part of application No. 14/877,784, filed on Oct. 7, 2015.

(60) Provisional application No. 62/210,244, filed on Aug. 26, 2015.

(51) Int. Cl.

| | |
|---|---|
| ***E21B 34/14*** | (2006.01) |
| ***E21B 43/26*** | (2006.01) |
| ***E21B 43/14*** | (2006.01) |
| *E21B 34/00* | (2006.01) |

(52) U.S. Cl.

CPC ..... *E21B 34/14* (2013.01); *E21B 43/14* (2013.01); *E21B 43/26* (2013.01); *E21B 2034/007* (2013.01)

(58) Field of Classification Search

CPC ..... E21B 34/14

See application file for complete search history.

(56) References Cited

U.S. PATENT DOCUMENTS

| | | | | |
|---|---|---|---|---|
| 2,117,534 A * | 5/1938 | Baker | E21B 17/14 137/70 |
| 2,752,861 A | 7/1956 | Hill | |
| 2,829,719 A * | 4/1958 | Clark, Jr. | E21B 21/10 137/269 |
| 3,054,415 A | 9/1962 | Baker et al. | |

(Continued)

FOREIGN PATENT DOCUMENTS

| | | |
|---|---|---|
| WO | 2014043807 A1 | 3/2014 |
| WO | 2015065474 A2 | 5/2015 |
| WO | 2015109407 A1 | 7/2015 |

OTHER PUBLICATIONS

U.S. Appl. No. 15/192,435, entitled "Reverse Flow Multiple Tool System and Method," filed Jun. 24, 2016.

(Continued)

*Primary Examiner* — Robert E Fuller

(74) *Attorney, Agent, or Firm* — David W. Carstens; Sudhakar V. Allada; Carstens & Cahoon, LLP

(57) ABSTRACT

A seat forming apparatus for use in a downhole tool comprising a driving member and a seating restriction. The driving member and the seating restriction are mechanically disposed within an outer housing of the downhole tool. When the driving member drives into the seating restriction, the seating restriction or the driving member bend or buckle inwards to form a seat in the downhole tool. The inner diameter of the seat is configured to allow a restriction element to be seated in the seat.

20 Claims, 36 Drawing Sheets

(56) References Cited

U.S. PATENT DOCUMENTS

| | | | | |
|---|---|---|---|---|
| 3,776,258 | A * | 12/1973 | Dockins, Jr. | E21B 21/10 137/269 |
| 2004/0163820 | A1* | 8/2004 | Bishop | E21B 34/14 166/373 |
| 2009/0056952 | A1 | 3/2009 | Churchill | |
| 2010/0089587 | A1 | 4/2010 | Stout | |
| 2012/0227973 | A1 | 9/2012 | Hart et al. | |
| 2013/0037273 | A1 | 2/2013 | Themig et al. | |
| 2013/0153220 | A1* | 6/2013 | Carter | E21B 33/128 166/285 |
| 2013/0264051 | A1 | 10/2013 | Kyle et al. | |
| 2014/0158368 | A1 | 6/2014 | Hoffman et al. | |
| 2014/0318815 | A1 | 10/2014 | Merron | |
| 2016/0258280 | A1* | 9/2016 | Murphree | E21B 47/12 |

OTHER PUBLICATIONS

U.S. Appl. No. 15/200,677, entitled "Reverse Flow Catch-and-Engage Tool and Method," filed Jul. 1, 2016.

European Patent Office, European Search Report for EP 16184462 mailed Jan. 26, 2017.

* cited by examiner

REVERSE FLOW MULTIPLE TOOL SYSTEM AND METHOD

CROSS REFERENCE TO RELATED APPLICATIONS

This application is a continuation-in-part of U.S. application Ser. No. 14/877,784, filed Oct. 7, 2015, which claims the benefit of U.S. Provisional Application No. 62/210,244, filed Aug. 26, 2015, this disclosures of which are fully incorporated herein by reference.

FIELD OF THE INVENTION

The present invention generally relates to oil and gas extraction. Specifically, the invention uses stored energy in a connected region of a hydrocarbon formation to generate reverse flow in a wellbore casing.

PRIOR ART AND BACKGROUND OF THE INVENTION

Prior Art Background

The process of extracting oil and gas typically consists of operations that include preparation, drilling, completion, production and abandonment.

In the drilling of oil and gas wells, a wellbore is formed using a drill bit that is urged downwardly at a lower end of a drill string. After drilling the wellbore is lined with a string of casing.

Open Hole Well Completions

Open hole well completions use hydraulically set mechanical external packers instead of bridge plugs and cement to isolate sections of the wellbore. These packers typically have elastomer elements that expand to seal against the wellbore and do not need to be removed, or milled out, to produce the well. Instead of perforating the casing to allow fracturing, these systems have sliding sleeve tools to create ports in between the packers. These tools can be opened hydraulically (at a specific pressure) or by dropping size-specific actuation balls into the system to shift the sleeve and expose the port. The balls create internal isolation from stage to stage, eliminating the need for bridge plugs. Open hole completions permit fracture treatments to be performed in a single, continuous pumping operation without the need for a drilling rig. Once stimulation treatment is complete, the well can be immediately flowed back and production brought on line. The packer may sustain differential pressures of 10,000 psi at temperatures up to 425° F. and set in holes enlarged up to 50%.

Ball Sleeve Operation

The stimulation sleeves have the capability to be shifted open by landing a ball on a ball seat. The operator can use several different sized dropping balls and corresponding ball-landing seats to treat different intervals. It is important to note that this type of completion must be done from the toe up with the smallest ball and seat working the bottom/lowest zone. The ball activated sliding sleeve has a shear-pinned inner sleeve that covers the fracture ports. A ball larger than the cast iron baffle in the bottom of the inner sleeve is pumped down to the seat on the baffle. A pressure differential sufficient to shear the pins holding the inner sleeve closed is reached to expose and open the fracture ports. When a ball meets its matching seat in a sliding sleeve, the pumped fluid forced against the seated ball shifts the sleeve open and aligns the ports to treat the next zone. In turn, the seated ball diverts the pumped fluid into the adjacent zone and prevents the fluid from passing to previously treated lower zones towards the toe of the casing. By dropping successively increasing sized balls to actuate corresponding sleeves, operators can accurately treat each zone up the wellbore.

The balls can be either drilled up or flowed back to surface once all the treatments are completed. The landing seats are made of a drillable material and can be drilled to give a full wellbore inner diameter. Using the stimulation sleeves with ball-activation capability removes the need for any intervention to stimulate multiple zones in a single wellbore. The description of stimulation sleeves, swelling packers and ball seats are as follows:

Stimulation Sleeve

The stimulation sleeve is designed to be run as part of the casing string. It is a tool that has communication ports between an inner diameter and an outer diameter of a wellbore casing. The stimulation sleeve is designed to give the operator the option to selectively open and close any sleeve in the casing string (up to 10,000 psi differentials at 350° F.).

Swelling Packer

The swelling packer requires no mechanical movement or manipulation to set. The technology is the rubber compound that swells when it comes into contact with any appropriate liquid hydrocarbon. The compound conforms to the outer diameter that swells up to 115% by volume of its original size.

Ball Seats

These are designed to withstand the high erosional effects of fracturing and the corrosive effects of acids. Ball seats are sized to receive/seat balls greater than the diameter of the seat while passing through balls that have a diameter less that the seat.

Because the zones are treated in stages, the lowermost sliding sleeve (toe ward end or injection end) has a ball seat for the smallest sized ball diameter size, and successively higher sleeves have larger seats for larger diameter balls. In this way, a specific sized dropped ball will pass though the seats of upper sleeves and only locate and seal at a desired seat in the well casing. Despite the effectiveness of such an assembly, practical limitations restrict the number of balls that can be run in a single well casing. Moreover, the reduced size of available balls and ball seats results in undesired low fracture flow rates.

Prior Art System Overview (0100)

As generally seen in a system diagram of FIG. 1 (0100), prior art systems associated with open hole completed oil and gas extraction may include a wellbore casing (0101) laterally drilled into a bore hole in a hydrocarbon formation. It should be noted the prior art system (0100) described herein may also be applicable to cemented wellbore casings. An annulus is formed between the wellbore casing (0101) and the bore hole.

The wellbore casing (0101) creates a plurality of isolated zones within a well and includes a port system that allows selected access to each such isolated zone. The casing (0101) includes a tubular string carrying a plurality of packers (0110, 0111, 0112, 0113) that can be set in the annulus to create isolated fracture zones (0160, 0161, 0162, 0163). Between the packers, fracture ports opened through the inner and outer diameters of the casing (0101) in each isolated zone are positioned. The fracture ports are sequentially opened and include an associated sleeve (0130, 0131, 0132, 0133) with an associated sealable seat formed in the inner diameter of the respective sleeves. Various diameter balls (0150, 0151, 0152, 0153) could be launched to seat in their respective seats. By launching a ball, the ball can seal against the seat and pressure can be increased behind the ball to drive the sleeve along the casing (0101), such driving allows a port to open one zone. The seat in each sleeve can be formed to accept a ball of a selected diameter but to allow balls of lower diameters to pass. For example, ball (0150) can be launched to engage in a seat, which then drives a sleeve (0130) to slide and open a fracture port thereby isolating the fracture zone (0160) from downstream zones. The toe ward sliding sleeve (0130) has a ball seat for the smallest diameter sized ball (0150) and successively heel ward sleeves have larger seats for larger balls. As depicted in FIG. 1, the ball (0150) diameter is less than the ball (0151) diameter which is less than the ball (0152) diameter and so on. Therefore, limitations with respect to the inner diameter of wellbore casing (0101) may tend to limit the number of zones that may be accessed due to limitation on the size of the balls that are used. For example, if the well diameter dictates that the largest sleeve in a well casing (0101) can at most accept a 3 inch ball diameter and the smallest diameter is limited to 2 inch ball, then the well treatment string will generally be limited to approximately 8 sleeves at ⅛ inch increments and therefore can treat in only 8 fracturing stages. With $1/16^{th}$ inch increments between ball diameter sizes, the number of stages is limited to 16. Limiting number of stages results in restricted access to wellbore production and the full potential of producing hydrocarbons may not be realized. Therefore, there is a need for actuating sleeves with actuating elements to provide for adequate number of fracture stages without being limited by the size of the actuating elements (restriction plug elements), size of the sleeves, or the size of the wellbore casing.

Prior Art Method Overview (0200)

As generally seen in the method of FIG. 2 (0200), prior art associated with oil and gas extraction includes site preparation and installation of a bore hole in step (0201). In step (0202) preset sleeves may be fitted as an integral part of the wellbore casing (0101) that is installed in the wellbore. The sleeves may be positioned to close each of the fracture ports disallowing access to hydrocarbon formation. After setting the packers (0110, 0111, 0112, 0113) in step (0202), sliding sleeves are actuated by balls to open fracture ports in step (0203) to enable fluid communication between the well casing and the hydrocarbon formation. The sleeves are actuated in a direction from upstream to downstream. Prior art methods do not provide for actuating sleeves in a direction from downstream to upstream. In step (0204), hydraulic fracturing fluid is pumped through the fracture ports at high pressures. The steps comprise launching an actuating ball, engaging in a ball seat, opening a fracture port (0203), isolating a hydraulic fracturing zone, and hydraulic fracturing fluids into the perforations (0204), are repeated until all hydraulic fracturing zones in the wellbore casing are fractured and processed. The fluid pumped into the fracture zones at high pressure remains in the connected regions. The pressure in the connected region (stored energy) is diffused over time. Prior art methods do not provide for utilizing the stored energy in a connected region for useful work such as actuating sleeves. In step (0205), if all hydraulic fracturing zones are processed, all the actuating balls are pumped out or removed from the wellbore casing (0206). A complicated ball counting mechanism may be employed to count the number of balls removed. In step (0207) hydrocarbon is produced by pumping from the hydraulic fracturing stages.

Step (0203) requires that a right sized diameter actuating ball be deployed to seat in the corresponding sized ball seat to actuate the sliding sleeve. Progressively increasing diameter balls are deployed to seat in their respectively sized ball seats and actuating the sliding sleeves. Progressively sized balls limit the number stages in the wellbore casing. Therefore, there is a need for actuating sleeves with actuating elements to provide for adequate number of fracture stages without being limited by the size of the actuating elements, size of the sleeves, or the size of the wellbore casing. Moreover, counting systems use all the same size balls and actuate a sleeve on an "$n^{th}$" ball. For example, counting systems may count the number of balls dropped balls as 10 before actuating on the $10^{th}$ ball.

Furthermore, in step (0203), if an incorrect sized ball is deployed in error, all hydraulic fracturing zones toe ward (injection end) of the ball position may be untreated unless the ball is retrieved and a correct sized ball is deployed again. Therefore, there is a need to deploy actuating seats with constant inner diameter to actuate sleeves with actuating elements just before a hydraulic fracturing operation is performed. Moreover, there is a need to perform out of order hydraulic fracturing operations in hydraulic fracturing zones.

Additionally, in step (0206), a complicated counting mechanism is implemented to make certain that all the balls are retrieved prior to producing hydrocarbon. Therefore, there is a need to use degradable actuating elements that could be flown out of the wellbore casing or flown back prior to the surface prior to producing hydrocarbons.

Additionally, in step (0207), smaller diameter seats and sleeves towards the toe end of the wellbore casing might restrict fluid flow during production. Therefore, there is need for larger inner diameter actuating seats and sliding sleeves to allow unrestricted well production fluid flow. Prior to production, all the sleeves and balls need to be milled out in a separate step.

Deficiencies in the Prior Art

The prior art as detailed above suffers from the following deficiencies:

- Prior art systems do not provide for actuating sleeves with actuating elements to provide for adequate number of fracture stages without being limited by the size of the actuating elements, size of the sleeves, or the size of the wellbore casing.
- Prior art systems such as coil tubing may be used to open and close sleeves, but the process is expensive.
- Prior art methods counting mechanism to count the balls dropped into the casing is not accurate.
- Prior art systems do not provide for a positive indication of an actuation of a downhole tool.
- Prior art methods do not provide for determining the location of a downhole tool.
- Prior art systems do not provide for performing out of order hydraulic fracturing operations in hydraulic fracturing zones.
- Prior art systems do not provide for using degradable actuating elements that could be flown out of the wellbore casing or flown back prior to the surface prior to producing hydrocarbons.
- Prior art systems do not provide for setting constant diameter larger inner diameter sliding sleeves to allow unrestricted well production fluid flow.
- Prior art methods do not provide for actuating sleeves in a direction from downstream to upstream.
- Prior art methods do not provide for utilizing the stored energy in a connected region for useful work.
- Prior art apparatus do not provide for actuating devices in downhole tools with reverse flow.

While some of the prior art may teach some solutions to several of these problems, the core issue of utilizing stored energy in a connected region for useful work has not been addressed by prior art.

BRIEF SUMMARY OF THE INVENTION

System Overview

A multiple tool reverse flow system in a wellbore casing for use in a wellbore is disclosed. The system comprises a plurality of catch-and-release tools and a catch-and-engage tool, wherein the catch-and-release tools allow a restriction element to pass through in a downstream direction and engage and then allow the restriction element to pass through in an upstream direction. The catch-and-engage tool allows the restriction element to pass through only in a downstream direction, engage and restrict travel of the restriction element in an upstream direction. The catch-and-engage tool forms a seat on an upstream end is positioned upstream of all of catch-and-release tools. The restriction element passes through all the tools in a downstream direction and moves back in an upstream direction and actuates each of the tools one at a time.

Method Overview:

The present invention system may be utilized in the context of an overall hydrocarbon extraction method, wherein the reverse flow multiple tool functioning method is described in the following steps:

(1) installing the well casing;
(2) deploying the restriction element into the well casing;
(3) allowing the restriction element to pass through the catch-and-engage tool and then through the plurality of catch-and-release tools in a downstream direction;
(4) flowing back the restriction element in a reverse direction;
(5) engaging the restriction element onto a first catch-and-release tool in the plurality of catch-and-release tools positioned at a downstream most end of the well casing;
(6) arming and exposing a first communication port in the first catch-and-release tool;
(7) releasing the restriction element in an upstream direction to engage onto a second catch-and-release tool in the plurality of catch-and-release tools positioned immediately upstream of the first catch-and-release tool;
(8) engaging the restriction element onto the second catch-and-release tool;
(9) arming and exposing a second communication port in a second catch-and-release tool;
(10) releasing the restriction element in an upstream direction;
(11) repeating the step (4) to step (10) until all of the plurality of catch-and-release tools are armed and exposed;
(12) releasing the restriction element in an upstream direction;
(13) engaging the restriction element onto the catch-and-engage tool;
(14) arming and exposing a communication port in the catch-and-engage tool; and (15) forming a seat in an upstream end of the catch-and-engage tool.

Integration of this and other preferred exemplary embodiment methods in conjunction with a variety of preferred exemplary embodiment systems described herein in anticipation by the overall scope of the present invention.

BRIEF DESCRIPTION OF THE DRAWINGS

For a fuller understanding of the advantages provided by the invention, reference should be made to the following detailed description together with the accompanying drawings wherein.

DESCRIPTION OF THE PRESENTLY PREFERRED EXEMPLARY EMBODIMENTS

Figure 1:
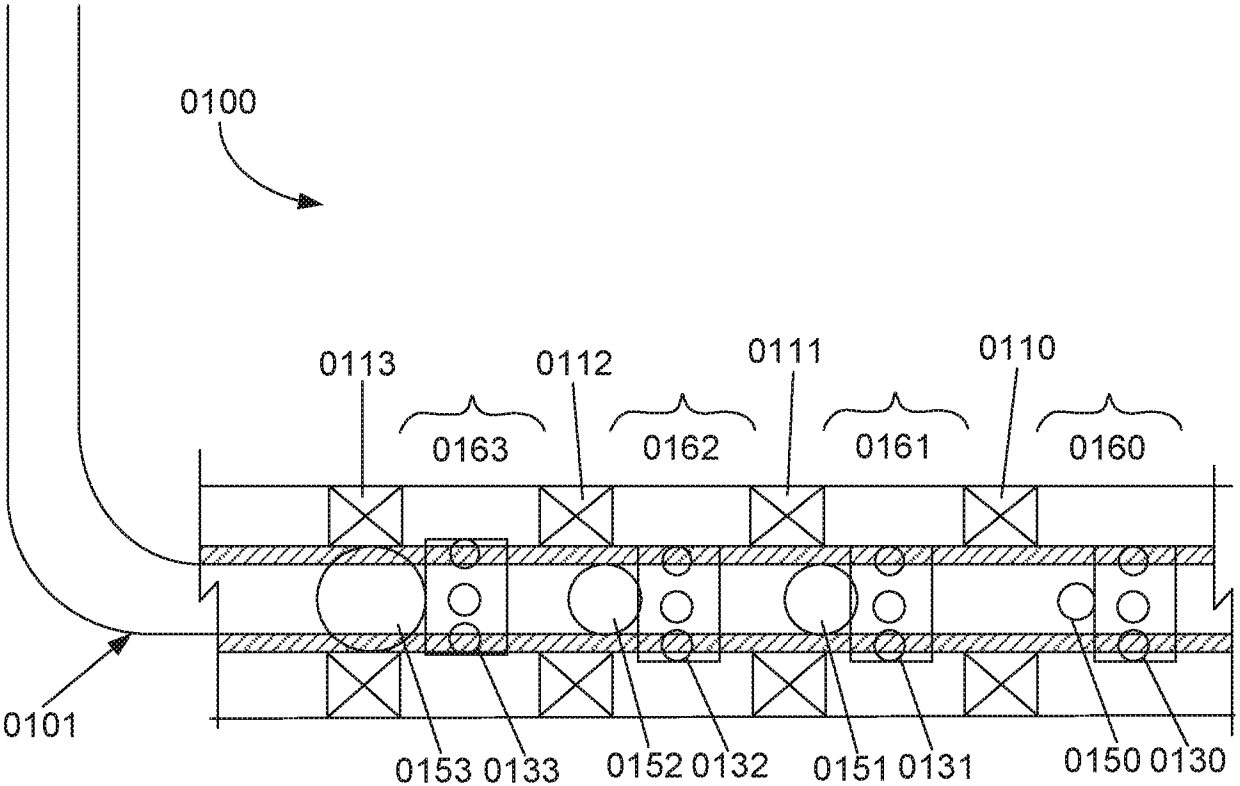
Prior Art FIG. 1
FIG. 1 illustrates a system block overview diagram describing how prior art systems use ball seats to isolate hydraulic fracturing zones.
Figure 2:
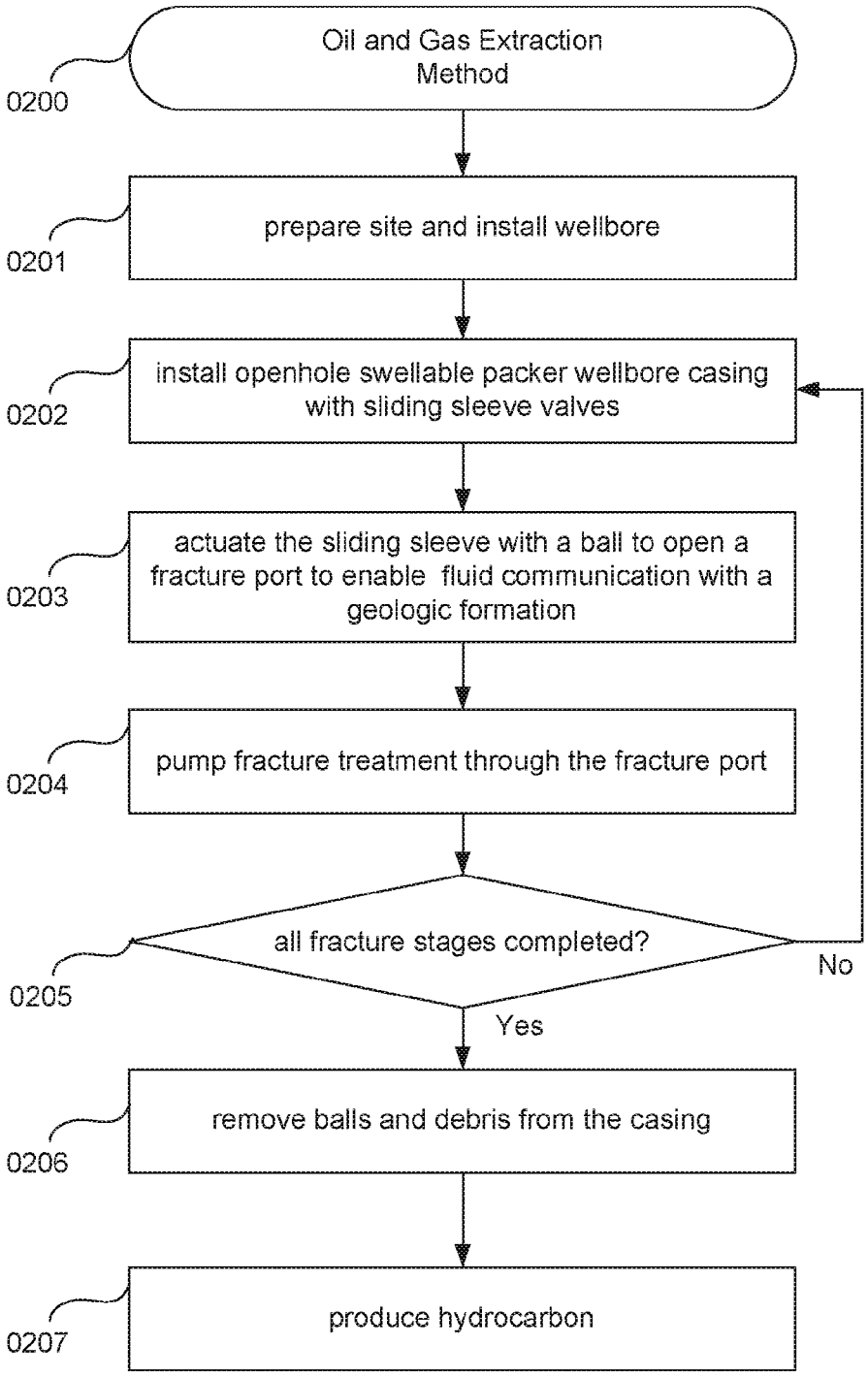
Prior Art FIG. 2
FIG. 2 illustrates a flowchart describing how prior art systems extract oil and gas from hydrocarbon formations.

While this invention is susceptible to embodiment in many different forms, there is shown in the drawings and will herein be described in detail, preferred embodiment of the invention with the understanding that the present disclosure is to be considered as an exemplification of the principles of the invention and is not intended to limit the broad aspect of the invention to the embodiment illustrated.

The numerous innovative teachings of the present application will be described with particular reference to the presently preferred embodiment, wherein these innovative teachings are advantageously applied to the particular problems of a reverse flow tool actuation method. However, it should be understood that this embodiment is only one example of the many advantageous uses of the innovative teachings herein. In general, statements made in the specification of the present application do not necessarily limit any of the various claimed inventions. Moreover, some statements may apply to some inventive features but not to others.

The term "heel end" as referred herein is a wellbore casing end where the casing transitions from vertical direction to horizontal or deviated direction. The term "toe end" described herein refers to the extreme end section of the horizontal portion of the wellbore casing adjacent to a float collar. The terms "upstream" or "uphole" as referred herein is a direction from a toe end towards heel end. The term "downstream" as referred herein is a direction from a heel end to toe end. For example, when a fluid is pumped into the wellhead, the fluid moves in a downstream direction from heel end to toe end. Similarly, when fluid flows back, the fluid moves in an upstream direction from toe end to heel end. In a vertical or deviated well, the direction of flow during reverse flow may be uphole which indicates fluid flow in a direction from the bottom of the vertical casing towards the wellhead. The terms "uphole pressure" "well pressure" "wellbore pressure" as used herein indicates a combined hydrostatic pressure and pressure applied at the well head.

Objectives of the Invention

Accordingly, the objectives of the present invention are (among others) to circumvent the deficiencies in the prior art and affect the following objectives:

- Provide for actuating sleeves with actuating elements to provide for adequate number of fracture stages without being limited by the size of the actuating elements, size of the sleeves, or the size of the wellbore casing.
- Provide for performing out of order hydraulic fracturing operations in hydraulic fracturing zones.
- Provide for using degradable actuating elements that could be flown out of the wellbore casing or flown back prior to the surface prior to producing hydrocarbons.
- Eliminate need for coil tubing intervention.
- Eliminate need for a counting mechanism to count the balls dropped into a casing.
- Provide for setting larger inner diameter actuating sliding sleeves to allow unrestricted well production fluid flow.
- Provide for a method for determining a location of a sliding sleeve based on a monitored pressure differential.
- Provide for a method for determining a proper functioning of a sliding sleeve based on a monitored actuation pressure.

While these objectives should not be understood to limit the teachings of the present invention, in general these objectives are achieved in part or in whole by the disclosed invention that is discussed in the following sections. One skilled in the art will no doubt be able to select aspects of the present invention as disclosed to affect any combination of the objectives described above.

Preferred Embodiment Reverse Flow

When fluid is pumped down and injected into a hydrocarbon formation, the local formation pressure temporarily rises in a region around the injection point. The rise in local formation pressure may depend on the permeability of the formation adjacent to the injection point. The formation pressure may diffuse away from the well over a period of time (diffusion time). During this period of diffusion time, the formation pressure results in stored energy source similar to a charged battery source in an electrical circuit. When the wellhead stops pumping fluid down either by closing a valve or other means, during the diffusion time, a "reverse flow" is achieved when energy is released back into the well. Reverse flow may be defined as a flow back mechanism where the fluid flow direction changes from flowing downstream (heel end to toe end) to flowing upstream (toe end to heel end). The pressure in the formation may be higher than the pressure in the well casing and therefore pressure is balanced in the well casing resulting in fluid flow back into the casing. The flow back due to pressure balancing may be utilized to perform useful work such as actuating a downhole tool such as a sliding sleeve valve. The direction of actuation is from downstream to upstream which is opposite to a conventional sliding sleeve valve that is actuated directionally from upstream to downstream direction. For example, when a restriction plug element such as a fracturing ball is dropped into the well bore casing and seats in a downhole tool, the restriction plug element may flow back due to reverse flow and actuate a sliding sleeve valve that is positioned upstream of the injection point. In a vertical or deviated well, the direction of flow during reverse flow may be uphole.

The magnitude of the local formation pressure may depend on several factors that include volume of the pumping fluid, pump down efficiency of the pumping fluid, permeability of the hydrocarbon formation, an open-hole log before casing is placed in a wellbore, seismic data that may include 3 dimensional formation of interest to stay in a zone, natural fractures and the position of an injection point. For example, pumping fluid into a specific injection point may result in an increase in the displacement of the hydrocarbon formation and therefore an increase in the local formation pressure, the amount, and duration of the local pressure.

The lower the permeability in the hydrocarbon formation the higher local the formation pressure and the longer that pressure will persist.

Preferred Embodiment Reverse Flow Sleeve Actuation (0300-0390)

Figure 3:
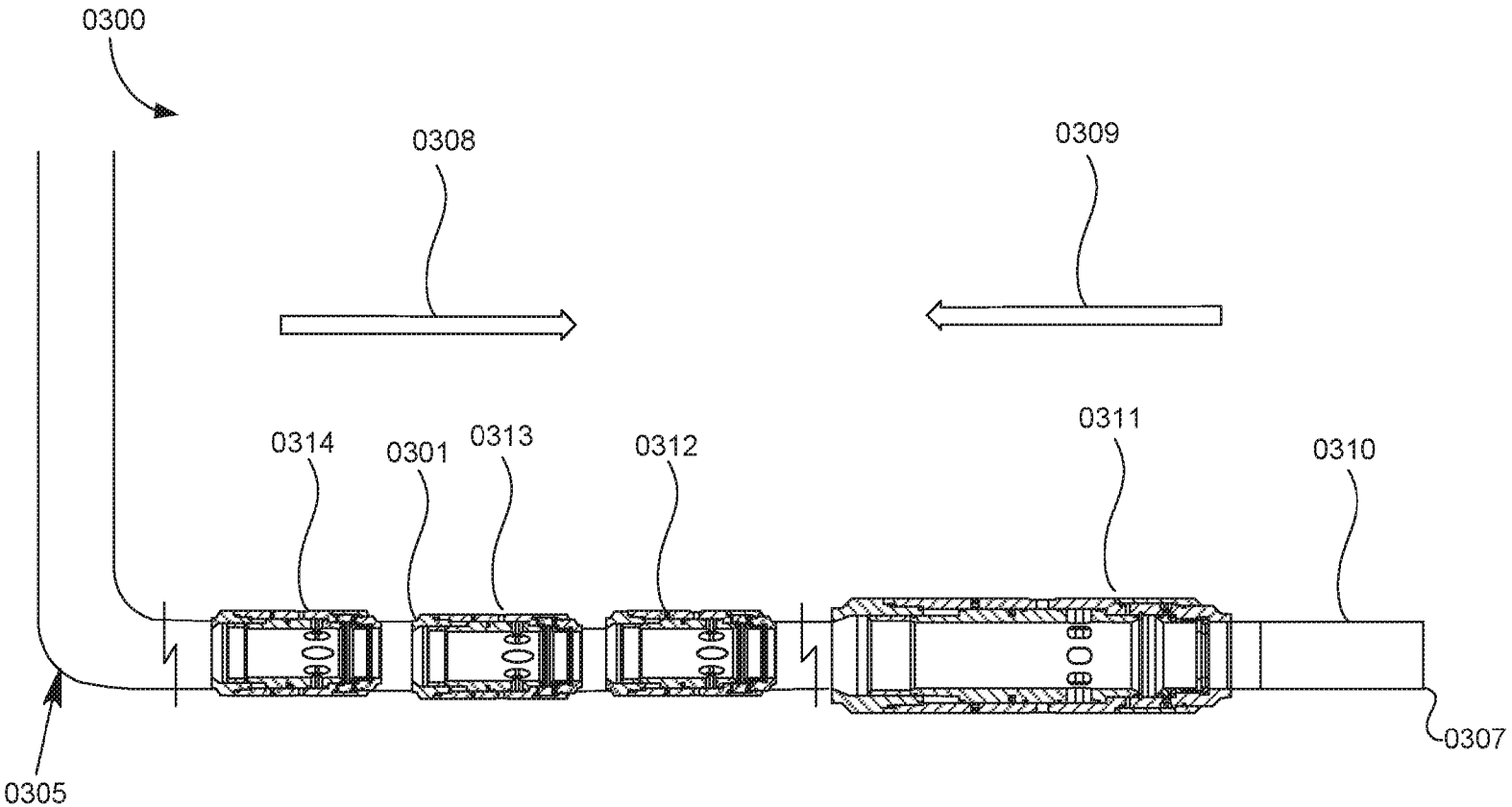
FIG. 3 illustrates an exemplary system overview depicting a wellbore casing along with sliding sleeve valves and a toe valve according to a preferred exemplary embodiment of the present invention.

FIG. 3 (0300) generally illustrates a wellbore casing (0301) comprising a heel end (0305) and a toe end (0307) and installed in a wellbore in a hydrocarbon formation. The casing (0301) may be cemented or may be an open-hole. A plurality of downhole tools (0311, 0312, 0313, 0314) may be conveyed with the wellbore casing. A toe valve (0310) installed at a toe end (0307) of the casing may be conveyed along with the casing (0301). The toe valve (0310) may comprise a hydraulic time delay valve or a conventional toe valve. The downhole tools may be sliding sleeve valves, plugs, deployable seats, and restriction devices. It should be noted the 4 downhole tools (0311, 0312, 0313, 0314) shown in FIG. 3 (0300) are for illustration purposes only, the number of downhole tools may not be construed as a limitation. The number of downhole tools may range from 1 to 10,000. According to a preferred exemplary embodiment, a ratio of an inner diameter of any of the downhole tools to an inner diameter of the wellbore casing may range from 0.5 to 1.2. For example, the inner diameter of the downhole tools (0311, 0312, 0313, 0314) may range from 2¾ inch to 12 inches.

According to another preferred exemplary embodiment, the inner diameters of each of the downhole tools are equal and substantially the same as the inner diameter of the wellbore casing. Constant inner diameter sleeves may provide for adequate number of fracture stages without being constrained by the diameter of the restriction plug elements (balls), inner diameter of the sleeves, or the inner diameter of the wellbore casing. Large inner diameter sleeves may also provide for maximum fluid flow during production. According to yet another exemplary embodiment the ratio an inner diameter of consecutive downhole tools may range from 0.5 to 1.2. For example the ratio of the first sliding sleeve valve (0311) to the second sliding sleeve valve (0312) may range from 0.5 to 1.2. The casing may be tested for casing integrity followed by injecting fluid in a downstream direction (0308) into the hydrocarbon formation through openings or ports in the toe valve (0310). The connected region around the injection point may be energetically charged by the fluid injection in a downstream direction (0308) from a heel end (0305) to toe end (0307). The connected region may be a region of stored energy that may be released when fluid pumping rate from the well head ceases or reduced. The energy release into the casing may be in the form of reverse flow of fluid from the injection point towards a heel end (0305) in an upstream direction (0309). The connected region (0303) illustrated around the toe valve is for illustration purposes only and should not be construed as a limitation. According to a preferred exemplary embodiment, an injection point may be initiated in any of the downhole tools in the wellbore casing.

Figure 3A:
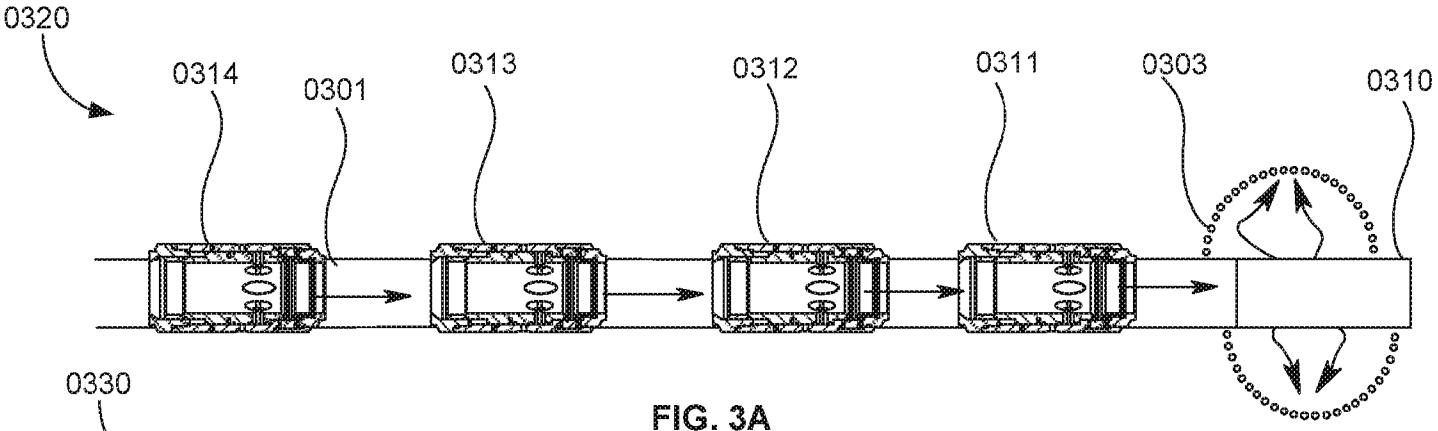
FIG. 3A-3H illustrate a system overview depicting an exemplary reverse flow actuation of downhole tools according to a presently preferred embodiment of the present invention.

FIG. 3A (0320) generally illustrates the wellbore casing (0301) of FIG. 3 (0300) wherein fluid is pumped into the casing at a pressure in a downstream direction (0308). The fluid may be injected through a port in the toe valve (0310) and establishing fluid communication with a hydrocarbon formation. The fluid that is injected into the casing at a pressure may displace a region (connected region, 0303) about the injection point. The connected region (0303) is a region of stored energy where energy may be dissipated or diffused over time. According to a preferred exemplary embodiment, the stored energy in the injection point may be utilized for useful work such as actuating a downhole tool.

Figure 3B:
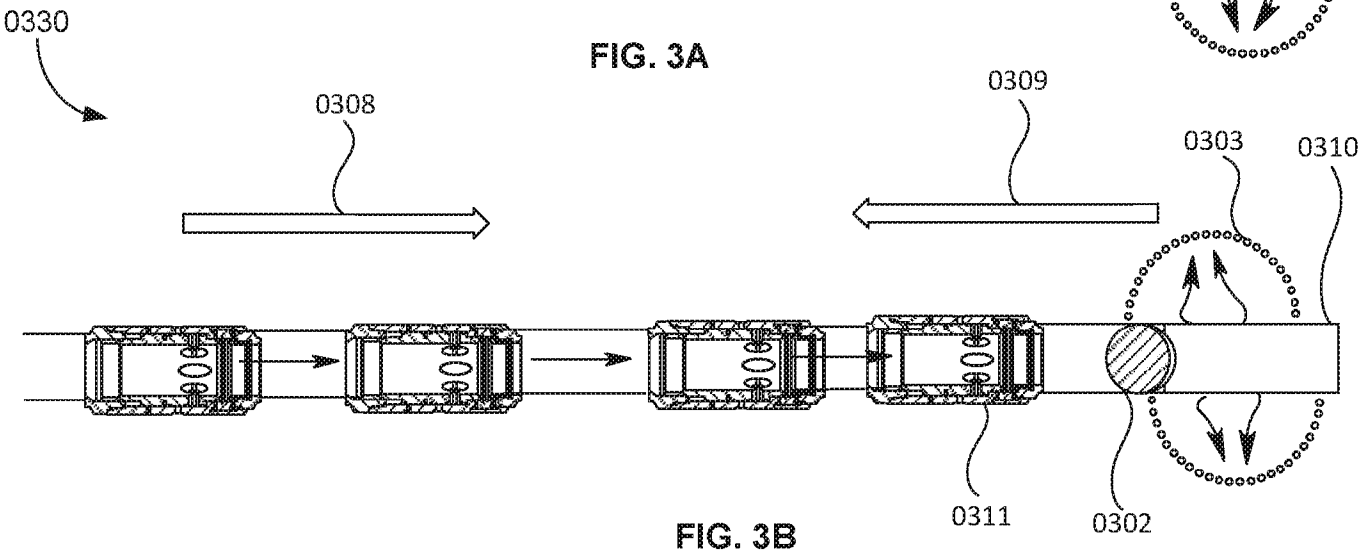

FIG. 3B (0330) generally illustrates a restriction plug element (0302) deployed into the wellbore casing (0301) after the injection point is created and fluid communication is established as aforementioned in FIG. 3A (0320). The plug is pumped in a downstream direction (0308) so that the plug seats against a seating surface in the toe valve (0310). According to another preferred exemplary embodiment, a pressure increase and held steady at the wellhead indicates seating against the upstream end of the toe valve. Factors such as pump down efficiency, volume of the fluid pumped and geometry of the well may be utilized to check for the seating of the restriction plug element in the toe valve. For example, in a 5.5 inch diameter wellbore casing, the amount of pumping fluid may 250 barrels for a restriction plug to travel 10,000 ft. Therefore, the amount of pumping fluid may be used as an indication to determine the location and seating of a plug.

According to a preferred exemplary embodiment the plug is degradable in wellbore fluids with or without a chemical reaction. According to another preferred exemplary embodiment the plug is non-degradable in wellbore fluids. The plug (0302) may pass through all the unactuated downhole tools (0311, 0312, 0313, 0314) and land on a seat in an upstream end of a tool that is upstream of the injection point. The inner diameters of the downhole tools may be large enough to enable pass through of the plug (0302). According to a further exemplary embodiment, the first injection point may be initiated from any of the downhole tools. For example, an injection point may be initiated through a port in sliding sleeve valve (0312) and a restriction plug element may land against a seat in sliding sleeve valve (0312). The restriction plug element in the aforementioned example may pass through each of the unactuated sliding sleeve valves (0313, 0314) that are upstream to the injection point created in sliding sleeve valve (0312). According to another preferred exemplary embodiment the restriction plug element shapes are selected from a group consisting of: a sphere, a cylinder, and a dart. According to a preferred exemplary embodiment the restriction plug element materials are selected from a group consisting of a metal, a nonmetal, and a ceramic. According to yet another preferred exemplary embodiment, restriction plug element (0302) may be degradable over time in the well fluids eliminating the need for them to be removed before production. The restriction plug element (0302) degradation may also be accelerated by acidic components of hydraulic fracturing fluids or wellbore fluids, thereby reducing the diameter of restriction plug element (0302) and enabling the plug to flow out (pumped out) of the wellbore casing or flow back (pumped back) to the surface before production phase commences.

Figures 3C, 3D, 3E:
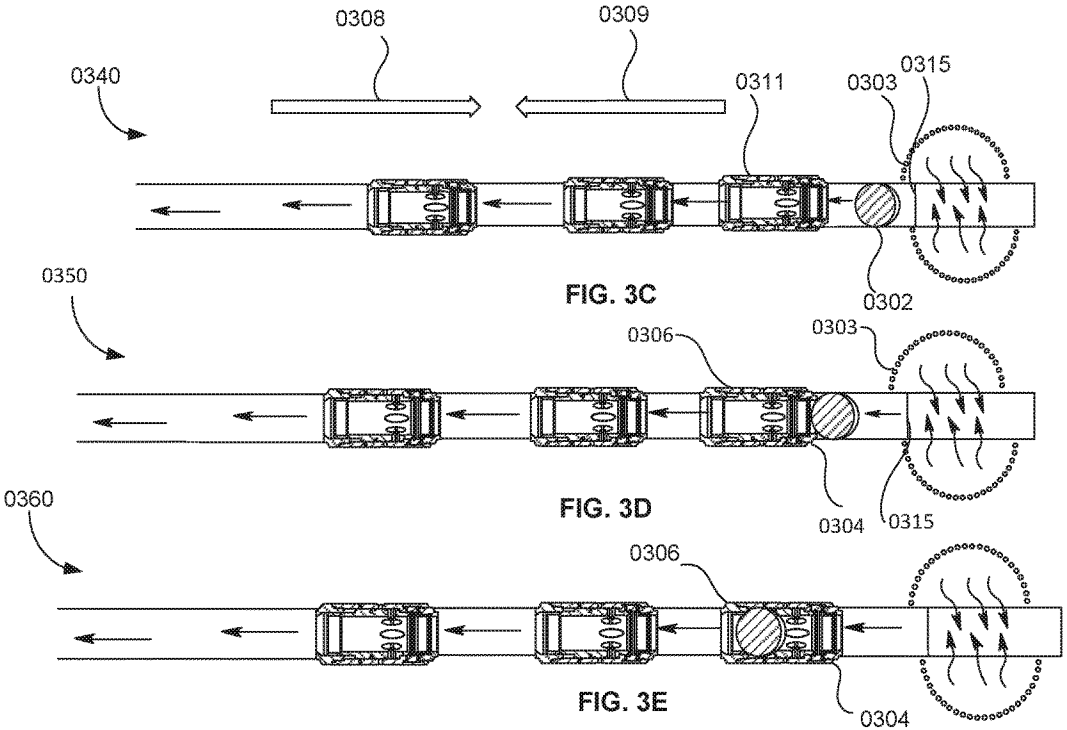

FIG. 3C (0340) and FIG. 3D (0350) generally illustrate a reverse flow of the well wherein the pumping at the wellhead is reduced or stopped. The pressure in the formation may be higher than the pressure in the well casing and therefore pressure is balanced in the well casing resulting in fluid flow back from the connected region (0303) into the casing (0301). The stored energy in the connected region (0303) may be released into the casing that may result in a reverse flow of fluid in an upstream direction (0309) from toe end to heel end. The reverse flow action may cause the restriction plug element to flow back from an upstream end (0315) of the toe valve (0310) to a downstream end (0304) of a sliding sleeve valve (0311). According to a preferred exemplary embodiment the sliding sleeve valve is positioned upstream of the injection point in the toe valve. An increase in the reverse flow may further deform the restriction plug element (0302) and enable the restriction plug element to engage onto the downstream end (0304) of the sliding sleeve valve (0311). The deformation of the restriction plug element (0302) may be such that the plug does not pass through the sliding sleeve valve in an upstream direction. According to a preferred exemplary embodiment, an inner diameter of the sliding sleeve valve is lesser than a diameter of the restriction element such that the restriction element does not pass through said the sliding sleeve in an upstream direction. According to another preferred exemplary embodiment, a pressure drop off at the wellhead indicates seating against the downstream end of the sliding sleeve valve.

FIG. 3E (0360) generally illustrates a restriction plug element (0302) actuating the sliding sleeve valve (0311) as a result of the reverse flow from downstream to upstream. According to a preferred exemplary embodiment, the actuation of the valve (0311) also reconfigures the upstream end of the valve (0311) and creates a seating surface for subsequent restriction plug elements to seat in the seating surface. A more detailed description of the valve reconfiguration is further illustrated in FIG. 4A-FIG. 4E. According to a preferred exemplary embodiment, a sleeve in the sliding sleeve valve travels in a direction from downstream to upstream and enables ports in the first sliding sleeve valve to open fluid communication to the hydrocarbon formation. According to a preferred exemplary embodiment, a pressure differential at the wellhead may indicate pressure required to actuate the sliding sleeve valve. Each of the sliding sleeve valves may actuate at a different pressure differential (▲P). For example valve (0311) may have a pressure differential of 1000 PSI, valve (0311) may have a pressure differential of 1200 PSI. According to another preferred exemplary embodiment, the pressure differential to actuate a downhole tool may indicate a location of the downhole tool being actuated.

Figures 3F, 3G, 3H:
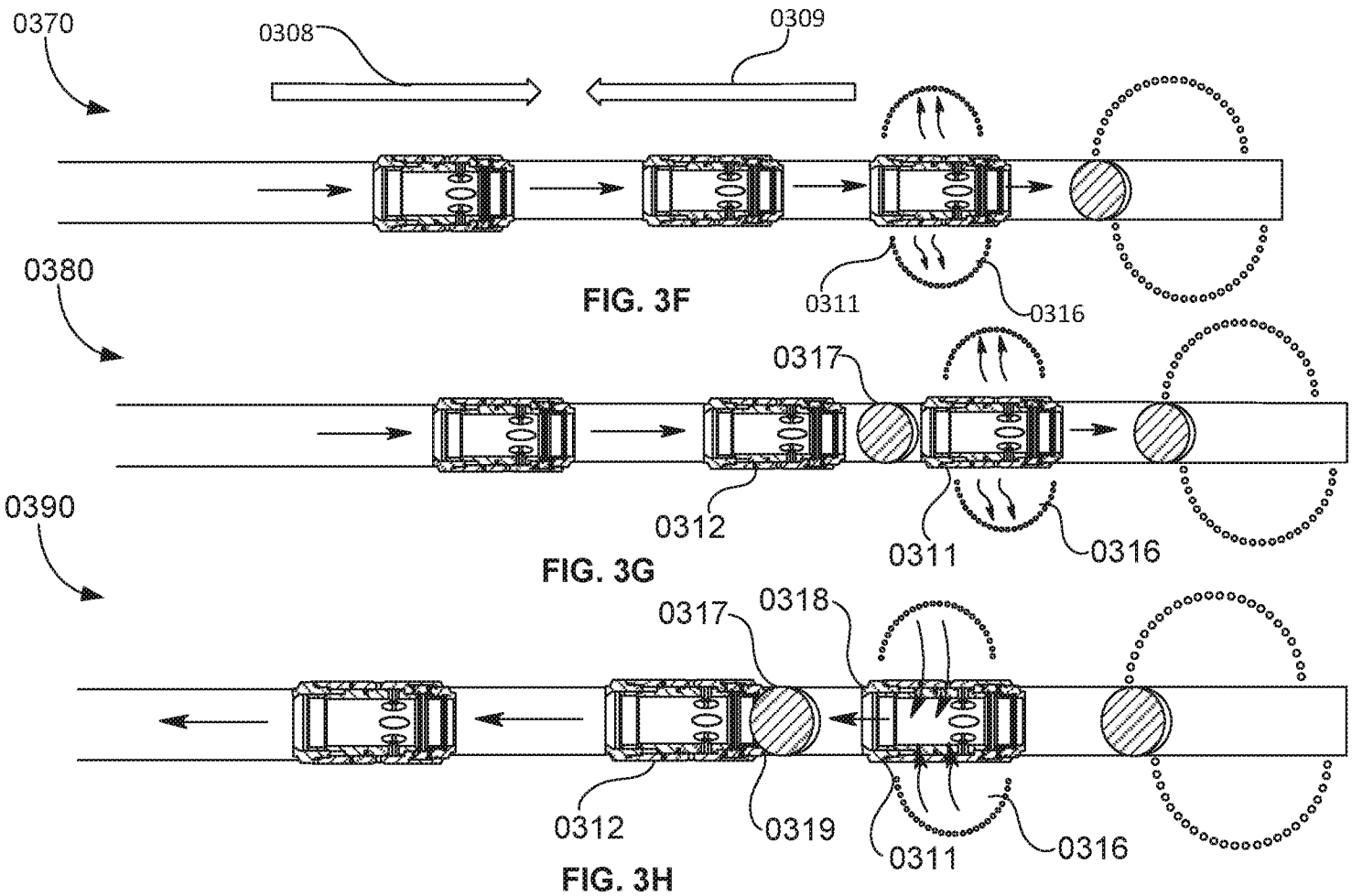

After the sliding sleeve valve (0311) is actuated as illustrated in FIG. 3E (0360), fluid may be pumped into the casing (0301) as generally illustrated in FIG. 3F (0370). The fluid flow may change to downstream (0308) direction as the fluid is pumped down. A second injection point and a second connected region (0316) may be created through a port in the sliding sleeve valve (0311). Similar to the connected region (0303), connected region (0316) may be a region of stored energy that may be utilized for useful work.

As generally illustrated in FIG. 3G (0380), a second restriction plug element (0317) may be pumped into the wellbore casing (0301). The plug (0317) may seat against the seating surface created in an upstream end (0306) during the reconfiguration of the valve as illustrated in FIG. 3E (0360). The plug (0317) may pass through each of the unactuated sliding sleeve valves (0314, 0313, 0312) before seating against the seating surface.

FIG. 3H (0390) generally illustrates a reverse flow of the well wherein the pumping at the wellhead is reduced or stopped similar to the illustration in FIG. 3C (0350). The pressure in the formation may be higher than the pressure in the well casing and therefore pressure is balanced in the well casing resulting in fluid flow back from the connected region (0316) into the casing (0301). The stored energy in the connected region (0316) may be released into the casing that may result in a reverse flow of fluid in an upstream direction (0309) from toe end to heel end. The reverse flow action may cause the restriction plug element (0317) to flow back from an upstream end (0318) of the sliding sleeve valve (0311) to a downstream end (0319) of a sliding sleeve valve (0312). Upon further increase of the reverse flow, the plug (0317) may deform and engage on the downstream end (0319) of the valve (0312). The plug (0317) may further actuate the valve (0312) in a reverse direction from downstream to upstream. Conventional sliding sleeve valves are actuated from upstream to downstream as opposed to the exemplary reverse flow actuation as aforementioned.

Preferred Embodiment Reverse Flow Sleeve Actuation (0400)

Figures 4A, 4B, 4C:
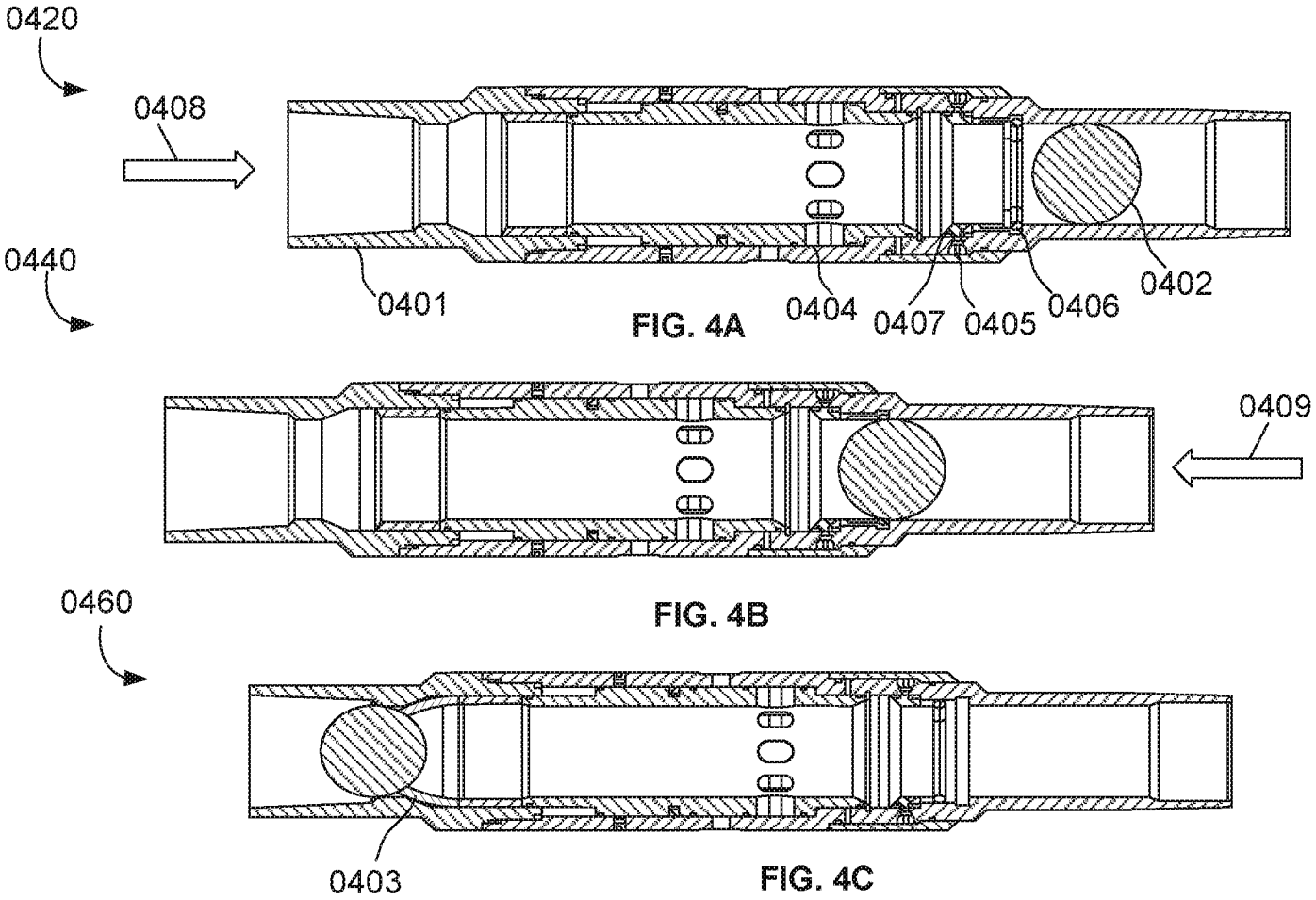
FIG. 4A-4C illustrate a system overview depicting an exemplary reverse flow actuation of sliding sleeves comprising a restriction feature and a reconfigurable seat according to a presently preferred embodiment of the present invention.

As generally illustrated in FIG. 4A (0420), FIG. 4B (0440) and FIG. 4C (0460), a sliding sleeve valve installed in a wellbore casing (0401) comprises an outer mandrel (0404) and an inner sleeve with a restriction feature (0406). The sliding sleeves (0311, 0312, 0313, 0314) illustrated in FIG. 3A-3H may be similar to the sliding sleeves illustrated in FIG. 4A-4C. A restriction plug element may change shape when the flow reverses. As generally illustrated in FIG. 4A (0420) and FIG. 4B (0440) the restriction plug (0402) deforms and changes shape due to the reverse flow or other means such as temperature conditions and wellbore fluid interaction. The restriction plug element (0402) may engage onto the restriction feature (0406) and enable the inner sleeve (0407) to slide when a reverse flow is established in the upstream direction (0409). When the inner sleeve slides as illustrated in FIG. 4C (0460), ports (0405) in the mandrel (0404) open such that fluid communication is established to a hydrocarbon formation. According to a preferred exemplary embodiment, the restriction feature engages the restriction plug element on a downstream end of the sliding sleeve when a reverse flow is initiated. The sleeve may further reconfigure to create a seat (0403) when reverse flow continues and the valve is actuated.

Preferred Exemplary Reverse Flow Sleeve Actuation Flowchart Embodiment (0500)

Figure 5A:
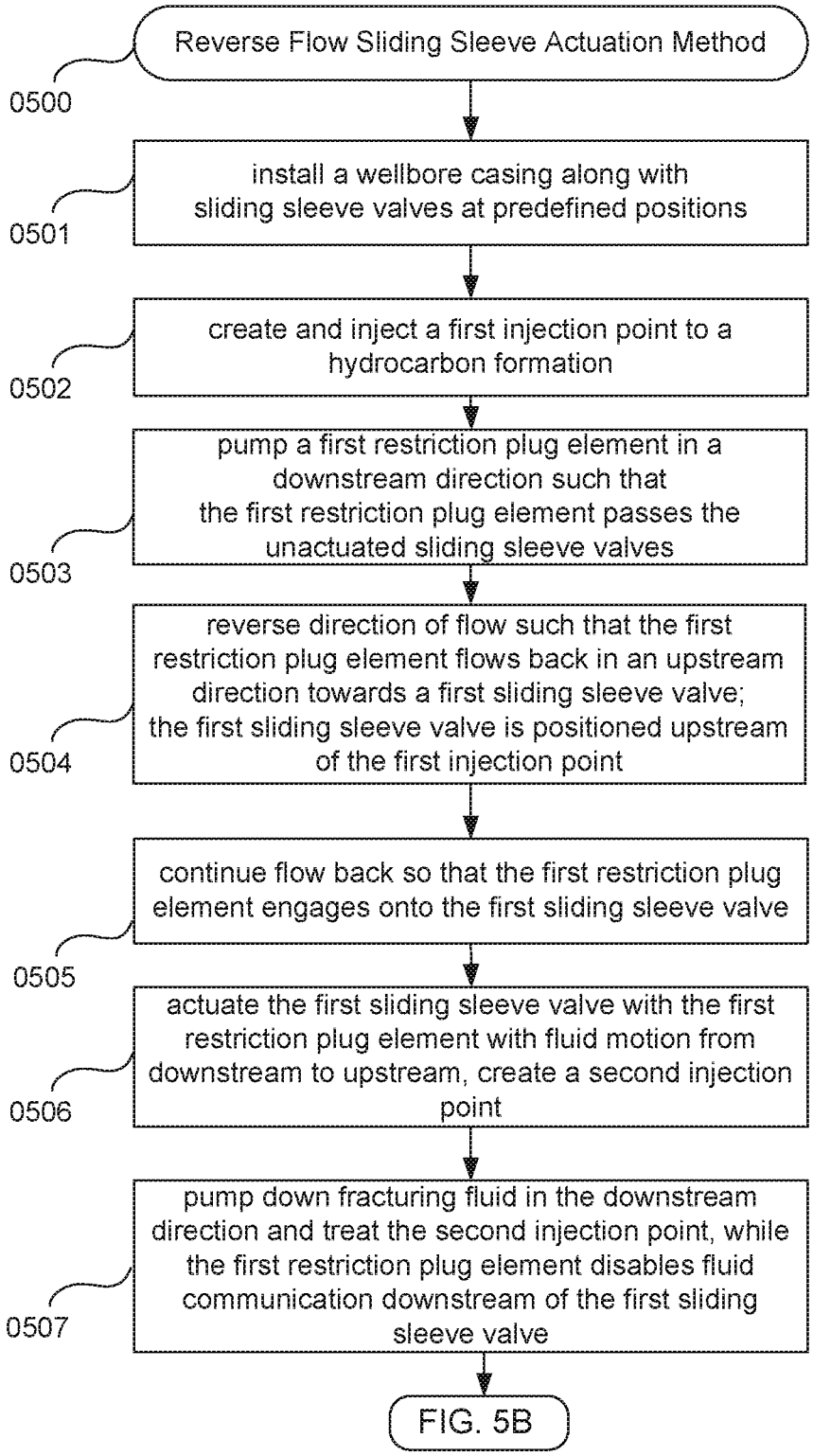
FIG. 5A-5B illustrate a detailed flowchart of a preferred exemplary reverse flow actuation of sliding sleeves method used in some preferred exemplary invention embodiments.
Figure 5B:
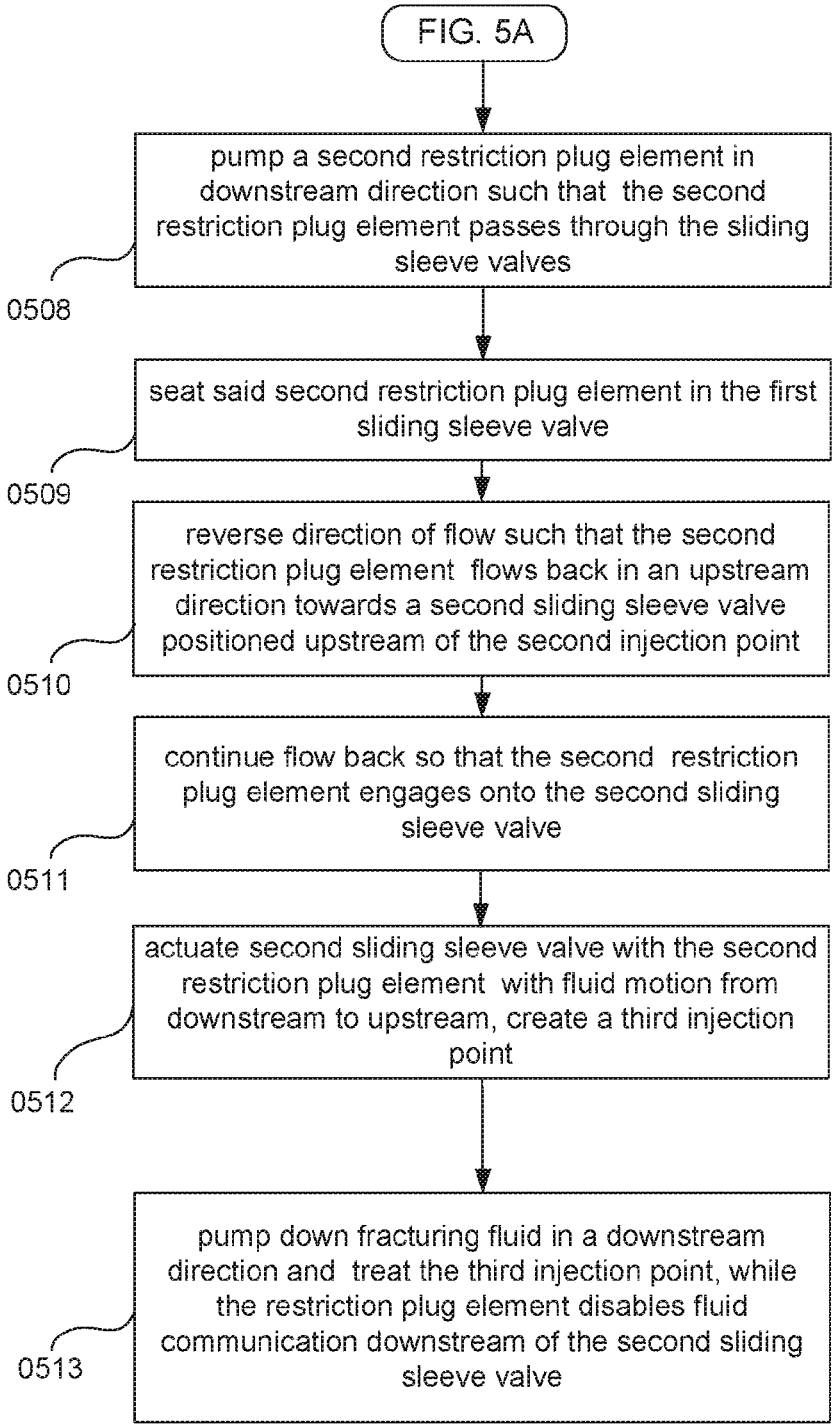

As generally seen in the flow chart of FIG. 5A and FIG. 5B (0500), a preferred exemplary reverse flow sleeve actuation method may be generally described in terms of the following steps:

(1) installing the wellbore casing along with sliding sleeve valves at predefined positions (0501);

(2) creating and treating a first injection point to a hydrocarbon formation (0502);

The first injection point may be in a toe valve as illustrated in FIG. 3A. The first injection point may be in any of the downhole tools such as the sliding sleeve valves (0311, 0312, 0313, 0314). The first injection point may be created by opening communication through a port in the toe valve. The first injection point may then be treated with treatment fluid so that energy is stored in the connected region.

(3) pumping a first restriction plug element in a downstream direction such that the first restriction plug element passes the unactuated sliding sleeve valves (0503);

The first restriction plug element may be a fracturing ball (0302) as illustrated in FIG. 3B. The fracturing ball (0302) may pass through the unactuated sliding sleeve valves (0311, 0312, 0313, 0314).

(4) reversing direction of flow such that the first restriction plug element flows back in an upstream direction towards a first sliding sleeve valve; the first sliding sleeve valve positioned upstream of the first injection point (0504);

The pumping rate at the wellhead may be slowed down or stopped so that a reverse flow of the fluid initiates from a connected region, for example connected region (0303) illustrated in FIG. 3C. The reverse flow may be from toe end to heel end in an upstream direction (0309).

(5) continuing flow back so that the first restriction plug element engages onto the first sliding sleeve valve (0505);

As illustrated in FIG. 3D the reverse flow may continue such that the plug element (0302) may engage onto a downstream end (0304) of the first sliding sleeve valve (0311).

(6) actuating the first sliding sleeve valve with the first restriction plug element with fluid motion from downstream to upstream and creating a second injection point (0506);

As illustrated in FIG. 3E, the plug element (0302) may actuate a sleeve in the sliding valve (0311) as the reverse flow continues with fluid motion from toe end to heel end. The first sliding sleeve valve may reconfigure during the actuation process such that a seating surface is created on the upstream end (0306) of the sliding sleeve valve (0311). The second injection point may be created by opening communication through a port in the first sliding sleeve valve.

The first sliding sleeve valve (0311) may further comprise a pressure actuating device such as a rupture disk. The pressure actuating device may be armed by exposure to wellbore. During the reverse flow a pressure port in the sliding sleeve valve (0311) may be opened so that the rupture disk is armed. The sleeve may then be actuated by pumping down fluid. The reverse flow may be adequate for the pressure actuating device to be armed and a higher pump down pressure may actuate the sleeve. The sliding sleeve may also comprise a hydraulic time delay element that delays the opening of the valve.

(7) pumping down treatment fluid in the downstream direction and treating the second injection point, while the first restriction plug element disables fluid communication downstream of the first sliding sleeve valve (0507);

After the sleeve is actuated in step (6), pumping rate of the fluid may be increased in a downstream direction (0308) so that the second injection point (0316) may be treated as illustrated in FIG. 3F. Fluid communication may be established to the hydrocarbon formation.

(8) pumping a second restriction plug element in a downstream direction such that the second restriction plug element passes through the sliding sleeve valves (0508);

As illustrated in FIG. 3G, a second plug (0317) may be deployed into he casing. The second plug (0317) may pass through each of the unactuated sliding sleeve valves (0312, 0313, 0314) in a downstream direction.

(9) seating the second restriction plug element in the first sliding sleeve valve (0509);

The second plug (0317) may seat in the seating surface that is created on the upstream end (0306) of the sliding sleeve valve (0311) as illustrated in FIG. 3H.

(10) reversing direction of flow such that the second restriction plug element flows back in an upstream direction towards a second sliding sleeve valve positioned upstream of the second injection point (0510);

Flow may be reversed similar to step (4) so that fluid flows from the connected region (0316) into the wellbore casing (0310). The motion of the reverse flow may enable the second plug (0317) to travel in an upstream direction (0309).

(11) continuing flow back so that the second restriction plug element engages onto the second sliding sleeve valve (0511);

Continuing the reverse flow may further enable the second plug (0317) to engage onto a downstream end of the second sliding sleeve valve (0312).

(12) actuating the second sliding sleeve valve with the second restriction plug element with fluid motion from downstream to upstream and creating a third injection point (0512); and The second sliding sleeve valve (0312) may be actuated by the second plug (0317) in a direction from downstream to upstream.

(13) pumping down treatment fluid in a downstream direction and treating the third injection point, while the restriction plug element disables fluid communication downstream of the second sliding sleeve valve (0513).

Fluid may be pumped in the downstream direction to treat the third injection point while the second plug (0317) disables fluid communication downstream of the third injection point.

The second sliding sleeve valve (0312) may further comprise a pressure actuating device such as a rupture disk. The pressure actuating device may be armed by exposure to wellbore. During the reverse flow a pressure port in the sliding sleeve valve (0312) may be opened so that the rupture disk is armed. The sleeve may then be actuated by pumping down fluid. The reverse flow may be adequate for the pressure actuating device to be armed and a higher pump down pressure may actuate the sleeve. The second sliding sleeve may also comprise a hydraulic time delay element that delays the opening of the valve.

The steps (8)-(13) may be continued until all the stages of the well casing are completed.

Preferred Exemplary Reverse Flow Sleeve Actuation Pressure Chart Embodiment (0600)

Figure 6:
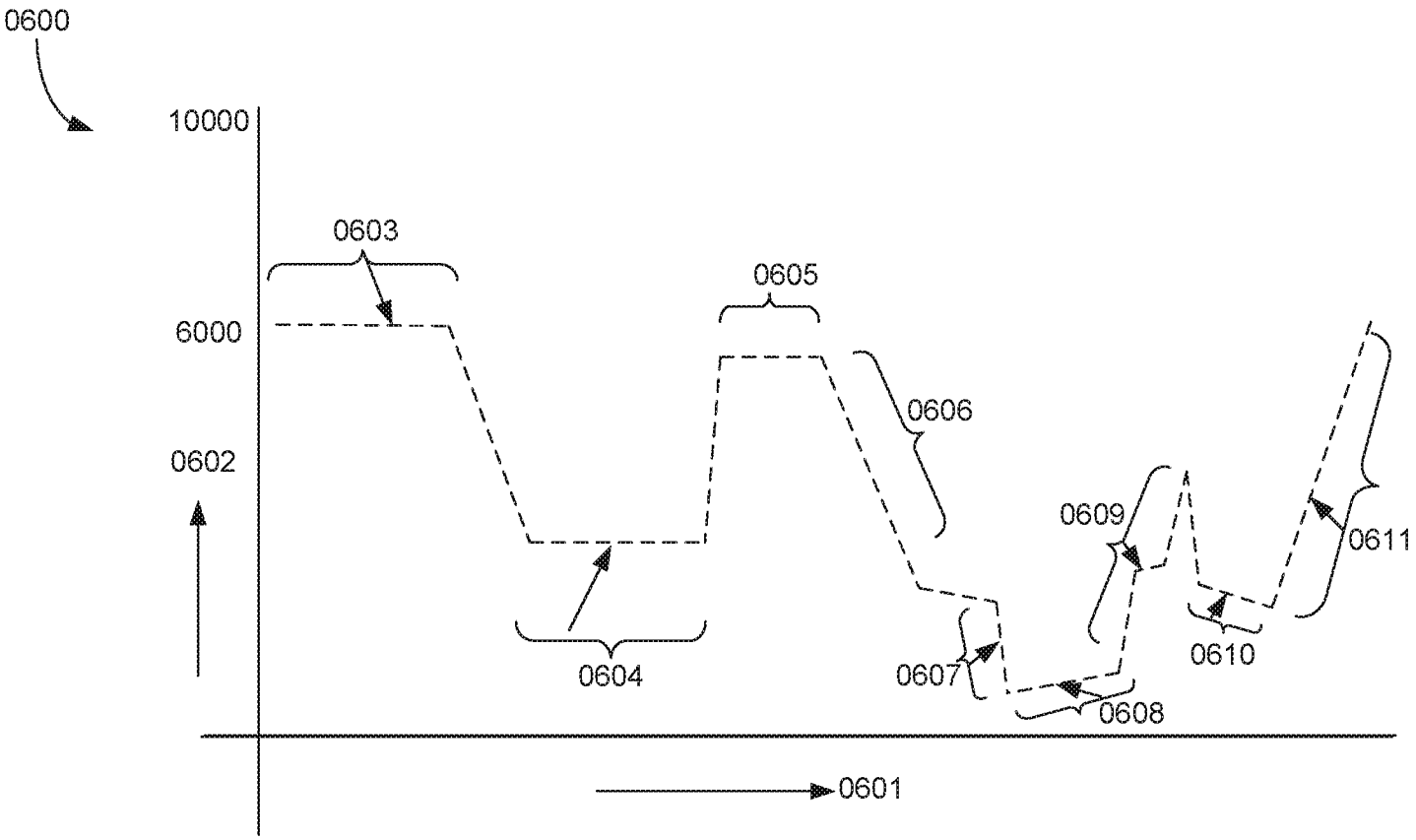
FIG. 6 illustrates an exemplary pressure chart depicting an exemplary reverse flow actuation of downhole tools according to a presently preferred embodiment of the present invention.

A pressure (0602) Vs time (0601) chart monitored at a well head is generally illustrated in FIG. 6 (0600). The chart may include the following sequence of events in time and the corresponding pressure (1) Pressure (0603) generally corresponds to a pressure when a restriction plug element similar to ball (0302) is pumped into a wellbore casing at a pumping rate of 20 barrels per minute (bpm).

According to a preferred exemplary embodiment the pressure (0603) may range from 3000 PSI to 12,000 PSI. According to a more preferred exemplary embodiment the pressure (0603) may range from 6000 PSI to 8,000 PSI.

Pressure (0604) or seating pressure generally corresponds to a pressure when a ball lands on a seat such as a seat in a toe valve (0310). The pumping rate may be reduced to 4 bpm.

(3) Pressure (0605) may be held when the ball seats against the seat. The pressure may be checked to provide an indication of ball seating as depicted in step (0704) of FIG. 7.

According to a preferred exemplary embodiment the seating pressure (0605) may range from 2000 PSI to 10,000 PSI. According to a more preferred exemplary embodiment the seating pressure (0605) may range from 6000 PSI to 8,000 PSI.

(4) Pumping rate may be slowed down so that fluid from a connected region may flow into the casing and result in a pressure drop (0606).

For example, the pumping rate may be slowed down from 20 bpm to 1 bpm.

(5) The ball may flow back in an upstream direction due to reverse flow resulting in a further drop in pressure (0607).

(6) A sleeve such as sleeve (0311) may be actuated with a pressure differential (0608). The pressure differential may be different for each of the sliding sleeves. As more injection points are opened up upstream in sliding sleeves, the pressure differential may decrease and a location of the sliding sleeve may be determined based on the pressure differential. An improper pressure differential may also indicate a leak past the ball.

According to a preferred exemplary embodiment the differential pressure (0608) may range from 1000 PSI to 5,000 PSI. According to a more preferred exemplary embodiment the seating pressure (0608) may range from 1000 PSI to 3,000 PSI. According to a most preferred exemplary embodiment the seating pressure (0608) may range from 1000 PSI to 2,000 PSI.

(7) After a sleeve is actuated, pressure (0609) may be increased to open the sleeve and seat the ball in the downhole tool.

(8) Establishing a second injection point in the sleeve (0311), pressure drop (0610) may result due to the release of pressure into the connected region through the second injection point.

(9) The pumping rate of the fluid to be injected and pressure increased (0611) so that injection is performed through the second injection point.

Preferred Exemplary Reverse Flow Sleeve Actuation Flowchart Embodiment (0700)

Figure 7:
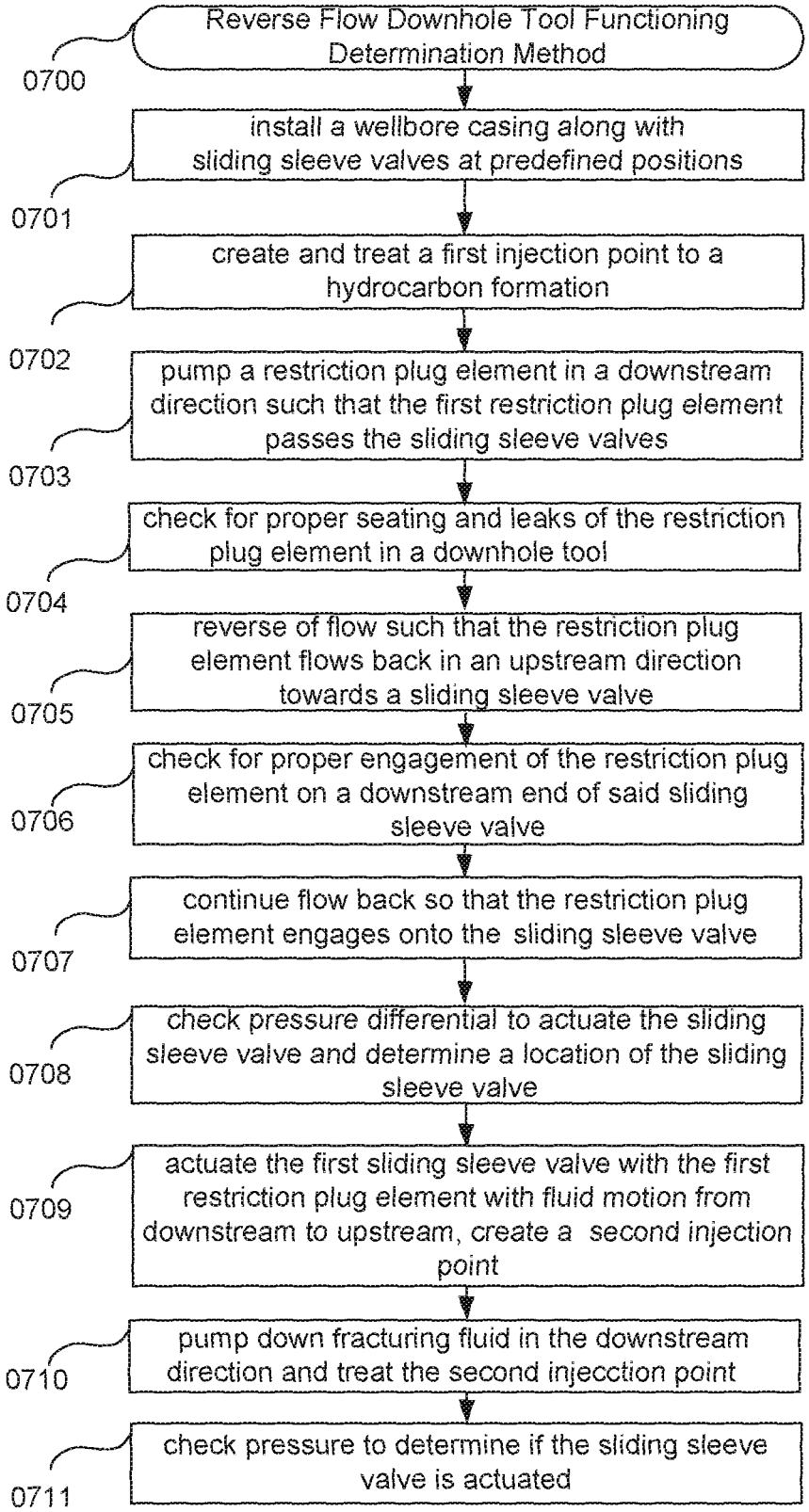
FIG. 7 illustrates a detailed flowchart of a preferred exemplary sleeve functioning determination method used in some exemplary invention embodiments.

As generally seen in the flow chart of FIG. 7 (0700), a preferred exemplary method for determining proper functionality of sliding sleeve valves may be generally described in terms of the following steps:

(1) installing the wellbore casing along with the sliding sleeve valves at predefined positions (0701);

(2) creating a first injection point to a hydrocarbon formation (0702);

(3) pumping a first restriction plug element in a downstream direction such that the restriction plug element passes unactuated the sliding sleeve valves (0703);

(4) checking for proper seating of the restriction plug element in a downhole tool (0704);

(5) reversing direction of flow such that the restriction plug element flows back in an upstream direction towards a sliding sleeve valve; the sliding sleeve valve positioned upstream of the first injection point (0705);

(6) continuing flow back so that the restriction plug element engages onto the sliding sleeve valve (0706);

(7) checking for proper engagement of the restriction plug element on a downstream end of the sliding sleeve valve (0707);

(8) actuating the sliding sleeve valve with the restriction plug element with fluid motion from downstream to upstream (0708);

(9) checking pressure differential to actuate the sliding sleeve and determining a location of the sliding sleeve valve (0709);

(10) pumping down treatment fluid in the downstream direction and creating a second injection point, while the restriction plug element disables fluid communication downstream of the sliding sleeve valve (0710); and

(11) checking pressure to determine if the sliding sleeve valve is actuated (0711).

Preferred Exemplary Reverse Flow Sleeve Actuation Flowchart Embodiment (0800)

Figure 8A:
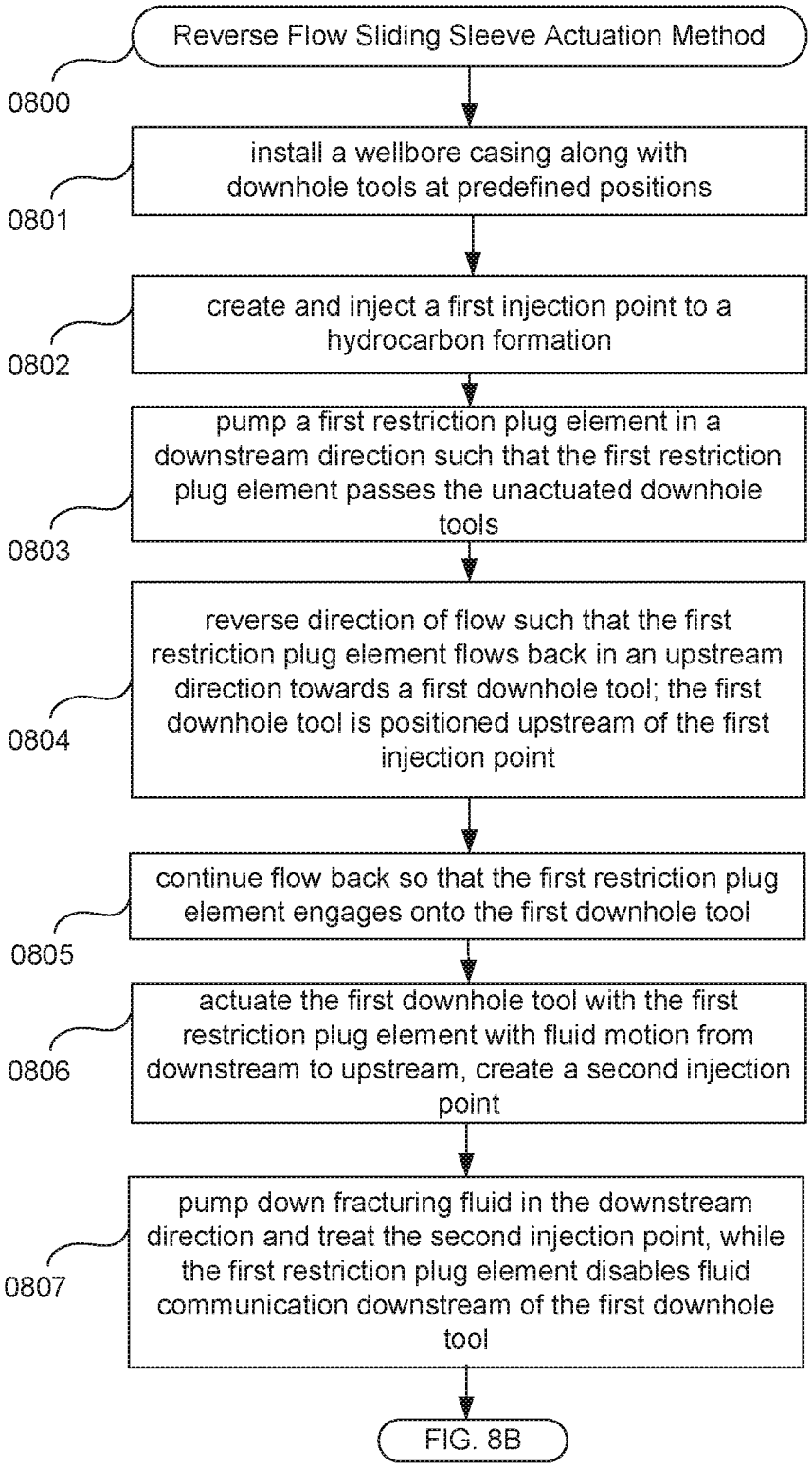
FIG. 8A-8B illustrate a detailed flowchart of a preferred exemplary reverse flow actuation of downhole tools method used in some preferred exemplary invention embodiments.
Figure 8B:
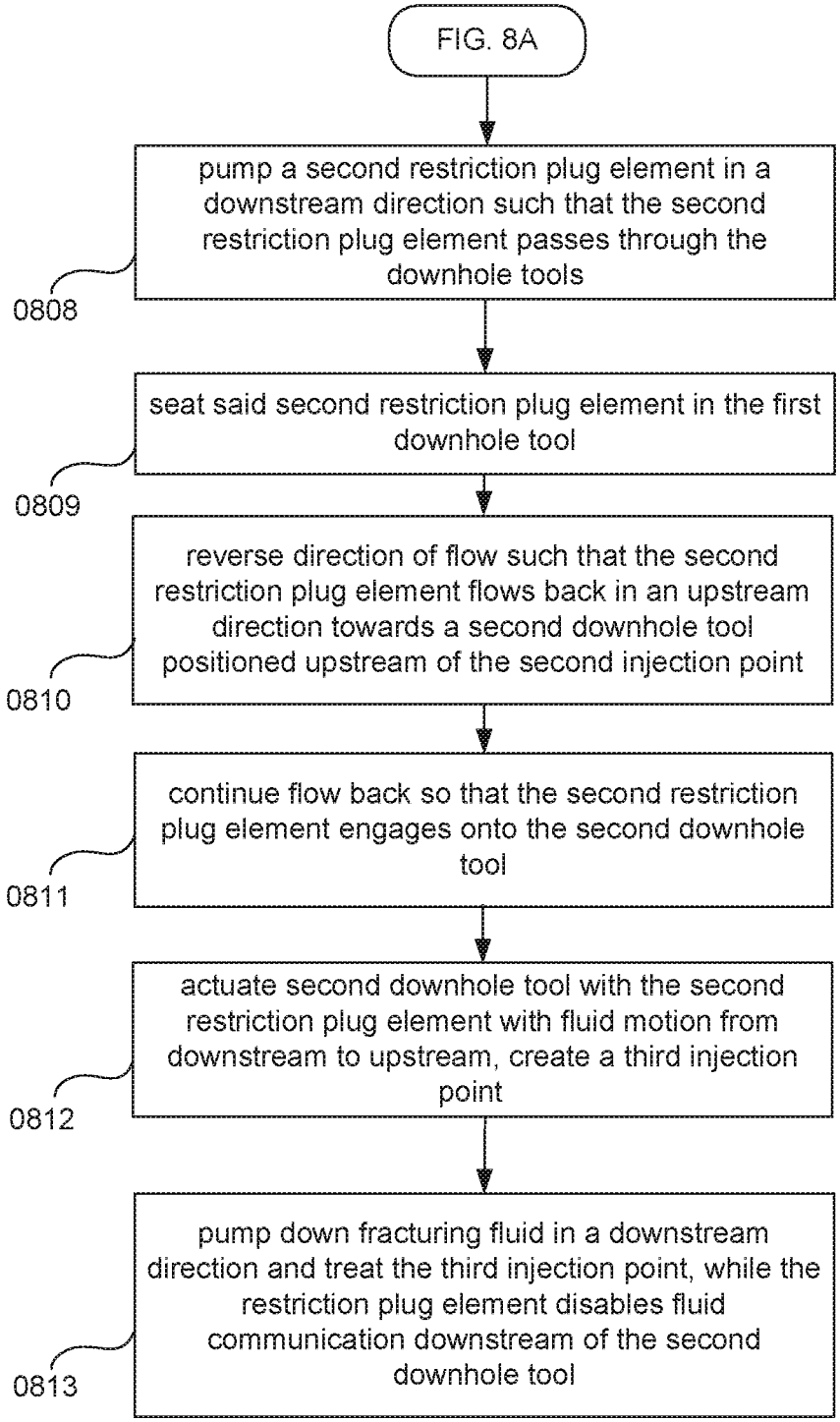

As generally seen in the flow chart of FIG. 8A and FIG. 8B (0800), a preferred exemplary reverse flow downhole tool actuation method may be generally described in terms of the following steps:

(1) installing the wellbore casing along with downhole tools at predefined positions (0801);

The downhole tools may be sliding sleeve valves, restriction plugs, and deployable seats. The downhole tools may be installed in a wellbore casing or any tubing string.

(2) creating and treating a first injection point to a hydrocarbon formation (0802);

The first injection point may be in a toe valve as illustrated in FIG. 3A. The first injection point may be in any of the downhole tools such as the downhole tools (0311, 0312, 0313, 0314). The first injection point may be created by opening communication through a port in the toe valve. The first injection point may then be treated with treatment fluid so that energy is stored in the connected region.

(3) pumping a first restriction plug element in a downstream direction such that the first restriction plug element passes the unactuated downhole tools (0803);

The first restriction plug element may be a fracturing ball (0302) as illustrated in FIG. 3B. The fracturing ball (0302) may pass through the unactuated downhole tools (0311, 0312, 0313, 0314).

(4) reversing direction of flow such that the first restriction plug element flows back in an upstream direction towards a first downhole tool; the first downhole tool positioned upstream of the first injection point (0804);

The pumping rate at the wellhead may be slowed down or stopped so that a reverse flow of the fluid initiates from a connected region, for example connected region (0303) illustrated in FIG. 3C. The reverse flow may be from toe end to heel end in an upstream direction (0309).

(5) continuing flow back so that the first restriction plug element engages onto the first downhole tool (0808);

As illustrated in FIG. 3D the reverse flow may continue such that the plug element (0302) may engage onto a downstream end (0304) of the first downhole tool (0311).

(6) actuating the first downhole tool with the first restriction plug element with fluid motion from downstream to upstream and creating a second injection point (0806);

As illustrated in FIG. 3E, the plug element (0302) may actuate a sleeve in the sliding valve (0311) as the reverse flow continues with fluid motion from toe end to heel end. The first downhole tool may reconfigure during the actuation process such that a seating surface is created on the upstream end (0306) of the downhole tool (0311). The second injection point may be created by opening communication through a port in the first downhole tool.

The first downhole tool (0311) may further comprise a pressure actuating device such as a rupture disk. The pressure actuating device may be armed by exposure to wellbore. During the reverse flow a pressure port in the downhole tool (0311) may be opened so that the rupture disk is armed. The sleeve may then be actuated by pumping down fluid. The reverse flow may be adequate for the pressure actuating device to be armed and a higher pump down pressure may actuate the sleeve. The sliding sleeve may also comprise a hydraulic time delay element that delays the opening of the valve.

(7) pumping down treatment fluid in the downstream direction and treating the second injection point, while the first restriction plug element disables fluid communication downstream of the first downhole tool (0807);

After the sleeve is actuated in step (6), pumping rate of the fluid may be increased in a downstream direction (0308) so that the second injection point (0316) may be treated as illustrated in FIG. 3F. Fluid communication may be established to the hydrocarbon formation.

(8) pumping a second restriction plug element in a downstream direction such that the second restriction plug element passes through the downhole tools (0808);

As illustrated in FIG. 3G, a second plug (0317) may be deployed into the casing. The second plug (0317) may pass through each of the unactuated downhole tools (0312, 0313, 0314) in a downstream direction.

(9) seating the second restriction plug element in the first downhole tool (0809);

The second plug (0317) may seat in the seating surface that is created on the upstream end (0306) of the downhole tool (0311) as illustrated in FIG. 3H.

(10) reversing direction of flow such that the second restriction plug element flows back in an upstream direction towards a second downhole tool positioned upstream of the second injection point (0810);

Flow may be reversed similar to step (4) so that fluid flows from the connected region (0316) into the wellbore casing (0310). The motion of the reverse flow may enable the second plug (0317) to travel in an upstream direction (0309).

(11) continuing flow back so that the second restriction plug element engages onto the second downhole tool (0811);

Continuing the reverse flow may further enable the second plug (0317) to engage onto a downstream end of the second downhole tool (0312).

(12) actuating the second downhole tool with the second restriction plug element with fluid motion from downstream to upstream and creating a third injection point (0812); and The second downhole tool (0312) may be actuated by the second plug (0317) in a direction from downstream to upstream.

(13) pumping down treatment fluid in a downstream direction and treating the third injection point, while the restriction plug element disables fluid communication downstream of the second downhole tool (0813).

Fluid may be pumped in the downstream direction to treat the third injection point while the second plug (0317) disables fluid communication downstream of the third injection point.

The second downhole tool (0312) may further comprise a pressure actuating device such as a rupture disk. The pressure actuating device may be armed by exposure to wellbore. During the reverse flow a pressure port in the downhole tool (0312) may be opened so that the rupture disk is armed. The sleeve may then be actuated by pumping down fluid. The reverse flow may be adequate for the pressure actuating device to be armed and a higher pump down pressure may actuate the sleeve. The second sliding sleeve may also comprise a hydraulic time delay element that delays the opening of the valve.

The steps (8)-(13) may be continued until all the stages of the well casing are completed.

Preferred Exemplary Reverse Flow Catch-and-Engage Tool (0900)

Figure 9A:
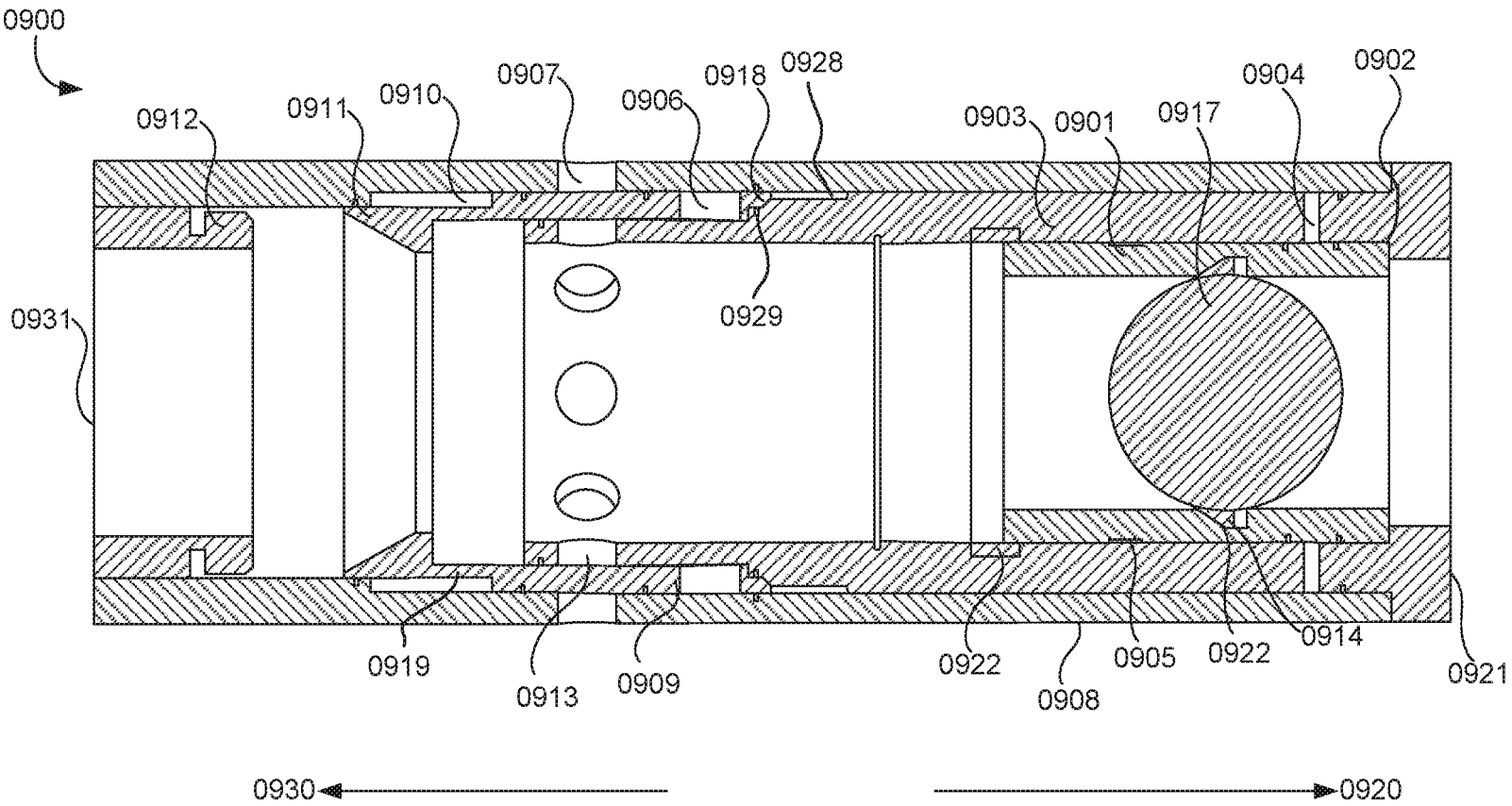
FIG. 9A illustrates an exemplary cross section view of a reverse flow catch-and-engage tool with an actuating apparatus and pilot hole according to a preferred embodiment of the present invention.
Figure 9B:
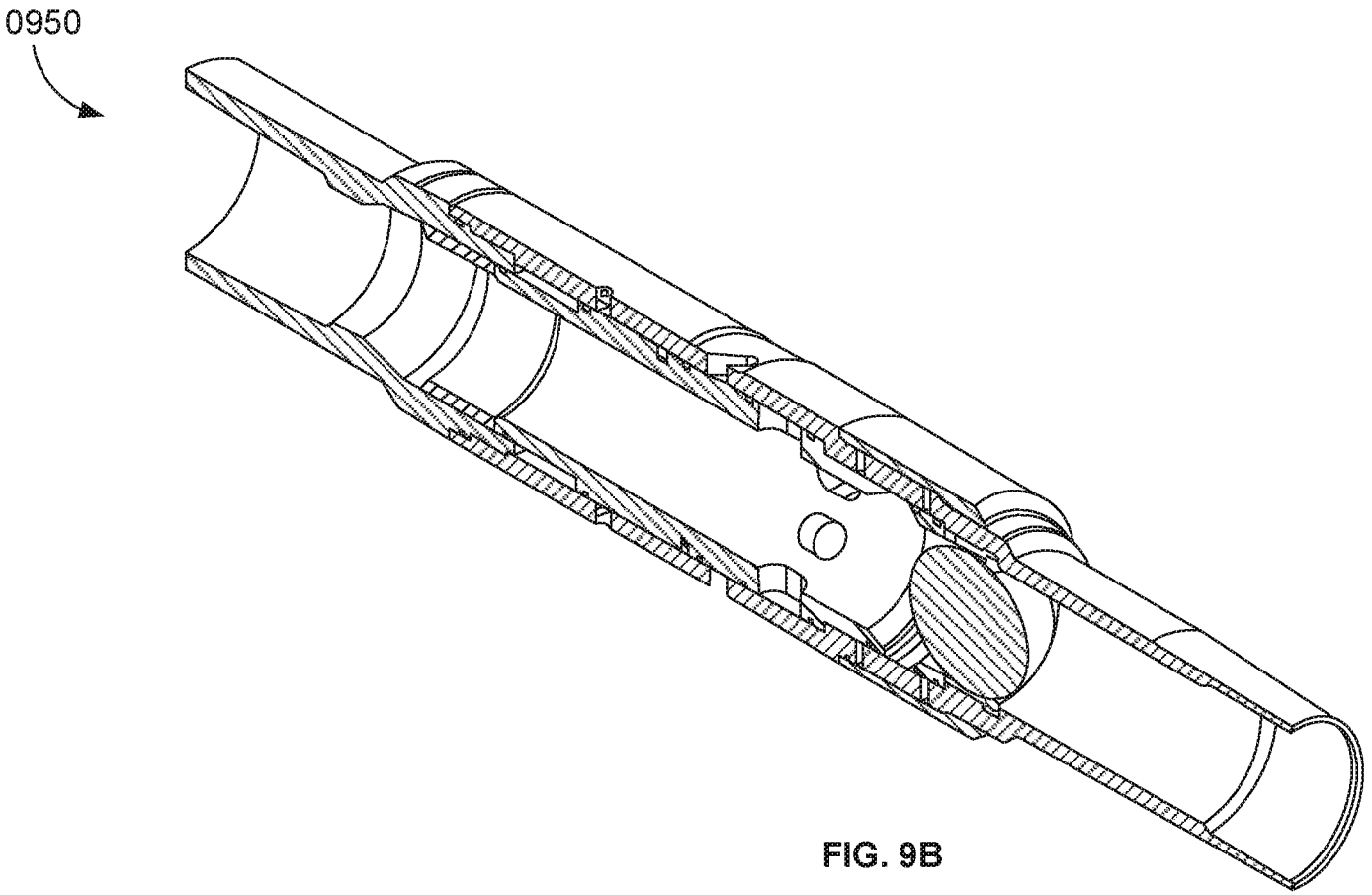
FIG. 9B illustrates an exemplary perspective view of a cross section of a reverse flow catch-and-engage tool with an actuating apparatus and a pilot hole according to a preferred embodiment of the present invention.

FIG. 9A (0900) generally illustrates an exemplary cross section view of a reverse flow catch-and-engage tool with a pilot hole and an actuating apparatus according to a preferred embodiment. An exemplary perspective view is generally illustrated in FIG. 9B (0950). The catch-and-engage tool may be a sliding sleeve valve or any downhole tool that may be conveyed with a well casing installed in a wellbore. For example, the downhole tool may be a toe valve, or a sliding sleeve valve. The reverse flow sliding sleeve (0900) may be conveyed along with a well casing in horizontal, vertical, or deviated wells. The two ends (0921, 0931) of the tool (0900) may be screwed/threaded or attached in series to the well casing. In another embodiment, the tool (0900) may be conveyed at a tubing and installed at a predefined location in the well casing. The tool may comprise an outer housing (0908) having one or more flow ports (0907) there through.

According to a preferred exemplary embodiment, the shape of the ports may be selected from a group comprising a circle, an oval or a square. The outer housing (0908) may be disposed longitudinally along outside of the well casing. The housing may be attached to the outside of the well casing via mechanical means such as screws, shear pins, or threads. The tool (0900) may comprise a functioning apparatus, a blocking apparatus and a seating apparatus disposed within the outer housing. The functioning apparatus may further comprise a movable member (0901) such as an actuating sleeve or an actuating member and a holding device (0914) such as a collet. The actuating sleeve may herein be referred to as actuating member. The functioning apparatus may be a catch-and-engage apparatus as further described below with respect to FIG. 12. The blocking apparatus may further comprise a blocking member (0909) configured to block one or more flow ports (0907) in a first position. When the blocking member if driven in an upstream direction to a second position, the blocking member may unblock the flow ports (0907). In the second position, when the flow ports are unblocked, fluid communication may be established to the wellbore. The seating apparatus may form a seat in the tool at an upstream end (0931) of the tool. The seating apparatus may also form a seat in the tool at a downstream end (0921) of the tool. The inner diameter of the housing is designed to allow for components such as, a blocking member (0903), seating apparatus, and movable member (0901), to be positioned in a space within the housing (0908). According to a preferred exemplary embodiment, the inner diameter of the well casing may range from 4⅜ in to 6 in. According to another preferred exemplary embodiment the ratio of the inner diameter of the well casing to the inner diameter of the actuating sleeve may range from 0.25 to 1.5.

The blocking member such as a port sleeve (0903) may be disposed such that the sleeve is movable and/or transportable longitudinally within the outer housing. The port sleeve (0903) may further comprise openings (0913). The openings may be positioned circumferentially along the port sleeve (0903). The openings (0913) may be equally spaced or unequally spaced depending on the spacing of the flow ports (0907) in the outer housing (0908). For example, the spacing between the openings (0913) may be 0.2 inches thereby enabling the ports to align with a spacing (0916) of 0.2 inches in the flow ports (0907).

The actuating sleeve (0901) may be positioned at a downstream end (0921) of the apparatus and is configured to slide in a space within the outer housing (0908). A holding device (0914) may be mechanically coupled and proximally positioned to the actuating sleeve (0901). According to an exemplary embodiment, the holding device (0914) may be a spring loaded collet. The collet may be a sleeve with a (normally) cylindrical inner surface and a conical outer surface. The collet can be squeezed against a matching taper such that its inner surface contracts to a slightly smaller diameter so that a restriction element (0917) may not pass through in an upstream direction (0930). Most often this may be achieved with a spring collet, made of spring steel, with one or more kerf cuts along its length to allow it to expand and contract. The spring loaded collet (0914) may expand outwards, thereby increasing an inner diameter, when the restriction element (0917) passes through the collet (0914) in a downstream direction (0920). Subsequently, the spring loaded collet (0914) may contract after the restriction element passes through in a downstream direction. Furthermore, the spring loaded collet (0914) may comprise a shallow angle (0922) that prevents the restriction element (0917) to pass through in an upstream direction (0930) when the restriction element (0917) engages on the holding device (0914) due to the reverse flow. According to another preferred exemplary embodiment, the restriction element (0917) may be deployed by a wireline such as a slick line, E Line, braided slick line and the like. The wireline may be used to pull the restriction element (0917) when pressure is not enough to move back the restriction element with the reverse flow. According to yet another preferred exemplary embodiment, a combination of pulling the wire line and reverse flow may be used to move back the restriction element (0917) such that the restriction element engages onto the functioning apparatus and moves the movable member (0901) in a upstream direction. The tool equipped with a catch-and-engage functioning apparatus comprising the holding device and movable member ("actuating sleeve") may be herein referred to as catch-and-engage tool.

According to an exemplary embodiment, when a restriction element (0917) passes through the downhole tool in a downstream direction (0920) and flows back in an upstream direction (0930) due to reverse flow, the restriction element (0917) engages on the holding device (0914) and actuates the actuating sleeve (0901) such that a communication port (0904) is exposed to uphole pressure. In a preferred embodiment, the communication port is a pilot hole. The pilot hole (0904) may be an opening in the port sleeve (0903) that is exposed when the actuating sleeve (0901) stops on a downhole stop (0902). The downhole stop (0902) is designed to restrict substantial longitudinal movement of the actuating sleeve (0901) in a downstream direction (0920). The downhole stop (0902) may be a projected arm from the outer housing (0908) that has the mechanical strength to withstand the longitudinal impact of a sliding actuating sleeve (0901). In an exemplary embodiment, when the restriction element (0917) passes through the downhole tool in a downstream direction (0920), the downhole stop (0902) restraints the actuating sleeve (0901) from further sliding in the downstream direction.

According to another exemplary embodiment, a latching device (0905) positioned between the actuating sleeve (0901) and the port sleeve (0903) may be designed to latch the actuating sleeve when the actuating sleeve slides in a reverse direction and exposes the communication port (0904) to uphole pressure or upstream pressure. In another exemplary embodiment, the latching device is a snap ring that locks into a groove in the port sleeve. The combination of the latching device and the downhole stop may be utilized to prevent the actuating sleeve from sliding any further downstream.

According to an exemplary embodiment the restriction element is degradable. According to another exemplary embodiment is restriction element is non-degradable. The restriction element shape may be selected from a group comprising: sphere, cylinder or dart. The restriction element material may be selected from a group comprising: Mg, Al, G10 or Phenolic.

According to another exemplary embodiment, the connection sleeve travels longitudinally in a reverse direction from a first position to a second position such that openings (0913) in the port sleeve (0903) align to the flow ports (0907) and enable fluid communication to the wellbore. The rate of movement of the port sleeve and the ports across the openings may be controlled to gradually expose the ports to well pressure.

According to yet another exemplary embodiment, a seating apparatus comprising a movable connection sleeve (0909) may be positioned longitudinally between the outer housing (0908) and the port sleeve (0903). The connection sleeve may be configured with a seat end (0911) and a connection end (0918). The connection end (0918) may be operatively coupled to an upstream end of the port sleeve. The connection sleeve (0909) may further comprise a slot or opening (0906) that may align with the flow ports (0907) in the outer housing and openings (0913) in the port sleeve (0903) enable fluid communication to wellbore. A thin section (0919) in the connection sleeve (0909) may be designed to deform inwards towards the inside of the casing and form a seating surface when the connection sleeve is forced to slide into a seating restriction (0912). According to another exemplary embodiment, when the port sleeve travels longitudinally in the reverse direction, the port sleeve drives the connection sleeve in an upstream direction such that the seat end pushes into a seating restriction and deforms the seating restriction to form a seating surface. According to yet another exemplary embodiment, the mechanical strength of the seating restriction may be lower than the mechanical strength of the seat end of the connection sleeve. For example, the ratio of mechanical strength of the seating restriction to the mechanical strength of the seat end may range from 0.1 to 0.5.

According to a further exemplary embodiment the pressure acting through an annulus (0929) moves the connection sleeve in an upstream direction into an air chamber (0910) between the connection sleeve and the outer housing. The ratio of the area of either ends of the connection sleeve are chosen such that a larger pressure is acted on the end towards the air chamber. The connection sleeve deforms and buckles inwards to create a seat when a larger pressure acts on the connection sleeve. For example, a ratio of the areas of the connection end and the seat end may be chosen to be 4. The selected ratio creates a pressure on the thin section of the seat end that is 4 times the pressure acted on the connection end.

According to yet another exemplary embodiment, the apparatus may further comprise a ramped restriction, whereby when the port sleeve travels longitudinally in the reverse direction, the port sleeve drives the connection sleeve in an upstream direction such that a flat part of the seat end swages into a ramp in the ramped restriction and the seat end bulges inwards to form a seating surface. A ramped restriction may be positioned at an upstream end of the apparatus so that the connection sleeve may drive against the ramp in the ramped restriction and form a seating surface.

According to a more preferred exemplary embodiment, the connection sleeve is integrated to the port sleeve to form a unified apparatus. The unified apparatus along with the functioning apparatus may be used to design a two piece catch-and-engage tool. Alternatively, the catch-and-engage tool may be assembled with a three piece design comprising a functioning apparatus, a blocking apparatus and a seating apparatus. The three piece design is illustrated with respect to FIG. 9A (0900).

Preferred Exemplary Reverse Flow Catch-and-Engage Tool with a Time Delay Element and a Rupture Disk (1000)

Figure 10A:
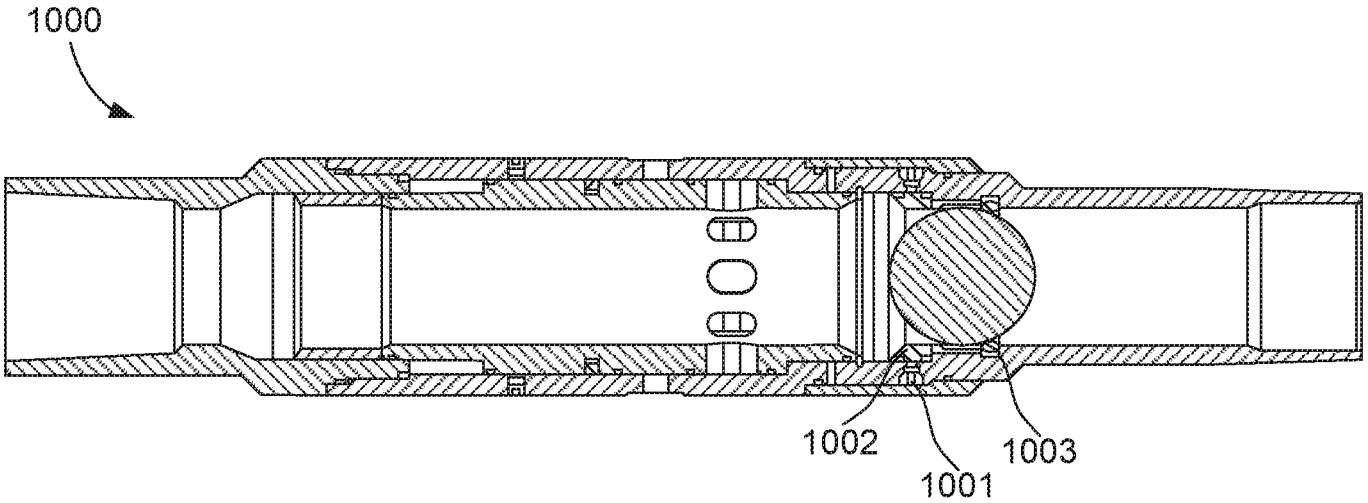
FIG. 10A illustrates an exemplary cross section view of a reverse flow catch-and-engage tool with an arming and actuating apparatus and a rupture disk according to a preferred embodiment of the present invention.
Figure 10B:
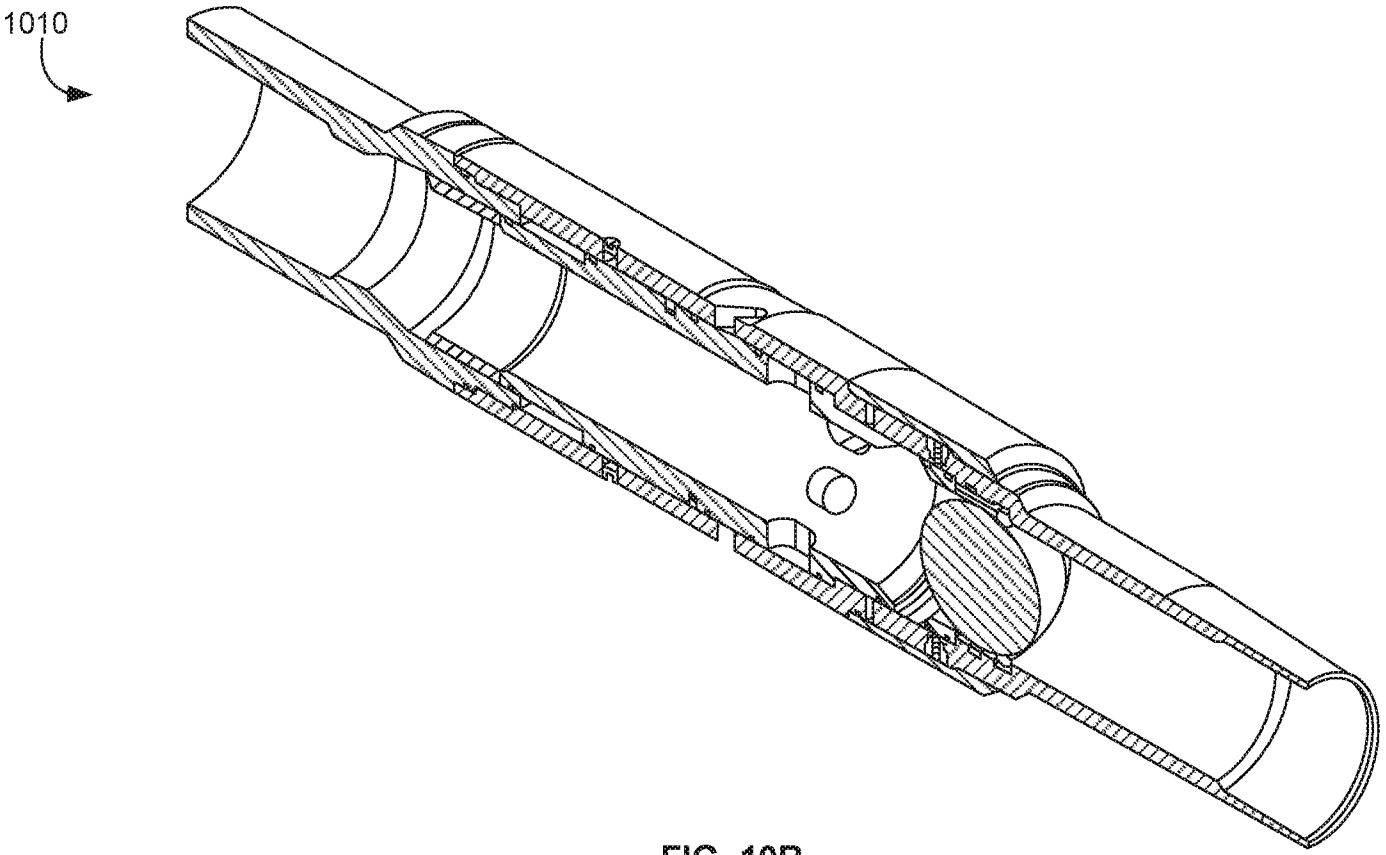
FIG. 10B illustrates an exemplary perspective view of a cross section of a reverse flow catch-and-engage tool with an arming and actuating apparatus and a rupture disk according to a preferred embodiment of the present invention.

Similar to FIG. 9A, FIG. 10.A (1000) generally illustrates an exemplary cross section view of a reverse flow catch-and-engage tool (1000) with a rupture disk according to a preferred embodiment. FIG. 1013 illustrates a perspective view of the apparatus in FIG. 10A. The reverse flow apparatus comprises a pressure actuating device (1001) that is configured to rupture at a pre-determined pressure. The pressure actuating device (1001) may be armed when an arming sleeve arms or functions and exposes the device wellbore pressure. Similar to the actuating sleeve (0901) of FIG. 9A (0900), the arming sleeve (1002) may travel in a reverse direction when a restriction element engages onto a holding device (1003) and drives the arming sleeve in a reverse direction. According to a preferred exemplary embodiment, the pressure actuating device is a forward acting rupture disk. According to another preferred exemplary embodiment, the pressure actuating device is a reverse acting rupture disk. According to another preferred exemplary embodiment said pre-determined pressure ranges from 500 psi to 10000 psi. When the pressure actuating device is exposed to the well pressure, the pressure actuating device is actuated and enables the port sleeve to travel longitudinally in a reverse direction.

A time delay element may be added to the pressure actuating device in series or parallel or a combination thereof. According to a preferred exemplary embodiment, the time delay element is in fluid communication with the pressure actuating device. In one preferred exemplary embodiment, when the pressure actuating device is exposed to the well pressure, the pressure actuating device is actuated and enables the port sleeve to travel longitudinally in the reverse direction after a pre-determined time delay. The pre-determined time delay may range from 1 second to 1000 minutes. The time delay element may be a hydraulic restriction element as illustrated in FIG. 10 a capillary tube as illustrated in FIG. 10D. According to a preferred exemplary embodiment, the time delay element is a hydraulic restriction element. According to another preferred exemplary embodiment the time delay element is a capillary tube. The pre-determined time may enable a pressure indication of the restriction element seating in a tool positioned downstream of the sliding sleeve apparatus. The ratio of inner diameter of the arming sleeve to inner diameter of the port sleeve ranges between 0.25 to 1.5. According to a preferred exemplary embodiment the arming sleeve, the port sleeve and the connection sleeve are made from a material selected from a group comprising: Mg, Al, steel or composite.

Preferred Exemplary Reverse Flow Catch-and-Engage Flowchart Embodiment (1100)

Figure 11:
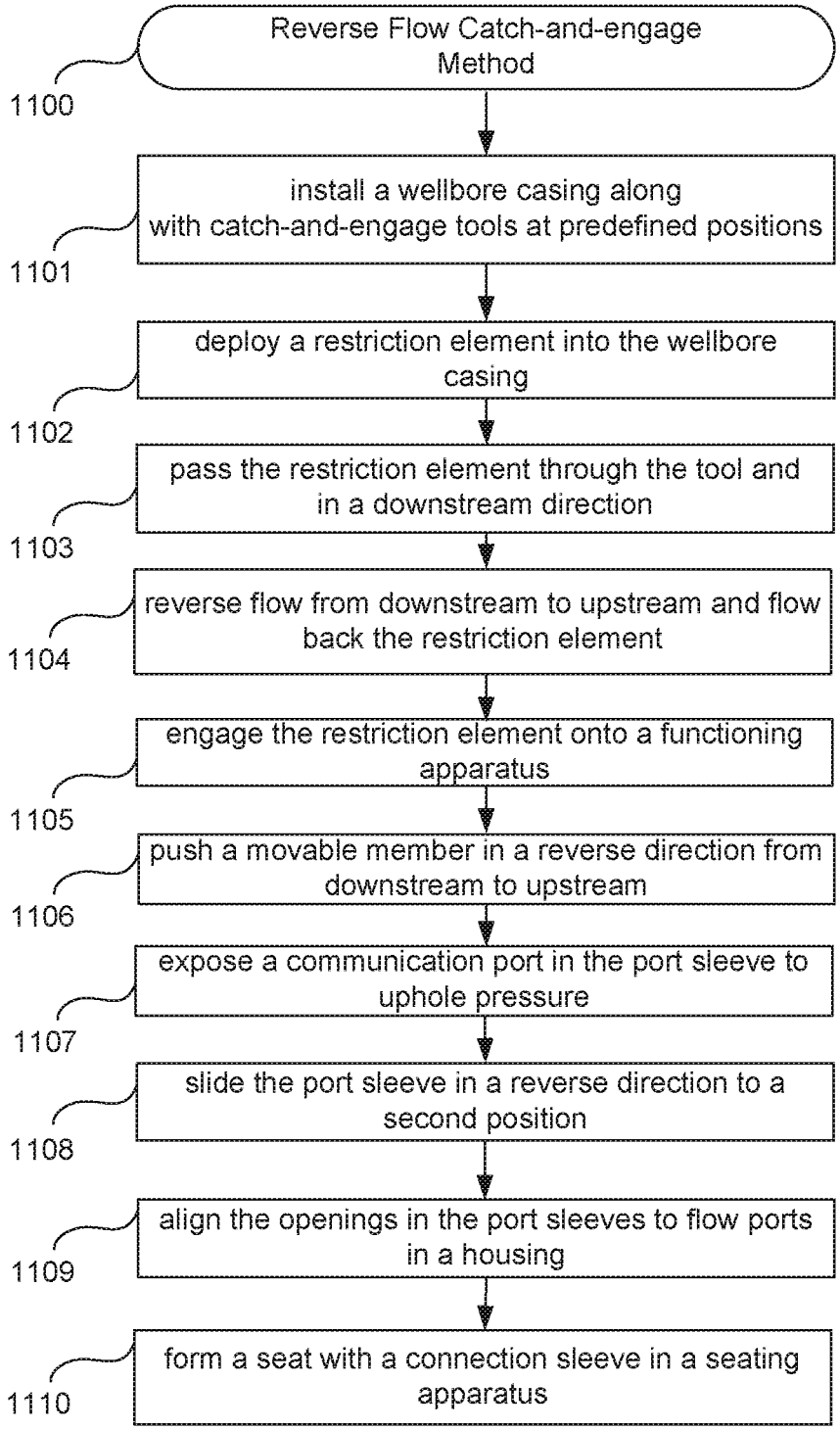
FIG. 11 is a detailed flowchart of a preferred exemplary reverse flow method with a reverse flow catch-and-engage tool in FIG. 9A or FIG. 10A used in some exemplary invention embodiments.

As generally seen in the flow chart of FIG. 11 (1100), a preferred exemplary reverse flow catch-and-engage method in conjunction with a catch-and-engage tool described in FIG. 9A (0900) may be generally described in terms of the following steps:

(1) installing the wellbore casing along with the catch-and-engage tool at predefined positions (1101);

The catch-and-engage tool may be the apparatus as described in FIG. 9 (0900). It should be noted that downhole tools such as sliding sleeve valves, restriction plugs, and deployable seats may be used in place of the catch-and-engage tool. The catch-and-engage tool may be installed in a wellbore casing or any tubing string. The catch-and-engage tool may also be conveyed by tubing means and installed at a predefined position within the well casing.

(2) deploying a restriction element into the wellbore casing (1102);

The restriction element ay be pumped or dropped into the well casing. Alternatively, the restriction element may be deployed with a wireline such as a slick line, E line or a braided line.

(3) passing the restriction element through catch-and-engage tool in a downstream direction (1103);

(4) reversing flow from downstream to upstream and flowing back the restriction element (1104);

The steps 3 (1103) and 4 (1104) may further comprise the steps of a) expanding an inner diameter of the catch-and-engage tool when the restriction element passes through the downhole tool;

The inner-diameter may be expanded when a holding device such as a collet aligns with a groove in the catch-and-engage apparatus.

b) snapping back to reduced inner diameter with a spring loaded means or misalignment of a collet in a groove; and c) preventing the restriction element from flowing back through the catch-and-engage apparatus;

A shallow angle on the holding device may prevent the restriction element from passing through in an upstream direction.

(5) engaging the restriction element onto a holding device in the functioning apparatus (1105);

(6) pushing an movable member in the functioning apparatus in a reverse direction from downstream to upstream (1106);

The movable member may be an actuating sleeve (0901) that actuates a pilot hole as illustrated in FIG. 9A (0900). Alternatively, the movable member may be an arming sleeve (1002) that arms and actuates a rupture disk (1001) as illustrated in FIG. 10A (1000)

(7) exposing a communication port in a port sleeve to well pressure (1107);

The communication port may be a pilot hole. Alternatively, a rupture disk may be armed. The wellbore pressure acts on the connection end (0918) of the connection sleeve (0909) through annulus (0928).

(8) sliding the blocking member in a reverse direction from downstream to upstream (1108);

The blocking member may be a connection sleeve (0909) that is configured to block flow ports in an outer housing in a first position.

(9) unblocking flow ports in a housing (1109); and

The flow ports may be unblocked when the blocking member moves to a second position when the pressure through the annulus (0928) acts on the connection end (0918) and disengages the seals (0929). Alternatively, the flow ports may align with openings in the blocking apparatus to enable fluid communication to the wellbore. The seating apparatus may further comprise openings that may be aligned with the flow ports and openings in the blocking apparatus. Alternatively, the blocking member may rotate such that the flow ports may align with openings in the blocking apparatus.

(10) forming a seat with the connection sleeve (1110).

The step 10 (1110) of forming a seat may further comprise the steps of:

(1) driving the connection sleeve in the seating apparatus into an air chamber with a differential area connection sleeve and creating a differential pressure; and (2) deforming a thin section of the connection sleeve to buckle inwards such that a seat with inner diameter less than a diameter of the restriction element is formed.

The step 10 (1110) of forming a seat may further comprise the steps of:

(1) driving the seat end of the connection sleeve into a seating restriction; and (2) deforming the seating restriction into a seat with a mechanical strength of the seat end of the connection sleeve that is substantially higher than a mechanical strength of the seating restriction.

The forming a seat 10 (1110) step may further comprise the steps of:

(1) driving the seat end of said connection sleeve into a ramp in a seating restriction; and (2) deforming the seating restriction into a seat with a thin section in the seat end swaging into the ramp of the seating restriction.

Preferred Exemplary Arming Actuating Apparatus with Reverse flow (1200, 1210)

Figure 12:
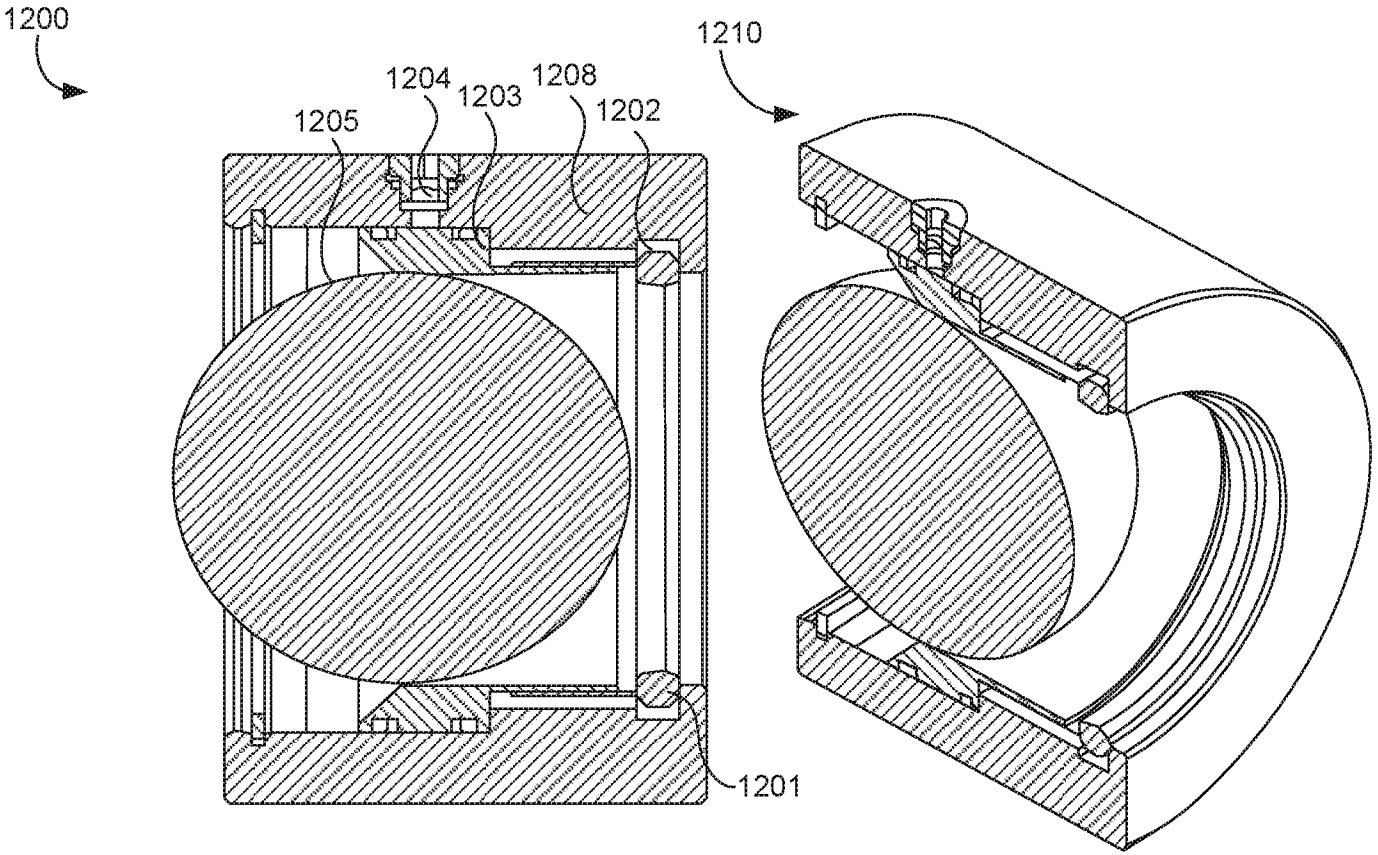
FIG. 12 illustrates an exemplary cross section view and a perspective view of a reverse flow arming apparatus according to a preferred embodiment of the present invention.

As generally illustrated in a cross section view (1200) and a perspective view (1210) of FIG. 12, an arming and actuating apparatus (1200) for arming and actuating a downhole tool may be conveyed with the downhole tool in a wellbore casing. The apparatus (1200) may also be herein referred to as catch-and-engage apparatus. The apparatus may comprise an arming member (1203) and a holding device (1201). The arming member (1203) may be circumferentially disposed in a space within an outer housing of the downhole tool, and the holding device may be mechanically coupled to the arming member. The arming member (1203) may slide in a space between the outer housing and another sleeve such as a port sleeve. According to a preferred exemplary embodiment, the arming member may be a sleeve disposed circumferentially within an outer housing (1208). When a restriction element pumped down or dropped down the wellbore casing passes through the downhole tool in a downstream direction and flows back in an upstream direction due to reverse flow, the restriction element (1205) may engage on the holding device (1201) and functions or moves the arming member and unblocks a port (1204) in the downhole tool so that a pressure actuating device is armed and exposed to uphole pressure. The pressure actuation device such as a rupture disk may be actuated upon exposure to uphole pressure. According to a preferred exemplary embodiment, the rupture disk ruptures instantaneously upon exposure to the wellbore fluids without a delay. According to yet another preferred exemplary embodiment the rupture disk ruptures upon exposure to the wellbore fluids after a pre-determined time delay. The holding device (1201) may be mechanically coupled circumferentially within the outer housing and proximally positioned to the arming member. The holding device may further be disposed in a groove (1202) that may be recessed into a housing of the downhole tool. The groove may further comprise an extension arm that may be mechanically connected to the arming member. The extension arm may further slide into a space between the groove and the arming member in the downhole tool. According to a preferred exemplary embodiment, the shape of the groove (1202) and the shape of the holding device (1201) may be selected such that the groove aligns with the holding device. For example, the groove may be rectangular shaped and the holding device may be hexagonal and one edge of the hexagonal shape aligns with one edge of the rectangular shaped holding device. When the holding device is aligned in the groove the inner diameter of the downhole tool may expand to accommodate a restriction element to pass through. Alternatively, an edge of holding device may be misaligned with the edge of the groove such that the inner diameter of the downhole tool is smaller than the diameter of the restriction device and therefore restrict the passage of the restriction device. Furthermore, the holding device may be aligned with the groove when the restriction element passes in a downstream direction and misaligned when the restriction element passes through in an upstream direction. It should be noted that the shape of the groove and the shape of the holding device shown in FIG. 12 is for illustration only and may not be construed as a limitation. Any shape compatible with the design of the tool may be selected for the groove and the holding device. For example, the shapes of the groove and the holding device can be selected from a group comprising: rectangular, square, oval, circular, or triangular notch.

Figure 16:
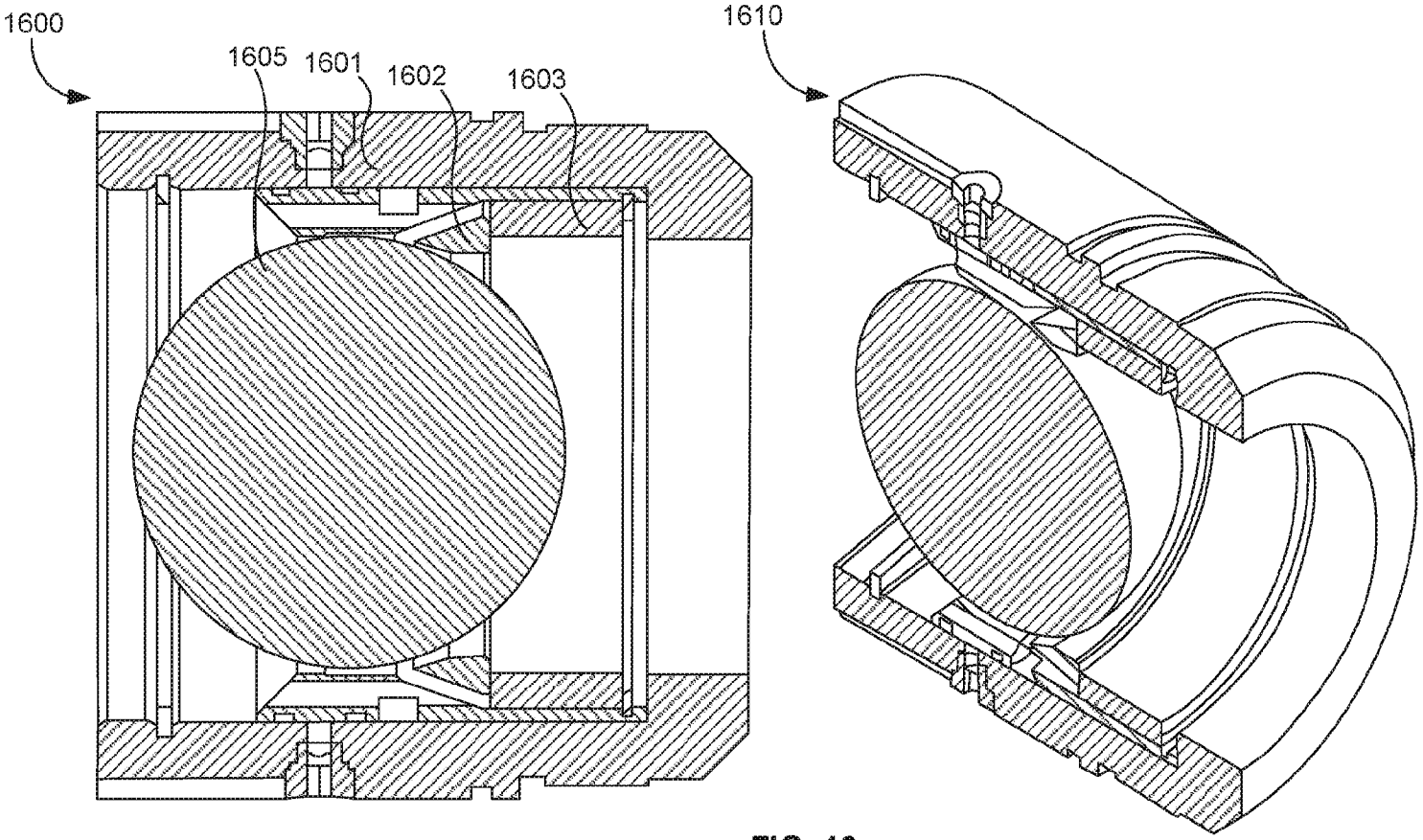
FIG. 16 illustrates an exemplary cross section view and a perspective view of a reverse flow arming apparatus with a ramped collet according to a preferred embodiment of the present invention.

According to an exemplary embodiment, the holding device (1201) may be a swing loaded collet, a sliding collet or a ramp collet. The collet may be a sleeve with a (normally) cylindrical inner surface and a conical outer surface. The collet can be squeezed against a matching taper such that its inner surface contracts to a slightly smaller diameter so that a restriction element (1205) may not pass through in an upstream direction. Most often this may be achieved with a spring collet, made of spring steel, with one or more kerf cuts along its length to allow it to expand and contract. The spring loaded collet (1202) may expand outwards, thereby increasing an inner diameter, when the restriction element (1205) passes through the collet (1202) in a downstream direction. Subsequently, the spring loaded collet (1202) may contract after the restriction element passes through in a downstream direction. Furthermore, a ramp collet may comprise a shallow angle that prevents the restriction element (1205) to pass through in an upstream direction when the restriction element (1205) engages on the holding device (1202) due to the reverse flow. The holding device may be a ramp collet as generally illustrated in cross section view of the apparatus in FIG. 16 (1600) and perspective view in FIG. 16 (1610) The ramp collet (1602) may be disposed within the housing (1601) of the downhole tool. The ramp collet (1602) may be beveled or angled so that a restriction element (1605) may pass through in one direction and restricted pass through of the downhole tool in the opposite direction. The ramp collet (1602) may be mechanically coupled to an extension arm (1603). According to a preferred exemplary embodiment the holding device prevents the restriction element from traveling upstream after the arming member is functioned. According to another preferred exemplary embodiment, the holding device allows the restriction element to continue to travel upstream after the said arming member is functioned. It should be noted that the term functioned and armed as referenced herein may be used interchangeably to indicate arming of a rupture disk.

According to an exemplary embodiment, when a restriction element (1205) passes through the holding device (1202) in a downstream direction and flows back in an upstream direction due to reverse flow, the restriction element (1205) engages on the holding device (1202) and arms the actuating sleeve (1203) such that a port (1204) in a rupture disk is exposed to uphole pressure. A pressure drop indication may be recorded when restriction element finishes pushing arming member.

According to an exemplary embodiment, the restriction element may be deployed by a wireline attached to the restriction element. The wireline configured to pull back the restriction element in an upstream direction. A combination of reverse flow and pulling a wireline may be utilized to pull back the restriction element in an upstream direction. The arming apparatus may be conveyed with a tubing to a predefined position into a wellbore casing.

Figure 15:
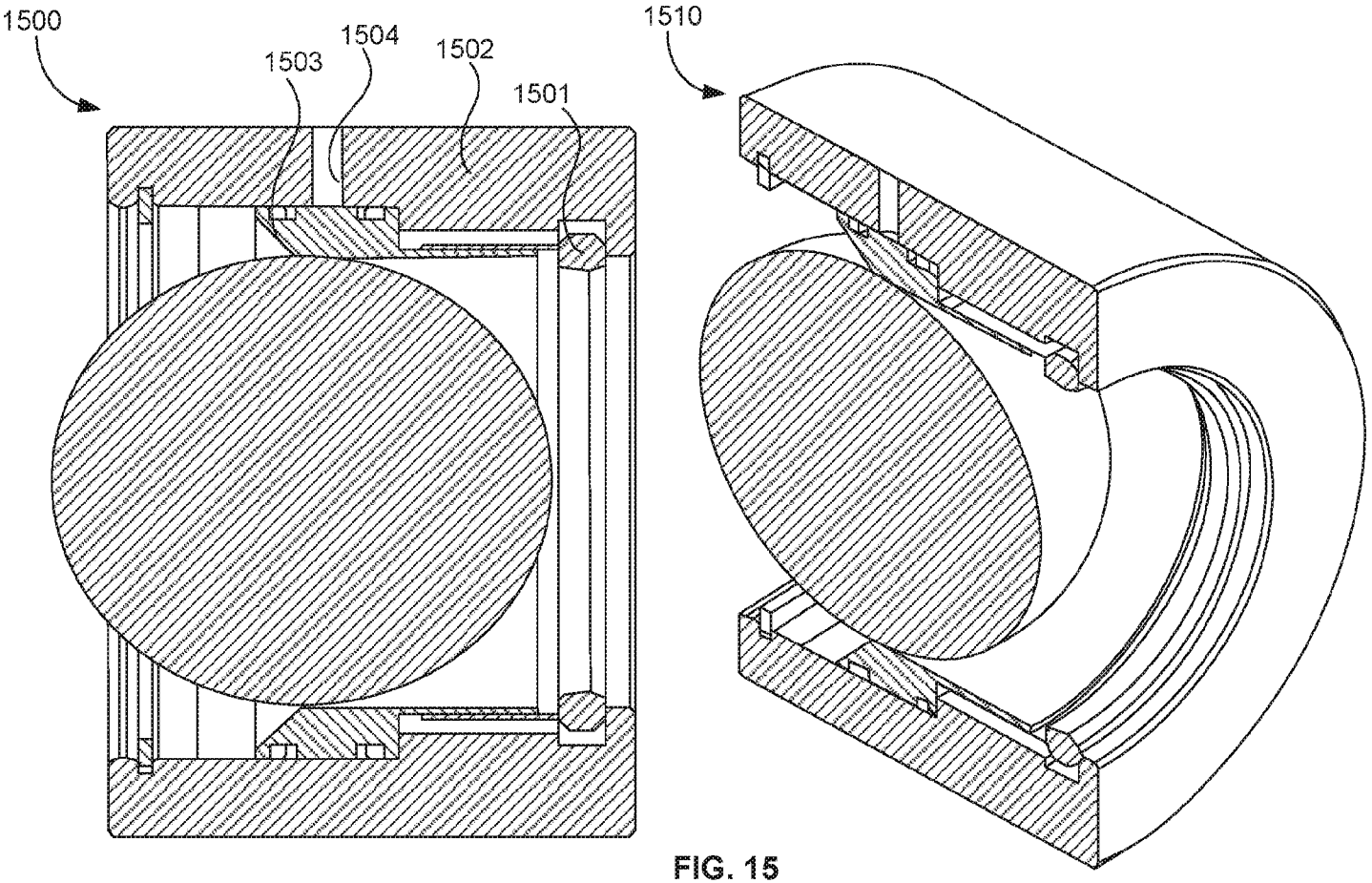
FIG. 15 illustrates an exemplary cross section view and a perspective view of a reverse flow actuating apparatus with a pilot hole according to a preferred embodiment of the present invention.

According to another exemplary embodiment, a port in the outer housing may be a pilot hole (1504) as illustrated in cross section view FIG. 15 (1500) and perspective view (1510). The pilot hole may be disposed in an outer housing (1502) of the downhole tool. Similar to the arming and actuating apparatus of FIG. 12 (1200), FIG. 15 illustrates an exemplary actuating apparatus comprising an actuating member (1503) and a holding device (1501) disposed in a groove of the outer housing. The actuating sleeve may unblock and actuate the pilot hole such that uphole pressure acts on a port sleeve and drives the port sleeve in an upstream direction. All other exemplary embodiments of the arming and actuating apparatus (1200) are exemplary embodiments of the actuating apparatus (1500).

Figure 13:
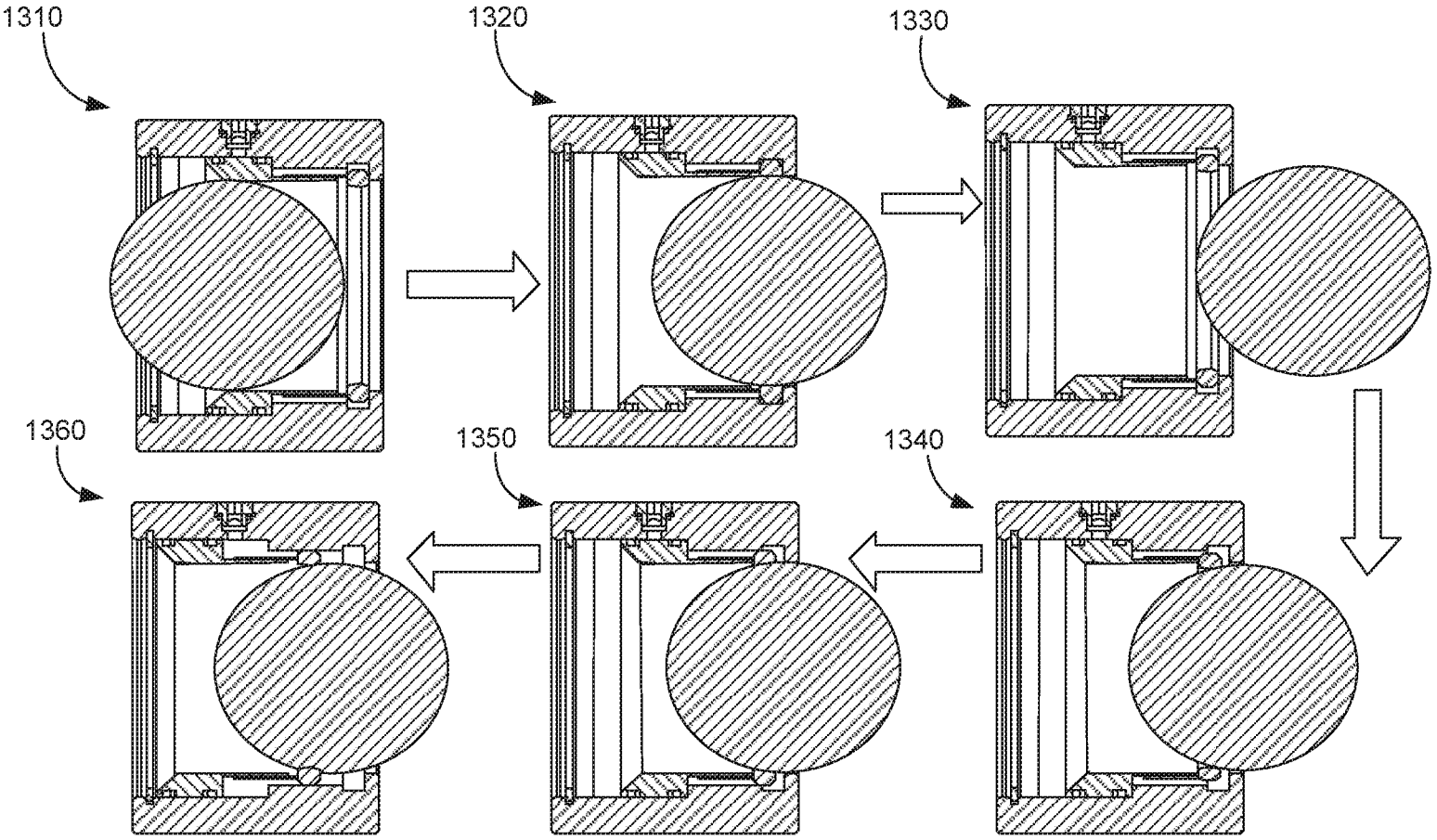
FIG. 13 illustrates steps of arming and actuating a downhole tool with an exemplary reverse flow arming apparatus of FIG. 12 according to a preferred embodiment of the present invention.

FIG. 13 (1310, 1320, 1330, 1340, 1350, 1360) illustrates the sequential positions of the arming apparatus of FIG. 12 during a typical reverse flow operation when a restriction element passes through the apparatus in a downstream direction and moves back in a upstream direction.

Preferred Exemplary Reverse Flow Actuation and Arming of a Downhole Tool Flowchart Embodiment (1400)

Figure 14:
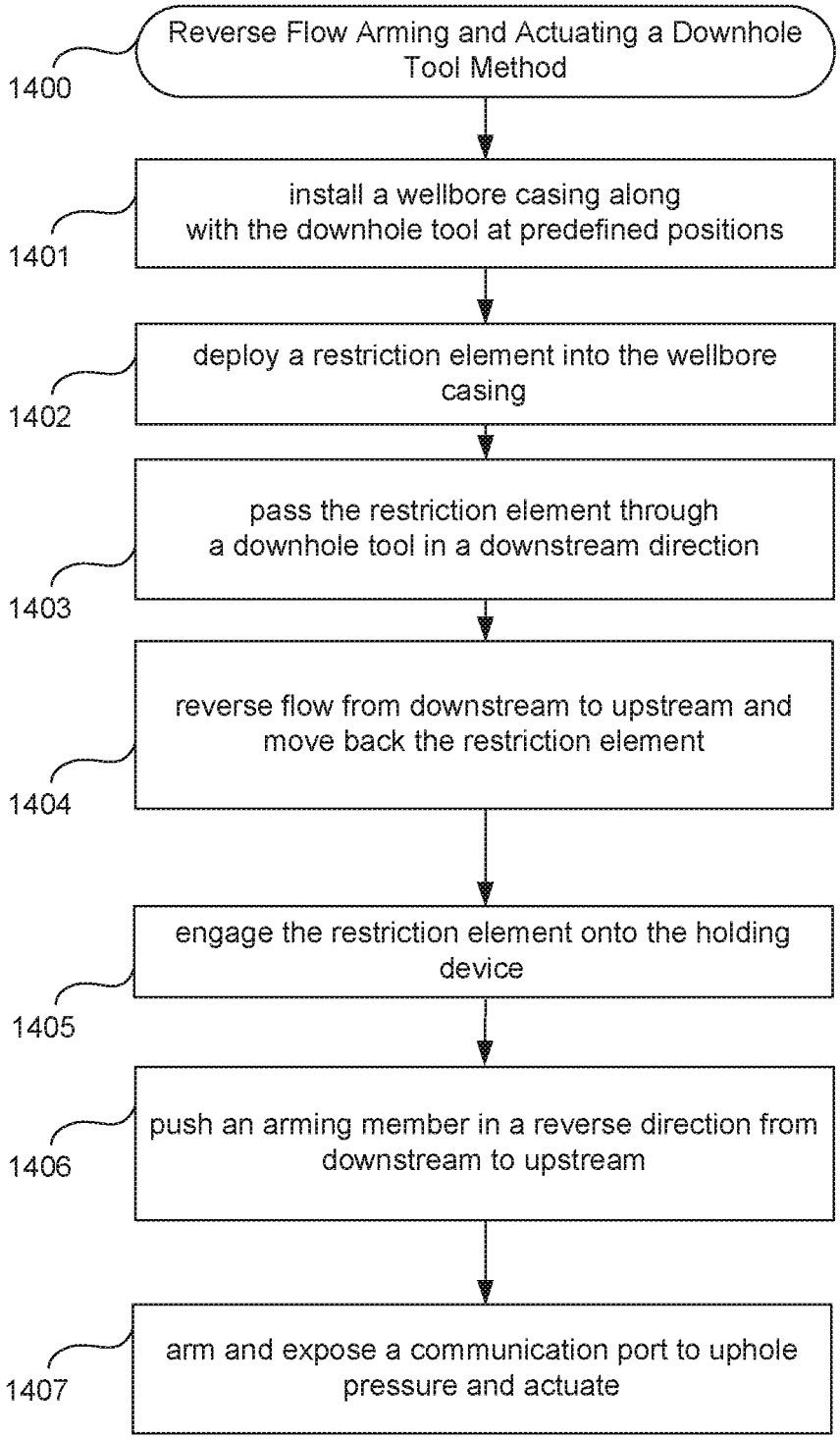
FIG. 14 is a detailed flowchart of arming and actuating a downhole tool method with a reverse flow arming apparatus in FIG. 12 used in some exemplary invention embodiments.

As generally seen in the flow chart of FIG. 14 (1400), a preferred exemplary reverse flow downhole tool actuation and arming method may be generally described in terms of the following steps:

(1) installing the wellbore casing along with the downhole at predefined positions (1401);

The downhole tool may be the catch-and-engage tool described in FIG. 9 (0900). Alternatively, the downhole tool may be the catch-and-release tool described in FIG. 17 (1700). It should be noted that downhole tools such as sliding sleeve valves, restriction plugs, and deployable seats may be used in place of the sliding sleeve apparatus. The downhole tool may be installed in a wellbore casing or any tubing string. The downhole tool may be configured with the catch-and-engage apparatus of FIG. 12. Alternatively, the downhole tool may be configured with the catch-and-release apparatus of FIG. 19.

(2) deploying a restriction element into the wellbore casing (1402);

The restriction element may be pumped or dropped into the wellbore casing such that it passes through all uphole (upstream) restrictions before reaching the downhole tool. FIG. 13 (1310) generally illustrates a restriction element reaching the downhole tool and the arming apparatus.

(3) passing the restriction element downhole tool in a downstream direction (1403);

FIG. 13 (1320) generally illustrates the restriction element passing the apparatus in a downstream direction.

(4) reversing flow from downstream to upstream and flowing back the restriction element (1404);

FIG. 13 (1330) generally illustrates the restriction element flowing back in a reverse direction towards the arming apparatus in an upstream direction.

(5) engaging the restriction element onto the holding device (1405);

FIG. 13 (1340) generally illustrates the restriction element engaging onto the holding device. The holding device may be misaligned in the groove such that the inner diameter of the passage is less than the diameter of the restriction element and thereby restricting passage of the restriction element in an upstream direction. The engaging step may further comprise the following steps for a catch-and-engage apparatus.

a) misaligning a collet in said apparatus into a groove; and b) preventing the restriction element to flow upstream.

The engaging step may further comprise the following steps for a catch-and-release apparatus.

(1) aligning a collet in the apparatus into a groove;

(2) expanding an inner diameter of the apparatus; and (3) releasing the restriction element to flow upstream.

(6) driving an arming member in a reverse direction from downstream to upstream (1406); and FIG. 13 (1350) generally illustrates the restriction element engaging onto the holding device and pushing the arming member in an upstream direction. A collet may be misaligned in the groove and restricting passage of the restriction element in an upstream direction.

(7) arming and exposing a port to uphole pressure (1407).

FIG. 13 (1360) generally illustrates a port exposed to uphole pressure. The port may be attached to a rupture disk or any pressure actuated device. The rupture disk may actuate upon reaching a rated pressure immediately or after a time delay. The port may be a pilot hole in an outer housing. The pilot hole may be exposed to uphole pressure and enable a port sleeve to travel in an upstream direction.

Preferred Exemplary Reverse Flow Catch-and-Release Tool (1700, 1800)

Figure 17:
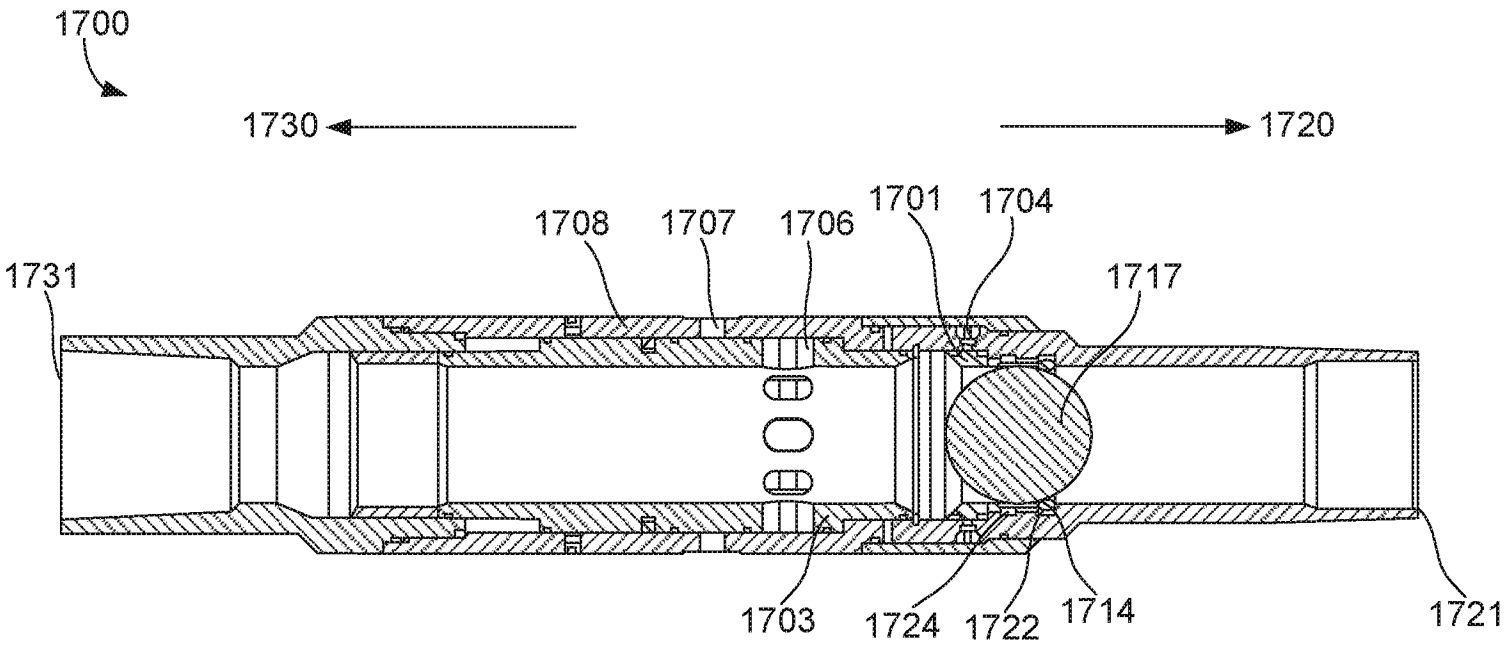
FIG. 17 illustrates an exemplary cross section view of a reverse flow catch-and-release tool according to a preferred embodiment of the present invention.
Figure 18:
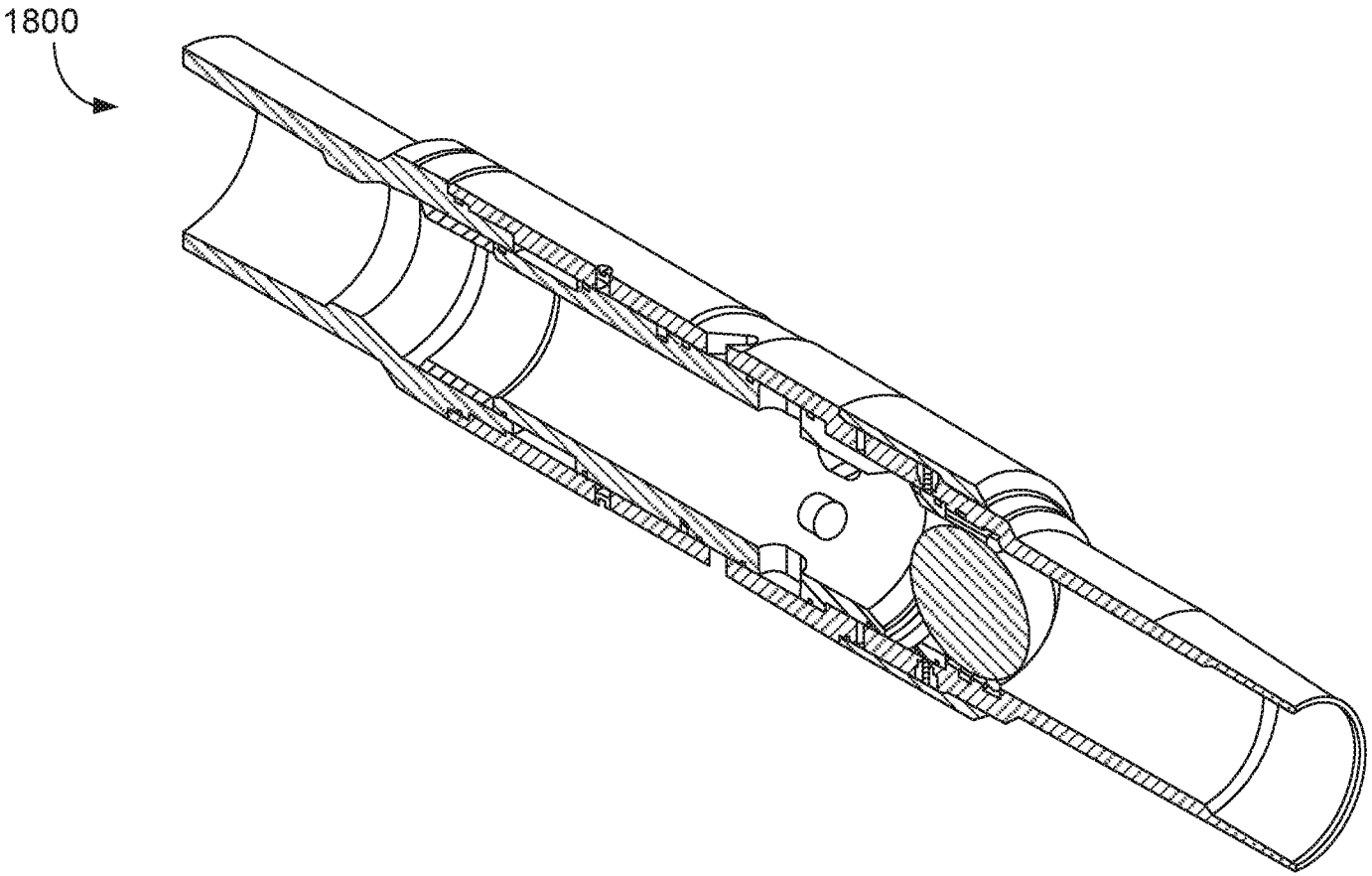
FIG. 18 illustrates an exemplary perspective view of a reverse flow catch-and-release tool according to a preferred embodiment of the present invention.

FIG. 17 (1700) generally illustrates an exemplary cross section view of a reverse flow catch-and-release tool with a pressure actuating device according to a preferred embodiment. An exemplary perspective view is generally illustrated in FIG. 18 (1800). The catch-and-release tool may be a sliding sleeve valve or any downhole tool that may be conveyed with a well casing installed in a wellbore. The catch-and-release tool (1700) may be conveyed along with a well casing (1715) in a horizontal, vertical, or deviated wells. Alternatively, the catch-and-release tool (1700) may be conveyed by a tubing to a desired position in a wellbore casing. The tool may comprise an outer housing (1708) having one or more flow ports (1707) there through. The catch-and-release tool enables a restriction element (1717) to pass through in a downstream direction (1720) and release the restriction element to flow back in an upstream direction (1730) during reverse flow. The tool may be connected to a wellbore casing in series on both ends of the tool. The inner diameter of the housing (1708) is designed to allow for components such as, a blocking apparatus (1703), and a functioning apparatus to be positioned within a space in the housing (1708). The blocking apparatus (1703) may be a port sleeve disposed within the outer housing. The functioning apparatus may further comprise a holding device (1714) and movable member (1701) such as an actuating sleeve or an arming sleeve.

The movable member (1701) in the functioning apparatus may be positioned at a downstream end (1721) of the tool and is configured to slide in a space between the outer housing and the port sleeve (1703). A holding device (1714) may be mechanically coupled circumferentially within the outer housing and proximally positioned to the movable member such as arming sleeve (1701). According to an exemplary embodiment, the holding device (1714) may be a sliding collet or a collet loaded with a spring. The collet may be a sleeve with a (normally) cylindrical inner surface and a conical outer surface. The holding device (1714) may be disposed within a first groove (1722). The holding device (1714) may expand outwards, thereby increasing an inner diameter, when the restriction element (1717) passes through the apparatus in a downstream direction (1720). Subsequently, the collet (1714) may contract after the restriction element passes through in a downstream direction. A second groove (1724) may be positioned upstream of the first groove (1722) so that when a restriction element engages onto the collet due to reverse flow or other means, the collet pushes an arming sleeve (1701) and the collet travels in an upstream direction and aligns itself in the second groove (1724). When the collet is aligned in the second groove (1724), the collet may be squeezed against the second groove such that its inner surface expands to a slightly larger diameter so that a restriction element (1717) passes through in an upstream direction (1730). Most often this may be achieved with a spring collet, made of spring steel, with one or more kerf cuts along its length to allow it to expand and contract. When the arming sleeve (1701) travels in an upstream direction due to reverse flow, a port (1704) may be armed and expose a pressure actuating device to uphole pressure. Alternatively, the communication port may be a pilot hole. The pilot hole (1704) may be an opening in the port sleeve (1703) that is exposed when the movable member (1701) is an actuation sleeve that travels upstream and unblocks the communication port. The movable member may stop on a downhole stop to prevent further longitudinal movement.

The tool equipped with the catch-and-release apparatus comprising the holding device and the movable member such as an arming sleeve or an actuation sleeve may be herein referred to as catch-and-release tool. The catch-and-release apparatus is further described below with respect to FIG. 19.

The blocking apparatus comprising the port sleeve (1703) may be disposed such that the sleeve is movable and/or transportable longitudinally or rotationally within the outer housing. The port sleeve (1703) may further comprise openings (1706) positioned circumferentially around the casing (1715). The openings (1706) may be equally spaced or unequally spaced depending on the spacing of the flow ports (1707) in the outer housing (1708). According to another exemplary embodiment, the port sleeve travels longitudinally in a reverse direction from downstream (1720) to upstream (1730) such that openings (1707) in the port sleeve (1703) align with the flow ports (1707) and enable fluid communication to the wellbore. The rate of movement of the port sleeve and the ports across the openings may be controlled to gradually expose the ports to well pressure.

Preferred Exemplary Catch-and-Release Apparatus with Reverse Flow (1900, 1910)

Figure 19:
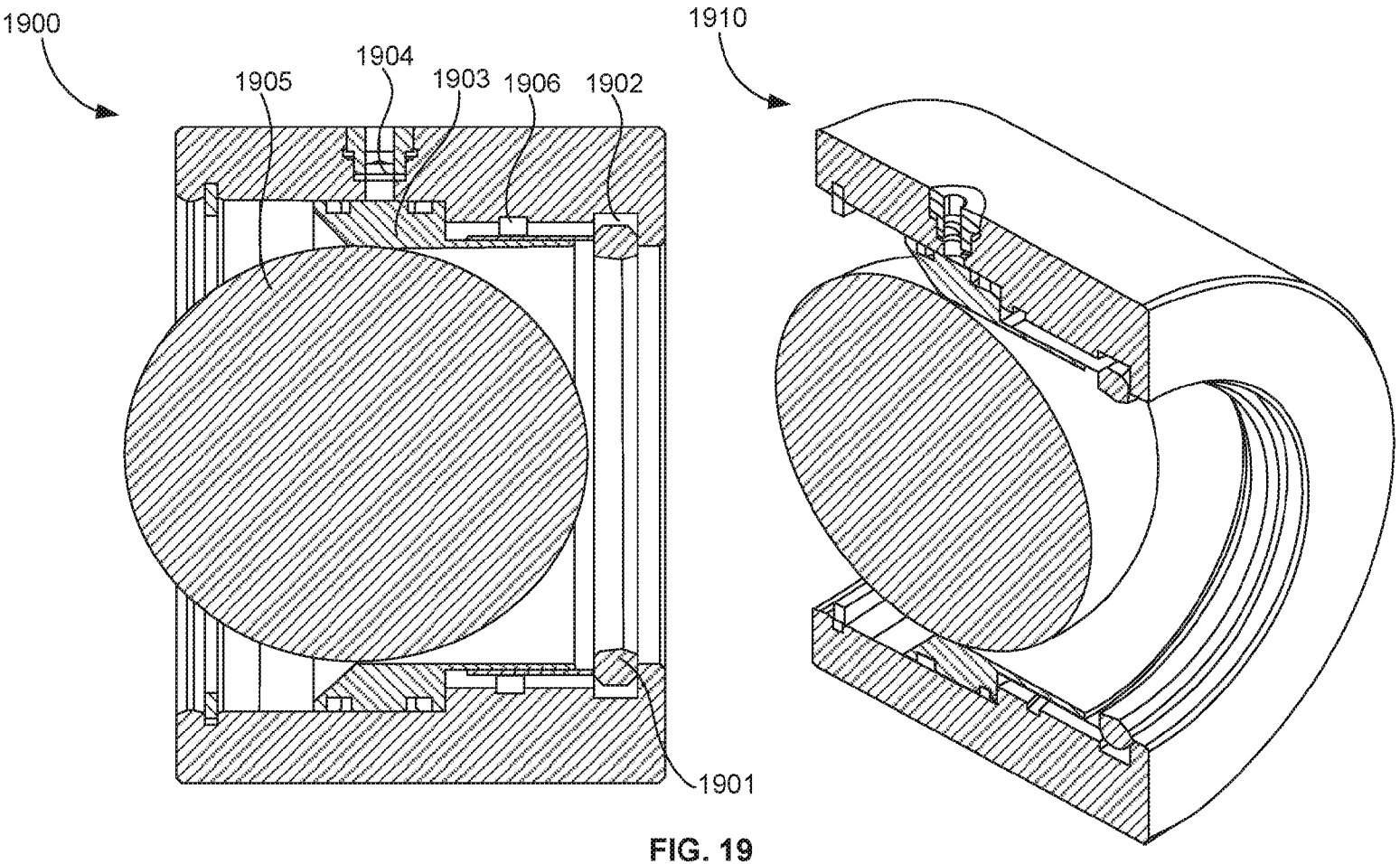
FIG. 19 illustrates an exemplary cross section view and a perspective view of a reverse flow arming apparatus in a catch-and-release tool according to a preferred embodiment of the present invention.

As generally illustrated in a cross section view (1900) and a perspective view (1910) of FIG. 19, a catch-and-release apparatus (1900) for arming and/or actuating a downhole tool may be conveyed with the downhole tool in a wellbore casing. The apparatus may comprise an arming member (1903) and a holding device (1901). The arming member (1903) may be circumferentially disposed within an outer housing of the downhole tool, and the holding device may be mechanically coupled to the arming member. According to a preferred exemplary embodiment, the arming member may be a sleeve disposed around an outer circumference of the well casing or another sleeve. When a restriction element pumped down or dropped down the wellbore casing passes through the downhole tool in a downstream direction and flows back in an upstream direction due to reverse flow, the restriction element (1905) may engage on the holding device (1901) and functions the arming member such that a port (1904) in the downhole tool is exposed to wellbore pressure. The holding device (1901) may be mechanically coupled circumferentially within an outer housing and proximally positioned to the arming member. The holding device may further be disposed in a first groove (1902) that may be recessed into a housing of the downhole tool. The first groove may further comprise an extension arm that may be mechanically connected to the arming member. The extension arm may further slide into a space between the groove and the arming member in the downhole tool.

According to an exemplary embodiment, the holding device (1901) may be a sliding collet, a ramp collet or a collet loaded with a spring. The collet may be a sleeve with a (normally) cylindrical inner surface and a conical outer surface. The holding device (1901) may be disposed within a first groove (1902). The holding device (1901) may expand outwards, thereby increasing an inner diameter, when the restriction element (1905) passes through the apparatus in a downstream direction. Subsequently, the collet (1901) may contract after the restriction element passes through in a downstream direction. A second groove (1906) may be positioned upstream of the first groove (1901) so that when a restriction element engages onto the collet due to reverse flow or other means, the collet pushes an arming sleeve (1903) and the collet travels in an upstream direction and aligns itself in the second groove (1906). When the collet is aligned in the second groove (1906), the collet may be squeezed against the second groove such that its inner surface expands to a slightly larger diameter so that a restriction element (1905) passes through in an upstream direction. When the arming sleeve travels in an upstream direction due to reverse flow, a communication port (1904) may be exposed to well pressure. Alternatively, the holding device may be aligned with the groove when the restriction element passes in a downstream direction and also aligned when the restriction element passes through in an upstream direction enabling passage of the restriction element in both directions. It should be noted that the shape of the first groove, the second groove and the shape of the holding device shown in FIG. 19 is for illustration only and may not be construed as a limitation. Any shape compatible with the design of the tool may be selected for the first groove, the second groove, and the holding device. For example, the shapes of the first groove, the second groove, and the holding device can be selected from a group comprising: rectangular, square, oval, circular, or triangular notch.

According to a preferred exemplary embodiment the holding device prevents the restriction element from traveling upstream after the arming member is functioned. According to another preferred exemplary embodiment, the holding device allows the restriction element to continue to travel upstream such that the said arming member is functioned. It should be noted that the term functioned and armed as referenced herein may be used interchangeably to indicate arming of a rupture disk.

Figure 20:
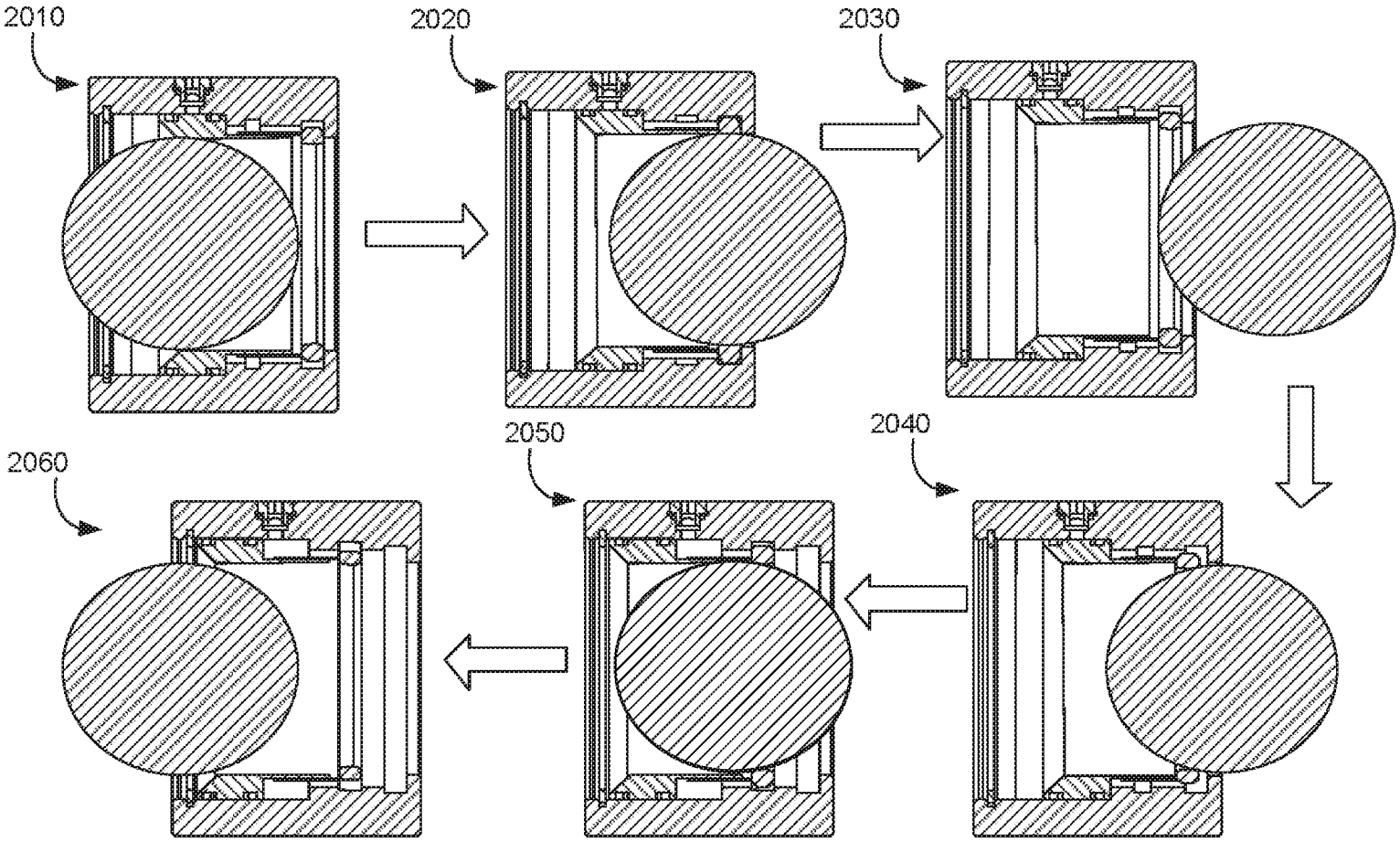
FIG. 20 illustrates steps of arming and actuating a catch-and-release downhole tool with an exemplary reverse flow catch-and-release arming apparatus of FIG. 19 according to a preferred embodiment of the present invention.

FIG. 20 (2010, 2020, 2030, 2040, 2050, 2060) illustrates the sequential positions of the arming apparatus of FIG. 19 during a typical reverse flow operation when a restriction element passes through the apparatus in a downstream direction and flows back in a upstream direction. The following steps generally illustrate the functioning of a typical catch-and-release apparatus described in FIG. 19.

(1) installing the wellbore casing along with the downhole at predefined positions;

The downhole tool may be the catch-and-release tool described in FIG. 17 (1700). The downhole tool may be configured with the catch-and-release apparatus of FIG. 19.

(2) deploying a restriction element into the wellbore casing;

FIG. 20 (2010) generally illustrates a restriction element reaching the downhole tool and the arming apparatus.

(3) passing the restriction element downhole tool in a downstream direction;

FIG. 20 (2020) generally illustrates the restriction element passing the arming apparatus in a downstream direction.

(4) reversing flow from downstream to upstream and flowing back the restriction element;

FIG. 20 (2030) generally illustrates the restriction element flowing back in a reverse direction towards the arming apparatus in an upstream direction.

(5) engaging the restriction element onto the holding device (1405);

FIG. 20 (2040) generally illustrates the restriction element engaging onto the holding device. The holding device may be misaligned in the first groove such that the inner diameter of the passage is less than the diameter of the restriction element and thereby restricting passage of the restriction element in an upstream direction.

(6) pushing an arming member in a reverse direction from downstream upstream;

FIG. 20 (2050) generally illustrates the restriction element engaging onto the holding device and pushing the arming member in an upstream direction. A collet may be misaligned in the groove and restricting passage of the restriction element in an upstream direction.

(7) exposing and arming a communication port to uphole pressure; and (8) releasing the restriction element in an upstream direction.

FIG. 20 (2060) generally illustrates a communication port exposed to well pressure. When the restriction element engages onto the collet due to reverse flow or other means, the collet travels in an upstream direction and aligns itself in the second groove. When the collet is aligned in the second groove, the collet may be squeezed against the second groove such that its inner surface expands to a slightly larger diameter so that a restriction element passes through in an upstream direction.

Preferred Exemplary Seat Forming Apparatus

Figure 21:
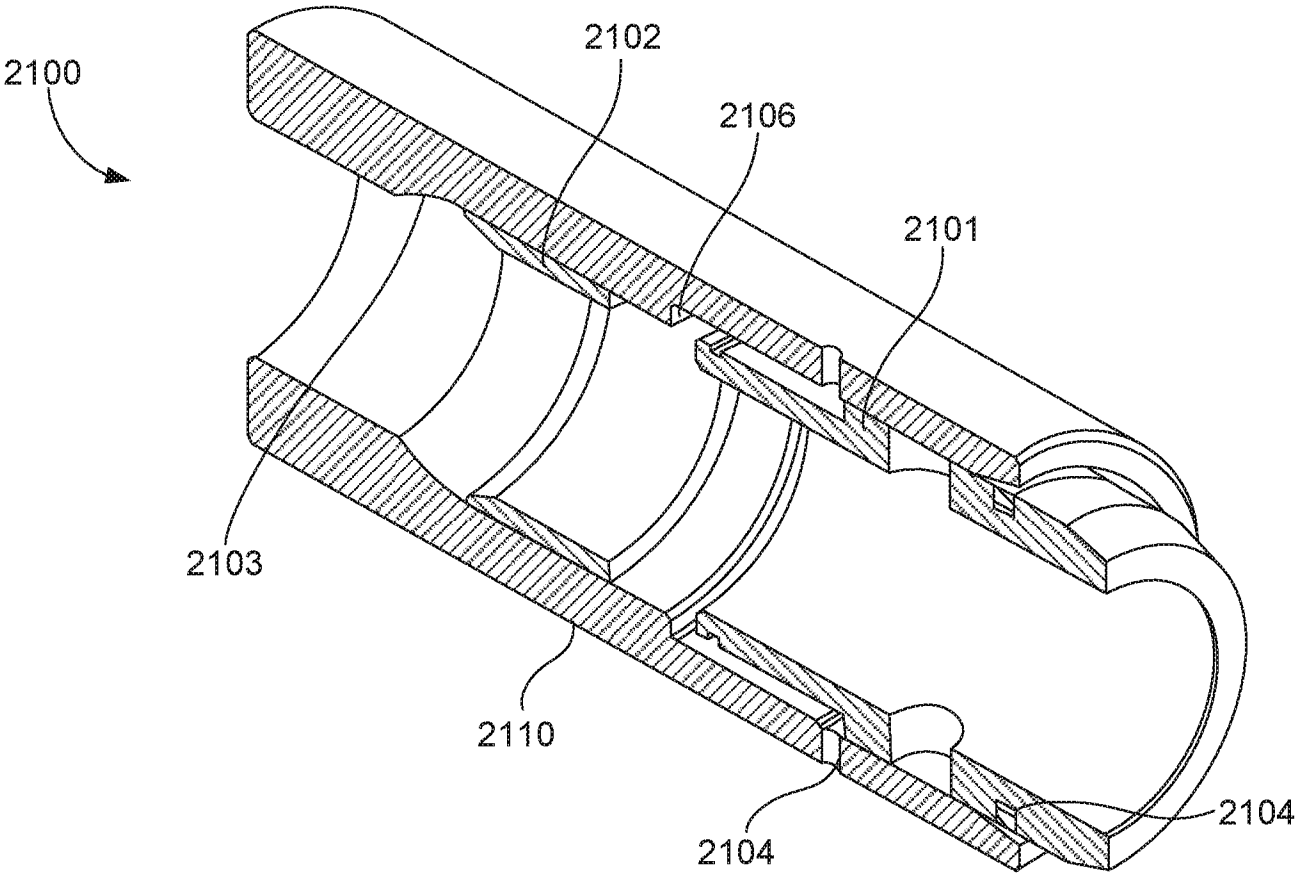
FIG. 21 illustrates an exemplary cross section and perspective view of a seat forming apparatus in a downhole tool with a curved inner surface in the outer housing according to a preferred embodiment of the present invention.
Figure 22:
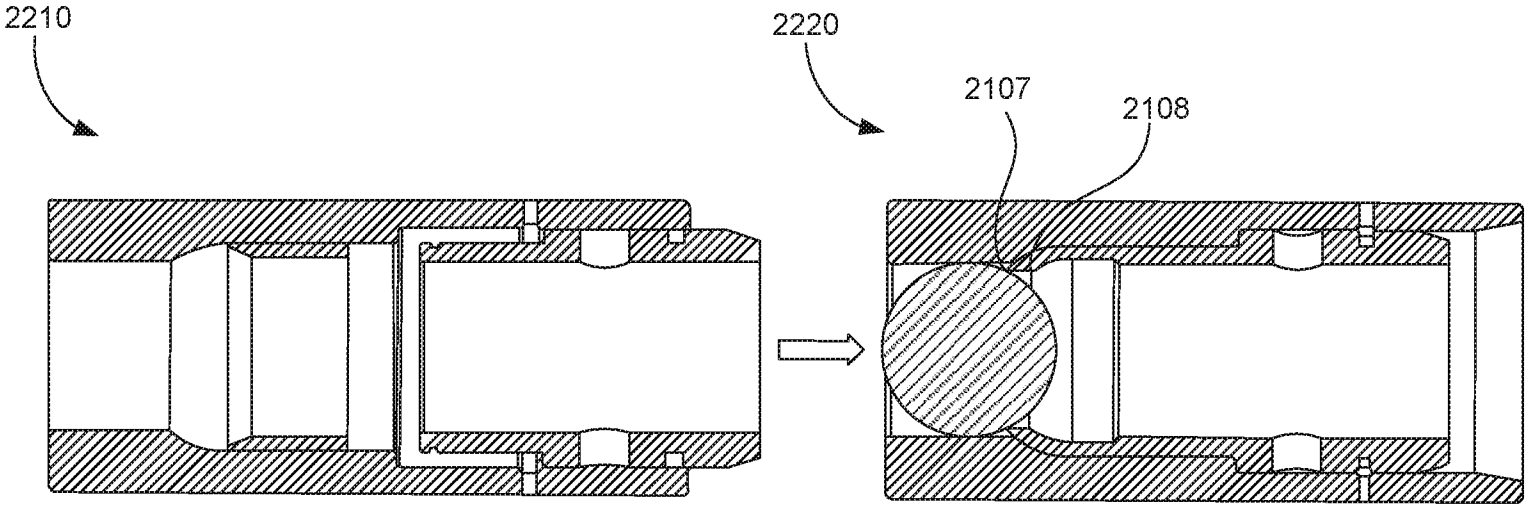
FIG. 22 illustrates cross section view of steps of forming a seat in a catch-and-engage tool with a curved inner surface in the outer housing according to a preferred embodiment of the present invention.

FIG. 21. (2100) generally illustrates a perspective view of a seat forming apparatus conveyed with a downhole tool. The seat forming apparatus may comprise a driving member (2101) and seating restriction (2102). The driving member and the seating restriction may be mechanically disposed within an outer housing of the downhole tool. The driving member drives into the seating restriction and forms a seat in the downhole tool. The seat so formed has an inner diameter such that a restriction element may be seated in the seat. The inner diameter of the seat may be smaller than the inner diameter of the restriction element such as a ball. A driving member such as a movable connection sleeve (2101) may be positioned longitudinally within an outer housing (2110). The apparatus may further comprise a seating restriction (2102) positioned proximally to the connection sleeve (2101). The driving member such as a connection sleeve (2101) may be operatively coupled to an upstream end of the port sleeve in a catch-and-engage tool as illustrated in FIG. 9 (0900). A section in the driving member (2101) may be designed to deform inwards towards the inside of the casing and form a seating surface when the driving member is driven to slide into the seating restriction (2102). According to another exemplary embodiment, a driving member is driven in an upstream direction such that the upstream end of the driving member pushes into the seating restriction and deforms the seating restriction to form a seating surface. During the formation of the seat, the seating restriction may swage against a curved inner surface (2103) in the outer housing or a mandrel of the downhole tool. The apparatus may further comprise a collet (2105) that aligns into a groove (2104) recessed in the outer housing. When the collet aligns in the groove, the driving member may be substantially locked and the movement of the driving member may be substantially restricted so that there is no further deformation of the seat. FIG. 22 generally illustrates the steps of forming a seat with the apparatus shown in FIG. 21 (2100). The driving member may be initially in a position illustrated in FIG. 22 (2210) when there is no driving force. Upon activation of another sleeve or other driving means, the driving member is driven into the seating restriction as illustrated in FIG. 22 (2220). Locking/aligning of the collet in the groove as illustrated in FIG. 22 (2220) provides stability to the formed seat such that the seat does not substantially move when a restriction element (2107) lands in the seat (2108). An uphole stop (2106) may further prevent uphole movement of the driving member. According to another exemplary embodiment, the mechanical strength of the seating restriction may be lower than the mechanical strength of the driving member. For example, the ratio of mechanical strength of the seating restriction to the mechanical strength of the seat end may range from 0.1 to 0.5.

Figure 23:
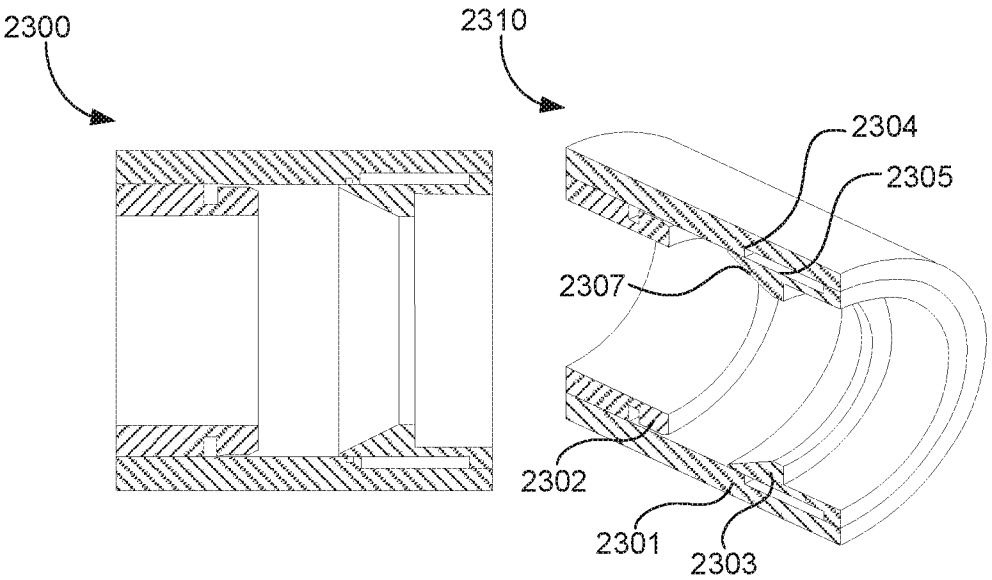
FIG. 23 illustrates an exemplary cross section and perspective view of a seat forming apparatus with a wedge shaped end in a downhole tool according to a preferred embodiment of the present invention.
Figure 24:
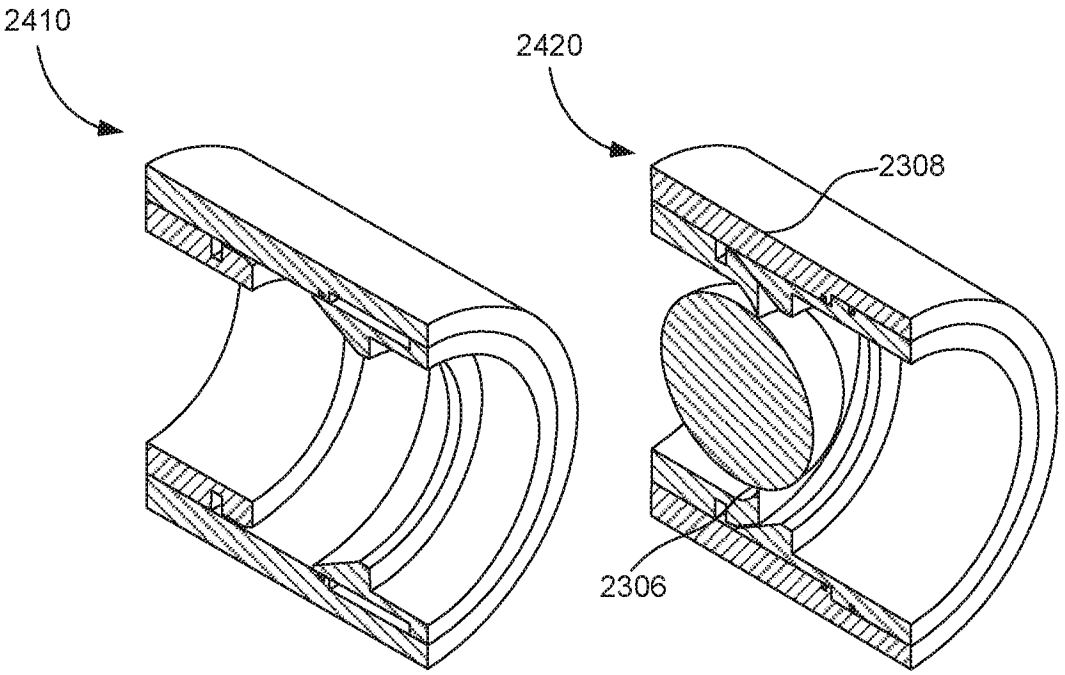
FIG. 24 illustrates perspective view steps of forming a deflected deformed seat with a wedge shaped end in a catch-and-engage tool according to a preferred embodiment of the present invention.

The driving member may be configured with a seat end (2307) as illustrated in FIG. 23 (2300, 2310) and FIG. 24. The driving member (2303) may be driven in an upstream direction into an air chamber (2305) between the driving member and the outer housing (2301) towards a uphole stop (2304). The ratio of the area of either ends of the driving member are chosen such that a larger pressure is acted on the end towards the air chamber. The driving member deforms and buckles inwards to create a seat when a larger pressure acts on the connection sleeve. For example, a ratio of the areas of the seat end to the other end may be chosen to be 4. The selected ratio creates a pressure on the thin section of the seat end that is 4 times the pressure acted on the other end of the driving member. The seat end of the driving member shaped as a wedge may be driven into the interface (2308) between a seating restriction (2302) and the outer housing (2301). The seating restriction may buckle or deform inwards towards the casing and form a seat (2306) when the seat end is driven into the interface. FIG. 24 (2410) and FIG. 24 (2420) illustrate before and after a seat (2306) is formed by driving a ramped end (seat end) with a wedge shape of a driving member (2303) into a seating restriction (2302).

According to yet another exemplary embodiment, the apparatus may further comprise a ramped restriction, whereby when the driving member travels in an upstream direction such that a flat part of the seat end swages into a ramp in the ramped restriction, the seat end bulges inwards to form a seating surface. A ramped restriction may be positioned at an upstream end of the apparatus so that the driving member may drive against the ramp in the ramped restriction and form a seating surface.

Figure 25:
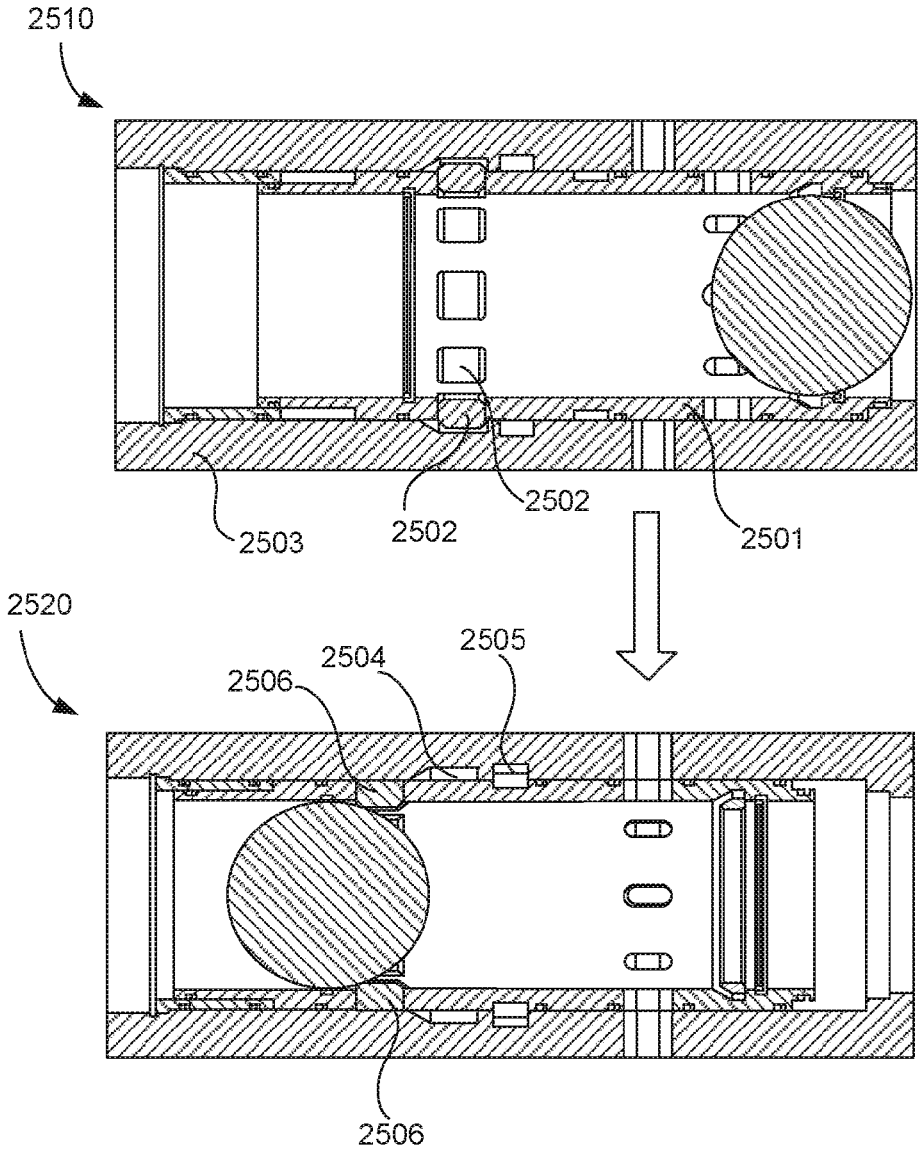
FIG. 25 illustrates an exemplary cross section of an alternate seat forming apparatus with dog elements and a driving member in a downhole tool according to a preferred embodiment of the present invention.

FIG. 25 (2510, 2520) generally describes a seat forming apparatus for use in a downhole tool. The seat forming apparatus may comprise a driving member (2501) and a plurality of dog elements (2502). The driving member may be a sleeve that is movable within the outer housing of the tool. The dog elements (2502), typically between 2 and 20, may be mechanically and circumferentially disposed and movable within an outer housing (2503) of the downhole tool. Furthermore, the dog elements may be aligned in grooves (2504) recessed in the outer housing of the downhole tool in a first position as illustrated in FIG. 25 (2510). The dog elements may be disengaged from the grooves in a second position as illustrated in FIG. 25 (2520). When the driving member (2501) travels in a reverse direction from upstream to downstream and enables the dog elements to move from said first position (2510) to the second position (2520), the dog elements (2502) disengage from the grooves (2504) and form a seat (2506) in the downhole tool. The formed seat is configured to allow a restriction element to be seated in said seat. The inner diameter of the formed seat (2506) may be smaller than the diameter of a restriction element so that the restriction element may be seated in the formed seat (2506). A locking mechanism such as a latch or a snap ring (2505) may be mechanically designed to further prevent substantial movement of the driving member (2501) when a seat is formed. According to a preferred exemplary embodiment, the seat may be formed at an upstream end of the downhole tool. The seat forming apparatus may be disposed mechanically in any downhole tool such as the catch-and-engage tool described with respect to FIG. 9 (0900).

Preferred Exemplary Seat Formation in a Downhole Tool Flowchart Embodiment (2600)

Figure 26:
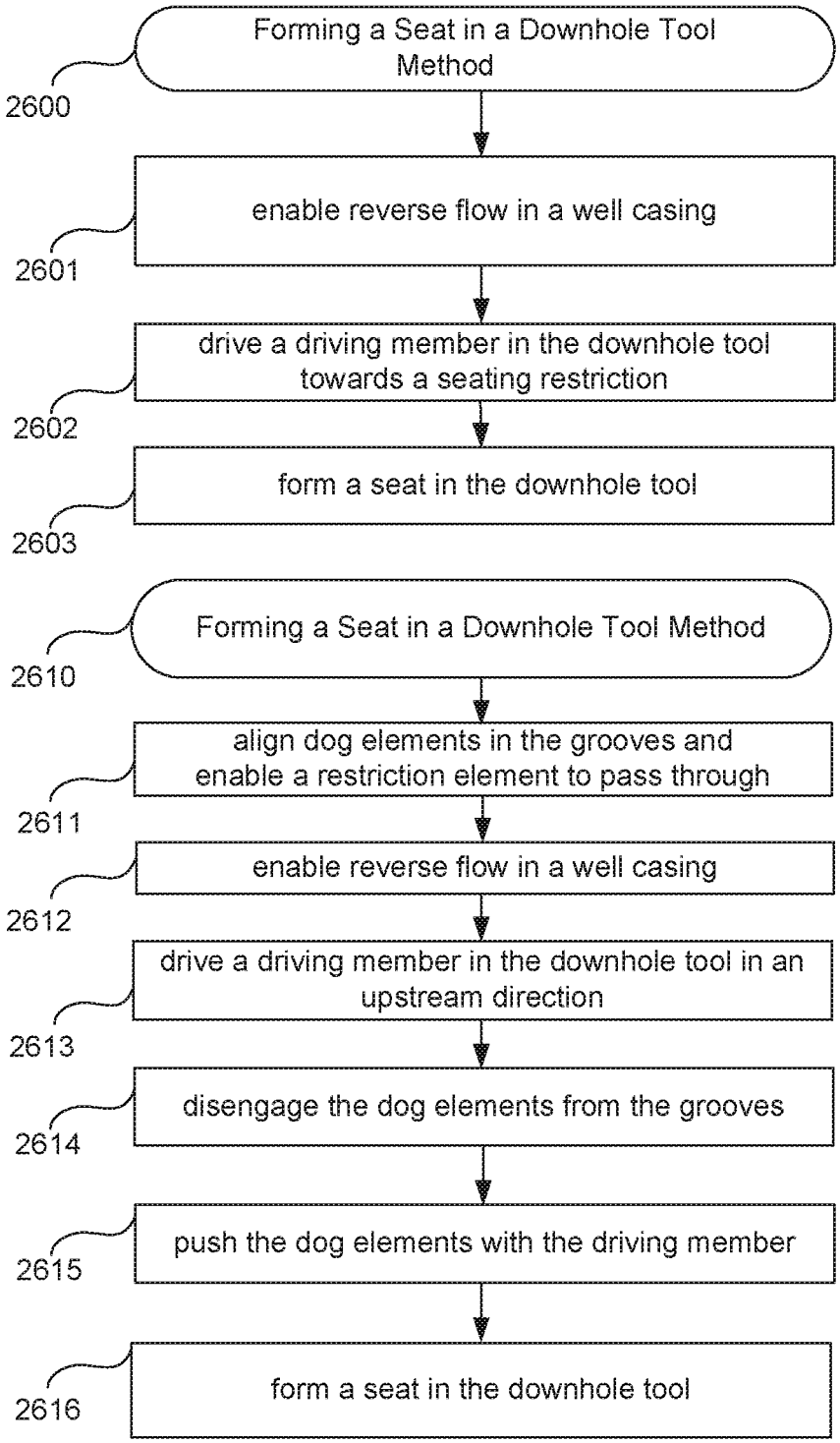
FIG. 26 is a detailed flowchart of forming a seat in a downhole tool according to a preferred embodiment of the present invention.

As generally seen in the flow chart of FIG. 26 (2600), a preferred exemplary seat formation in a downhole tool method in conjunction with a seat forming apparatus may be generally described in terms of the following steps:

(1) Enabling reverse flow in a wellbore casing (2601);

A downhole tool may be the catch-and-engage tool described in FIG. 9 (0900). The downhole tool may be installed in a wellbore casing or any tubing string. The downhole tool may be configured with seat forming apparatus of FIG. 21 (2100) or FIG. 23 (2300).

(2) driving a driving member towards a seating restriction (2602); and

When a restriction element flow back due to reverse flow and drives a port sleeve, the port sleeve may in turn drive a driving member such as a connection sleeve in an upstream direction.

(3) forming a seat (2603).

A seat may be formed such that a restriction element deployed into the well casing may be seated without substantial movement of the formed seat.

The exemplary forming step (2603) may further be described in terms of the following steps.

(1) swaging the seating restriction along a curved inner surface of the downhole tool;

The seating restriction might swage against an inner surface (2103) of downhole tool and bend/buckle inwards as shown in FIG. 21 (2100). The curvature may further determine the size of the seat formed. For example if the length of the upstream end swaging against the inner surface is small, the inner diameter of the seat is bigger. Similarly if the length of the upstream end swaging against the inner surface is bigger, the inner diameter of the seat is smaller.

(2) forming said seat in said seating restriction; and

A seat may be formed at an upstream end of the downhole tool. The inner diameter of the seat may be such that a restriction element is prevented from passing through in a downstream direction, but allowed to be seated on the seat.

(3) locking said driving member at a predefined location.

The predefined position that the driving member locks may determine the inner diameter of the seat formed.

When the driving member is locked within a shorter distance, the diameter of the formed seat may be larger.

The exemplary forming step (2603) may further be described in terms of the following steps.

(1) driving a wedge in the driving member towards said seating restriction;

The seat end of the driving member shaped as a wedge may be driven into the interface (2308) between a seating restriction (2302) and the outer housing (2301) as illustrated in FIG. 23 (2300).

(2) buckling said seating restriction inwards to form said seat; and

The seating restriction may buckle or deform inwards towards the casing and form a seat (2306) as illustrated in FIG. 23 (2300).

(3) holding said driving member at a predefined location.

The driving member may be stopped with a shoulder built into the outer housing such that there is not substantial movement of the driving member in an upstream direction.

The exemplary forming step (2603) may further be described in terms of the following steps.

(1) driving a thin end in said driving member towards said seating restriction;

(2) buckling said thin end inwards to form said seat; and (3) locking said driving member at a predefined location.

The exemplary forming step (2603) may further be described in terms of the following steps.

(1) driving a flat end in said driving member towards a ramp in said seating restriction;

(2) deforming said flat end inwards to form said seat; and (3) locking said driving member at a predefined location.

Preferred Exemplary Seat Formation in a Downhole Tool Flowchart Embodiment (2610)

As generally seen in the flow chart of FIG. 26 (2610), a preferred exemplary seat formation in a downhole tool method in conjunction with a seat forming apparatus of FIG. 25 (2500) may be generally described in terms of the following steps;

(1) aligning the dog elements in the grooves and enabling a restriction element to pass through (2611);

The dog elements may be aligned in the grooves in a first position as illustrated in FIG. 25 (2510).

(2) Enabling reverse flow in a wellbore casing (2612);

A downhole tool may be the catch-and-engage tool described in FIG. 9 (0900). The downhole tool may be installed in a wellbore casing or any tubing string. The downhole tool may be configured with seat forming apparatus of FIG. 21 (2100) or FIG. 23 (2300).

(3) driving a driving member in a upstream direction (2613); and

When a restriction element flow back due to reverse flow and drives a port sleeve, the port sleeve may in turn drive a driving member such as a connection sleeve in an upstream direction.

(4) disengaging the dog elements from the grooves (2614);

The dog elements may be disengaged in the grooves in a second position as illustrated in FIG. 25 (2520).

(5) pushing the dog elements with the driving member (2615);

(6) forming a seat (2616).

Preferred Exemplary Reverse Flow Multiple Tool System Embodiment (2700)

Figure 27:
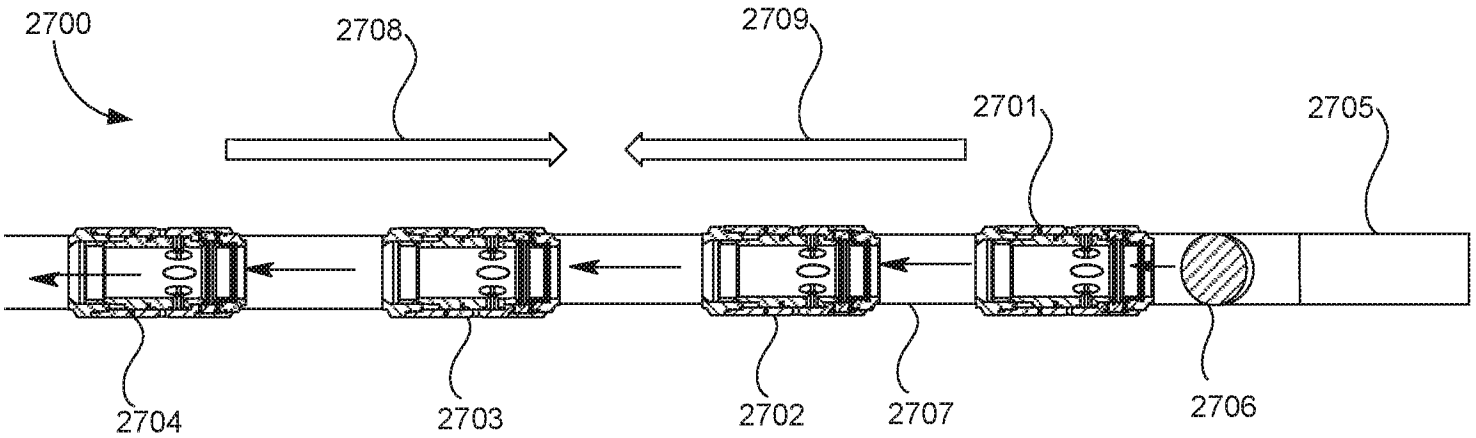
FIG. 27 illustrates an exemplary cross section view of a reverse flow system with multiple catch-and-release sleeves and a catch-and-engage sleeve according to a preferred embodiment of the present invention.

As generally illustrated in FIG. 27 (2700), a multiple tool system comprises a plurality of catch-and-release tools and a catch-and-engage tool. The plurality of catch-and-release tools and a catch-and-engage tool may be conveyed with a well casing (2707). The catch-and-release tools (2701, 2702, 2703) may be positioned downstream (2708) of the catch-and-engage tool (2704). The catch-and-release tools may be similar to the tools described with respect to FIG. 19 (0900). The catch-and-engage tool may be similar to the tool described with respect to FIG. 19 (1900). The catch-and-release tools allow a restriction element (2706) to pass thorough in a downstream direction (2708) and after arming the tool, release the restriction element to pass through the tool in an upstream direction (2709). According to a preferred exemplary embodiment a deformed seat is not formed in the catch-and-release tools. The catch-and-engage tool allows a restriction element (2706) to pass through in a downstream direction (2708) and after arming/functioning the tool, restrict the restriction element from passing through the tool in an upstream direction (2709). Each of the tools in the system (2700) may be actuated when a pilot hole is present. Optionally, each of the tools in the system (2700) may be armed and actuated when a rupture disk is designed into the outer housing of the tools. Alternatively, each of tool may open after a pre-determined time delay. Instead, each of tool may close after a pre-determined time delay for diversion purposes. According to a preferred exemplary embodiment a deformed seat is formed in the catch-and-engage tool at an upstream end of the tool (2704). According to a preferred exemplary embodiment, the number of catch-and-release tools may range from 1 to 100. According to a more preferred exemplary embodiment, the number of catch-and-release tools may range from 3 to 5. The number of tools in a multiple tool configuration may depend on the number of stages and the number of perforations required per stage. As there are multiple stages per well, multiple clusters per stage (typically 3 to 15) and multiple perforating guns in each cluster (typically 4-6), each stage with multiple clusters may be armed and actuated by a single restriction element. According to a preferred exemplary embodiment, a pressure spike indication at the surface of the well may monitor the number of tools armed and actuated in the casing. The ability to monitor pressure at the surface may enable detection of faulty tools or defects in the casing.

According to a preferred exemplary embodiment the system as illustrated in FIG. 27 (2700) (first system) may be attached to a second multiple tool reverse flow system (second system) that is positioned immediately upstream of the first system. A second restriction element may function multiple tools in the second system in a reverse direction and seat in the seat formed in the catch-and-engage tool of the first system. According to another preferred exemplary embodiment the first system creates a first fracturing stage (first stage) in a hydrocarbon formation and the first stage may be treated with fracturing fluids after each of the tools establish communication to wellbore. Similarly the second system creates a second fracturing stage (second stage) in the hydrocarbon formation and the second stage may be treated with fracturing fluids after each of the tools in the second system establish communication to wellbore. According to yet another preferred exemplary embodiment when the second restriction element seats is the seat, the second restriction element isolates the first stage from the second stage during fracture treatment of the second stage. The inner diameter (first diameter) of the tools in the first system may be substantially same. Similarly, the inner diameter (second diameter) of the tools in the second system may be substantially same. A ratio of the first diameter to the second diameter may range from 0.25 to 1. The number of stages may range from 1 to 500. In a 20,000 ft horizontal well, there might be 500 of 40-ft length casing joints, each joint connected by valves. Therefore there may be 500 stages in the wellbore casing and each stage may be configured with the system of FIG. 27 (2700) and each of the stages may be actuated or functioned by a distinct restriction element. For example, the first stage may be actuated by a first restriction element and the second stage may be actuated by a second restriction element.

According to a preferred exemplary embodiment each of the plurality of catch-and release tools and the catch-and-engage tool are configured with a tool inner diameter; and a ratio of a diameter of the restriction element to the tool inner diameter may range from 0.25 to 0.99. For example, the inner diameter of each of the catch-and-release tools may be 5 inches and the diameter of the restriction element may be 4.5 inches and the ratio may be calculated as 0.9.

According to a preferred exemplary embodiment said a ratio of the tool inner diameter and a diameter of the wellbore casing may ranges from 0.25 to 1.25. For example, the inner diameter of each of the catch-and-release tools may be 5 inches and the diameter of the well casing may be 4.25 inches and the ratio may be calculated as 0.85. In another example, the inner diameter of each of the catch-and-release tools may be 4.25 inches and the diameter of the well casing may be 5 inches and the ratio may be calculated as 1.17.

According to another preferred exemplary embodiment each of the plurality of catch-and-release tools and the catch-and-engage tool are conveyed to pre-defined locations with a tubing in the wellbore. In this case, the wellbore casing may be installed and each of the tools may be conveyed by tubing or coil tubing to the predefined locations in the wellbore casing. Optionally, the tools may be conveyed with a tubing to predefined locations in an open hole wellbore. The predefined locations may be determined based on various factors such as nature of hydrocarbon formation, orientation of the preferred fracture planes and so on. According to another preferred exemplary embodiment each of the plurality of catch-and-release tools and the catch-and-engage tool are conveyed with the wellbore casing.

Preferred Exemplary Reverse Flow Multiple Tool Functioning Method Flowchart Embodiment (2800)

Figure 28A:
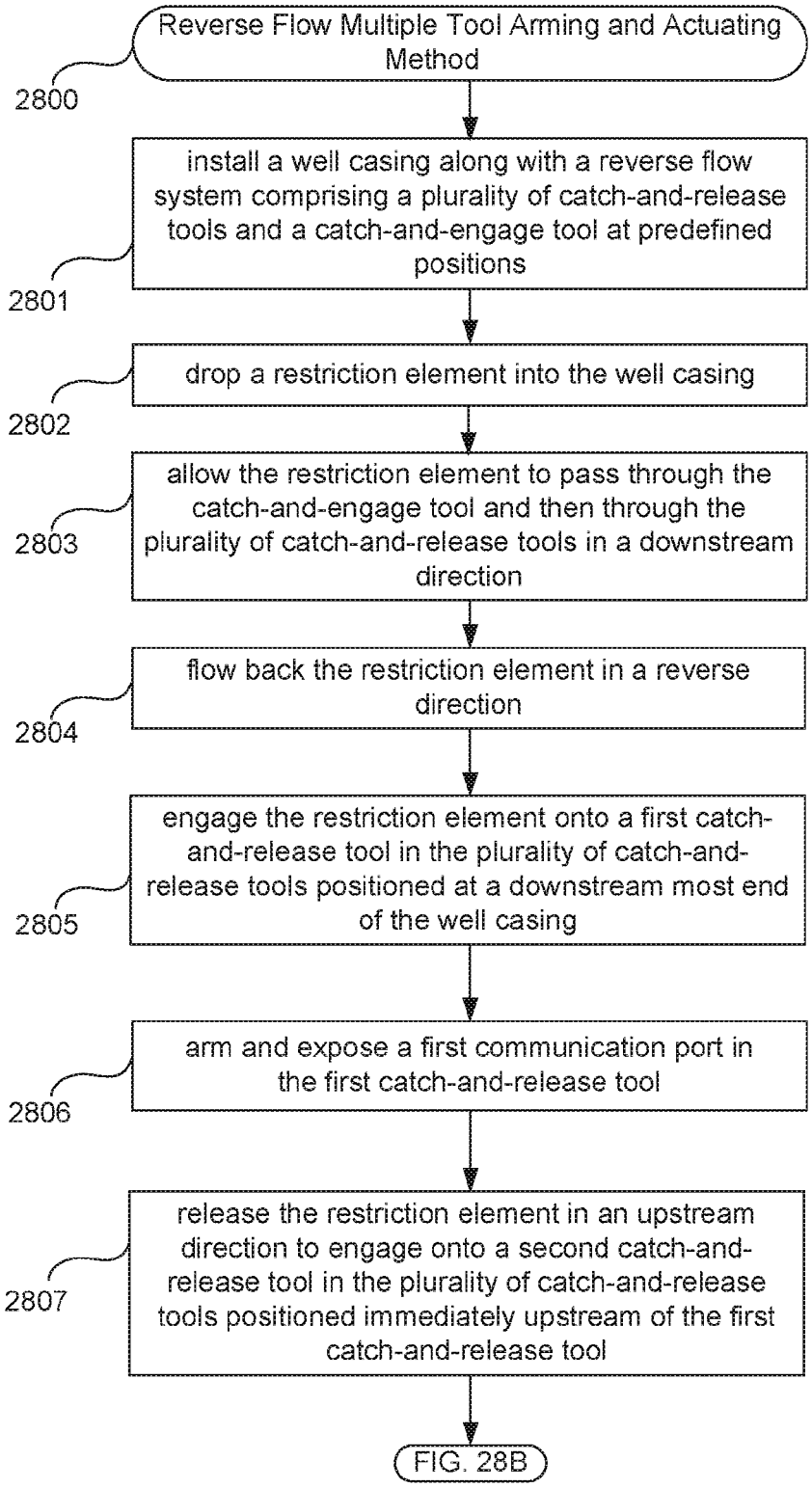
FIG. 28A and FIG. 28B are a detailed flowchart of arming and actuating method with a reverse flow system with multiple catch-and-release sleeves and a catch-and-engage sleeve in FIG. 27 used in some exemplary invention embodiments.
Figure 28B:
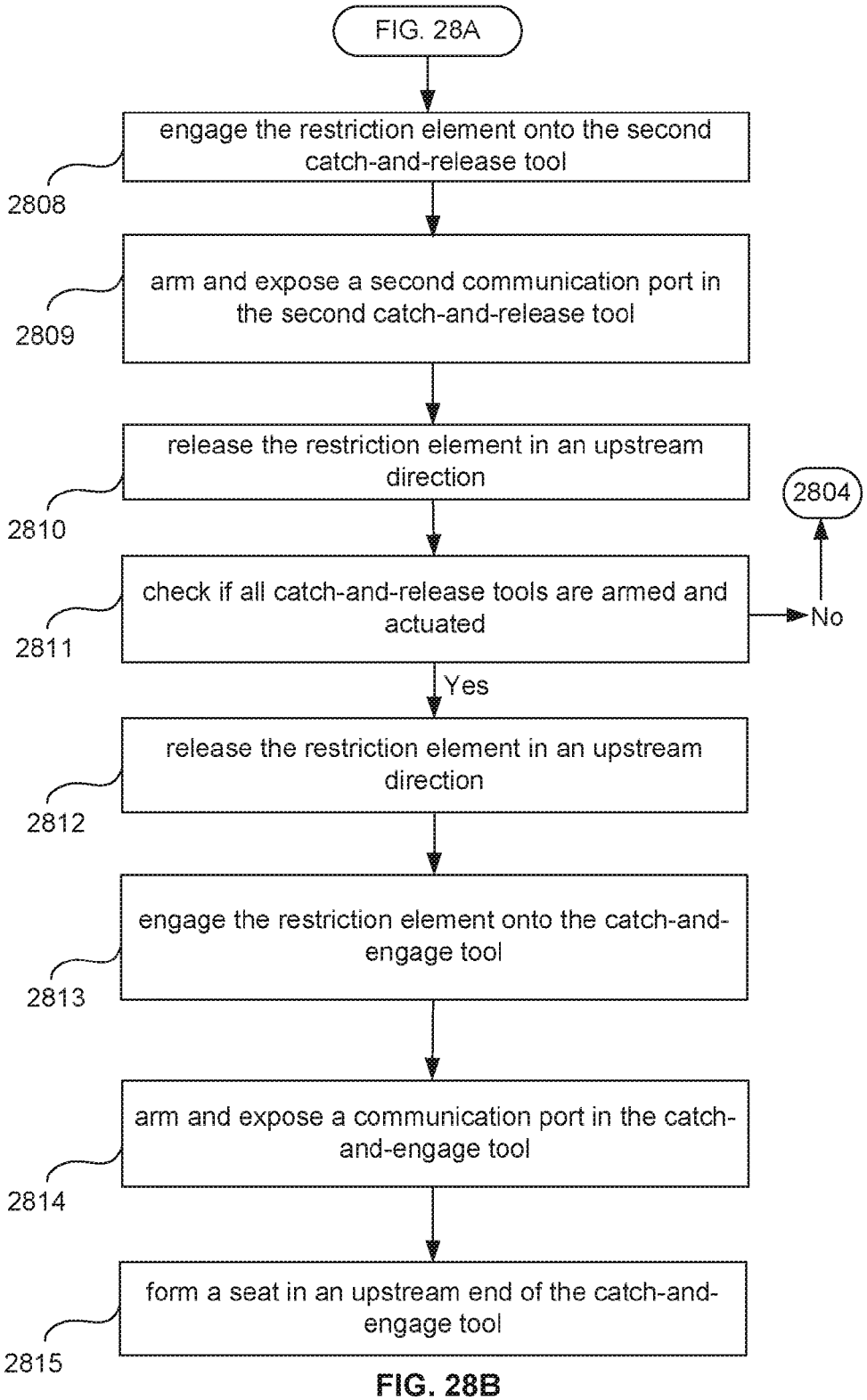

As generally seen in the flow chart of FIG. 28A and FIG. 28B, reverse flow multiple tool functioning method in conjunction with a system comprising a plurality of catch-and-release tools and a catch-and-engage tool, the method may be generally described in terms of the following steps:

(1) installing the well casing (2801);

Each of the plurality of catch-and-release tools and the catch-and-engage tool may be conveyed to pre-defined locations with a tubing in the wellbore. In this case, the wellbore casing may be installed and each of the tools may be conveyed by tubing or coil tubing. The predefined locations may be determined based on various factors such as nature of hydrocarbon formation, orientation of the preferred fracture planes and so on. According to another preferred exemplary embodiment each of the plurality of catch-and-release tools and the catch-and-engage tool are conveyed with the wellbore casing.

(2) deploying a restriction element into the well casing (2802);

(3) allowing the restriction element to pass through the catch-and-engage tool and then through said plurality of catch-and-release tools in a downstream direction (2803);

With reference to FIG. 27 (2700), the restriction element may pass through the catch-and-engage tool (2704) and then through the plurality of catch-and-release tools (2701, 2702, 2703) in a downstream direction (2708). A toe valve (2705) may be positioned at the toe end of the casing. The restriction element may seat in the toe valve for a first stage of the operations.

(4) flowing back the restriction element in a reverse direction (2704);

(5) engaging the restriction element onto a first catch-and-release tool in the plurality of catch-and-release tools positioned at a downstream most end of the well casing (2805);

The restriction element (2706) may engage onto a holding device such as a collet in a first catch-and-release tool, for example tool (2701).

(6) arming and exposing a first communication port in the first catch-and-release tool (2806);

A communication port may be a pilot hole in tool (2701) may be actuated and exposed to well pressure. Optionally, the communication port may be a port in a rupture disk that may be armed, actuated and exposed to uphole pressure.

(7) releasing the restriction element in an upstream direction to engage onto a second catch-and-release tool in the plurality of catch-and-release tools positioned immediately upstream of the first catch-and-release tool (2807);

The restriction element (2706) may be released from the first catch-and-release tool upstream (2709) towards a second catch-and-release tool and engage onto a holding device such as a collet in a second catch-and-release tool, for example tool (2702).

(8) engaging the restriction element onto the second catch-and-release tool (2808);

(9) arming and exposing a second communication port in the second catch-and-release tool (2809);

A communication port may be a pilot hole in tool (2702) may be actuated and exposed to uphole pressure. Optionally, the communication port may be a port in a rupture disk that may be armed, actuated and exposed to uphole pressure.

(10) releasing the restriction element in an upstream direction (2810);

(11) repeating the step (4) to step (10) until all of the plurality of catch-and-release tools are armed and exposed (2811);

The restriction element may perform the steps (4) to step (10) for the catch-and-release tools in each stage. For example, if catch-and-release tools (2701, 2702, 2703) are in the first stage, the steps (4) to step (10) are repeated for each of the tools.

(12) releasing the restriction element in an upstream direction (2812);

The restriction element (2706) may be released from a catch-and-release tool upstream (2703) towards a catch-and-engage tool (2704).

(13) engaging the restriction element onto the catch-and-engage tool (2813);

The restriction element (2706) may be engaged onto a holding device in catch-and-engage tool (2704) and push an arming sleeve upstream.

(14) arming and exposing a communication port in the catch-and-engage tool (2814); and A communication port such a pilot hole in tool (2704) may be actuated and exposed to uphole pressure. Optionally, the communication port may be a port in a rupture disk that may be armed, actuated and exposed to uphole pressure.

(15) forming a seat in an upstream end of the catch-and-engage tool (2815).

A seat may be formed in an upstream end of tool (2704) may be armed and exposed to well pressure. The restriction element may then be pumped back to seat in the tool that is positioned at the most downstream end of the current stage. For example, the restriction element may flow down to seat in a toe valve (2705). In subsequent stages the restriction element may be seated in the seat formed in catch-and-engage tool (2704) so that the stage is isolated from stages positioned upstream. Each stage may be fracture treated after the seating of the restriction element and isolation of the downstream stage.

System Summary

The present invention system anticipates a wide variety of variations in the basic theme of extracting gas utilizing wellbore casings, but can be generalized as a multiple tool reverse flow system in a wellbore casing for use in a wellbore, the system comprising a plurality of catch-and-release tools and a catch-and-engage tool, wherein;

the plurality of catch-and-release tools are configured to allow a restriction element to pass through in a downstream direction;

the catch-and-release tools are configured to engage and then allow the restriction element to pass through in an upstream direction;

the catch-and-engage tool is configured allow the restriction element to pass through only in a downstream direction;

the catch-and-engage tool is configured to engage and restrict travel of the restriction element in an upstream direction;

the catch-and-engage tool is configured to form a seat on an upstream end of the catch-and-engage tool; and the catch-and-engage tool is positioned upstream of all of the plurality of catch-and-release tools.

This general system summary may be augmented by the various elements described herein to produce a wide variety of invention embodiments consistent with this overall design description.

Method Summary

The present invention method anticipates a wide variety of variations in the basic theme of implementation, but can be generalized as a catch-and-engage method;

wherein the method comprises the steps of:

(1) installing the well casing;

(2) deploying the restriction element into the well casing;

(3) allowing the restriction element to pass through the catch-and-engage tool and then through the plurality of catch-and-release tools in a downstream direction;

(4) flowing back the restriction element in a reverse direction;

(5) engaging the restriction element onto a first catch-and-release tool in the plurality of catch-and-release tools positioned at a downstream most end of the well casing;

(6) arming and exposing a first communication port in the first catch-and-release tool;

(7) releasing the restriction element in an upstream direction to engage onto a second catch-and-release tool in the plurality of catch-and-release tools positioned immediately upstream of the first catch-and-release tool;

(8) engaging the restriction element onto the second catch-and-release tool;

(9) arming and exposing a second communication port in a second catch-and-release tool;

(10) releasing the restriction element in an upstream direction;

(11) repeating the step (4) to step (10) until all of the plurality of catch-and-release tools are armed and exposed;

(12) releasing the restriction element in an upstream direction;

(13) engaging the restriction element onto the catch-and-engage tool;

(14) arming and exposing a communication port in the catch-and-engage tool; and

(15) forming a seat in an upstream end of the catch-and-engage tool.

This general method summary may be augmented by the various elements described herein to produce a wide variety of invention embodiments consistent with this overall design description.

System/Method Variations

The present invention anticipates a wide variety of variations in the basic theme of hydrocarbon extraction. The examples presented previously do not represent the entire scope of possible usages. They are meant to cite a few of the almost limitless possibilities.

This basic system and method may be augmented with a variety of ancillary embodiments, including but not limited to:

An embodiment further comprises a second multiple tool reverse flow system (second system); the second system positioned immediately upstream of the first system; wherein a second restriction element functions multiple tools in the second system and seats in the seat formed in the catch-and-engage tool of the first system.

An embodiment wherein the first system creates a first fracturing stage (first stage) in a hydrocarbon formation; the first stage configured to be treated with fracturing fluids.

An embodiment wherein the second system creates a second fracturing stage (second stage) in a hydrocarbon formation; the second stage configured to be treated with fracturing fluids.

An embodiment wherein when second restriction element seats is the seat the second restriction element isolates the first stage from the second stage during fracture treatment of the second stage.

An embodiment further comprises a plurality of multiple tool reverse flow systems; each of the plurality of multiple tool reverse flow systems configured to be actuated by one of a plurality of restriction elements.

An embodiment wherein each of the plurality of multiple tool reverse flow systems is configured to create a single distinct stage in a plurality of stages.

An embodiment wherein a number of the plurality of stages ranges from 1 to 100.

An embodiment wherein the catch-and-release tools do not form a seat on an upstream end of the plurality of catch-and-release tools.

An embodiment wherein after each of the plurality of catch-and-release tools engage the restriction element, the restriction element actuates each of the plurality of catch-and-release tools in a reverse direction.

An embodiment wherein after each of the plurality of catch-and-release tools engage the restriction element, the restriction element arms and actuates each of the plurality of catch-and-release tools in a reverse direction.

An embodiment wherein after the catch-and-engage tool engages the restriction element, the restriction element actuates the catch-and-engage tool in a reverse direction.

An embodiment wherein after the catch-and-engage tool engages the restriction element, the restriction element actuates the catch-and-engage tool in a reverse direction.

An embodiment wherein a number of the plurality of catch-and-release tools range from 1 to 500.

An embodiment wherein an inner diameter of each of the plurality of catch-and-release tools and the catch-and-engage tool is substantially equal.

An embodiment wherein each of the plurality of catch-and-release tools and the catch-and-engage tool are configured with a tool inner diameter; and a ratio of a diameter of the restriction element to the tool inner diameter ranges from 0.5 to 0.99.

An embodiment wherein a ratio of the tool inner diameter and a diameter of the wellbore casing ranges from 0.25 to 1.25.

An embodiment wherein each of the plurality of catch-and-release tools and the catch-and-engage tool are conveyed to predefined locations with a tubing in the wellbore.

An embodiment wherein each of the plurality of catch-and-release tools and the catch-and-engage tool are conveyed with the wellbore casing.

One skilled in the art will recognize that other embodiments are possible based on combinations of elements taught within the above invention description.

CONCLUSION

A multiple tool reverse flow system and method in a wellbore casing for use in a wellbore has been disclosed. The system comprises a plurality of catch-and-release tools and a catch-and-engage tool, wherein the catch-and-release tools allow a restriction element to pass through in a downstream direction and engage and then allow the restriction element to pass through in an upstream direction. The catch-and-engage tool allows the restriction element to pass through only in a downstream direction, engage and restrict travel of the restriction element in an upstream direction. The catch-and-engage tool forms a seat on an upstream end is positioned upstream of all of catch-and-release tools. The restriction element passes through all the tools in a downstream direction and moves back in an upstream direction and actuates each of the tools one at a time.

What is claimed is:

1. A multiple tool reverse flow system in a wellbore casing for use in a wellbore, said system comprising a plurality of catch-and-release tools and a catch-and-engage tool, wherein;

said plurality of catch-and-release tools are configured to allow a restriction element to pass through in a downstream direction;

said catch-and-release tools are configured to engage and then allow said restriction element to pass through in an upstream direction;

said catch-and-engage tool is configured allow said restriction element to pass through only in a downstream direction;

said catch-and-engage tool is configured to engage and restrict ravel of said restriction element in an upstream direction;

said catch-and-engage tool is configured to form a seat on an upstream end of said catch-and-engage tool; and said catch-and-engage tool is positioned upstream of all of said plurality of catch-and-release tools.

2. The multiple tool reverse flow system of claim 1 further comprises a second multiple tool reverse flow system; said second multiple tool reverse flow system positioned immediately upstream of said multiple tool reverse flow system; wherein a second restriction element functions multiple tools in said second multiple tool reverse flow system and seats in said seat formed in said catch-and-engage tool of said multiple tool reverse flow system.

3. The multiple tool reverse flow system of claim 2 wherein said multiple tool reverse flow system creates a first fracturing stage in a hydrocarbon formation; said first fracturing stage configured to be treated with fracturing fluids.

4. The multiple tool reverse flow system of claim 3 wherein said second multiple tool reverse flow system creates a second fracturing stage in a hydrocarbon formation; said second fracturing stage configured to be treated with fracturing fluids.

5. The multiple tool reverse flow system of claim 4 wherein when second restriction element seats in said seat said second restriction element isolates said first fracturing stage from said second fracturing stage during fracture treatment of said second fracturing stage.

6. The multiple tool reverse flow system of claim 2 further comprises a plurality of multiple tool reverse flow systems; each of said plurality of multiple tool reverse flow systems configured to be actuated by one of a plurality of restriction elements.

7. The multiple tool reverse flow system of claim 6 wherein each of said plurality of multiple tool reverse flow systems is configured to create a single distinct stage in a plurality of stages.

8. The multiple tool reverse flow system of claim 6 wherein a number of said plurality of stages ranges from 1 to 100.

9. The multiple tool reverse flow system of claim 1 wherein said catch-and-release tools do not form a seat on an upstream end of said plurality of catch-and-release tools.

10. The multiple tool reverse flow system of claim 1 herein after each of said plurality of catch-and-release tools engage said restriction element, said restriction element actuates each of said plurality of catch-and-release tools in a reverse direction.

11. The multiple tool reverse flow system of claim 1 wherein after each of said plurality of catch-and-release tools engage said restriction element, said restriction element arms and actuates each of said plurality of catch-and-release tools in a reverse direction.

12. The multiple tool reverse flow system of claim 1 wherein after said catch-and-engage tool engages said restriction element, said restriction element actuates said catch-and-engage tool in a reverse direction.

13. The multiple tool reverse flow system of claim 1 wherein after said catch-and-engage tool engages said restriction element, said restriction element actuates said catch-and-engage tool in a reverse direction.

14. The multiple tool reverse flow system of claim 1 wherein a number of said plurality of catch-and-release tools range from 1 to 500.

15. The multiple tool reverse flow system of claim 1 wherein an inner diameter of each of said plurality of catch-and-release tools and said catch-and-engage tool is substantially equal.

16. The multiple tool reverse flow system of claim 1 wherein each of said plurality of catch-and-release tools and said catch-and-engage tool are configured with a tool inner diameter; and a ratio of a diameter of said restriction element to said tool inner diameter ranges from 0.5 to 0.99.

17. The multiple tool reverse flow system of claim 1 wherein said a ratio of said tool inner diameter and a diameter of said wellbore casing ranges from 0.25 to 1.25.

18. The multiple tool reverse flow system of claim 1 wherein each of said plurality of catch-and-release tools and said catch-and-engage tool are conveyed to predefined locations with a tubing in said wellbore.

19. The multiple tool reverse flow system of claim 1 wherein each of said plurality of catch-and-release tools and said catch-and-engage tool are conveyed with said wellbore casing.

20. A reverse flow multiple tool functioning method, said method operating in conjunction with a reverse flow multiple tool system in a wellbore casing, said system comprising a plurality of catch-and-release tools and a catch-and-engage tool; wherein, said plurality of catch-and-release tools are configured to allow a restriction element to pass through in a downstream direction;

said catch-and-release tools are configured to engage and then allow said restriction element to pass through in an upstream direction;

said catch-and-engage tool is configured allow said restriction element to pass through only in a downstream direction;

said catch-and-engage tool is configured to engage and restrict travel of said restriction element in an upstream direction;

said catch-and-engage tool is configured to form a seat on an upstream end of said catch-and-engage tool; and said catch-and-engage tool is positioned upstream of all of said plurality of catch-and-release tools;

wherein said method comprises the steps of:

(1) installing said well casing;

(2) deploying said restriction element into said well casing;

(3) allowing said restriction element to pass through said catch-and-engage tool and then through said plurality of catch-and-release tools in a downstream direction;

(4) flowing back said restriction element in a reverse direction;

(5) engaging said restriction element onto a first catch-and-release tool in said plurality of catch-and-release tools positioned at a downstream most end of said well casing;

(6) arming and exposing a first communication port in said first catch-and-release tool;

(7) releasing said restriction element in an upstream direction to engage onto a second catch-and-release tool in said plurality of catch-and-release tools positioned immediately upstream of said first catch-and-release tool;

(8) engaging said restriction element onto said second catch-and-release tool;

(9) arming and exposing a second communication port in a second catch-and-release tool;

(10) releasing said restriction element in an upstream direction;

(11) repeating said step (4) to step (10) until all of said plurality of catch-and-release tools are armed and exposed;

(12) releasing said restriction element in an upstream direction;

(13) engaging said restriction element onto said catch-and-engage tool;

(14) arming and exposing a communication port in said catch-and-engage tool; and

(15) forming a seat in an upstream end of said catch-and-engage tool.

* * * * *